US007741017B2

(12) United States Patent
Matsunaga et al.

(10) Patent No.: US 7,741,017 B2
(45) **Date of Patent: *Jun. 22, 2010**

(54) SILVER HALIDE COLOR PHOTOGRAPHIC LIGHT-SENSITIVE MATERIAL AND IMAGE FORMATION METHOD USING THE SAME, SILVER HALIDE EMULSION, REDUCING COMPOUND HAVING GROUP ADSORPTIVE TO SILVER HALIDE AND METHOD FOR PRODUCING THE SAME

(75) Inventors: Atsushi Matsunaga, Kanagwa (JP); Tadashi Inaba, Kanagawa (JP); Shinichi Ichikawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/132,239

(22) Filed: Jun. 3, 2008

(65) Prior Publication Data

US 2008/0242860 A1 Oct. 2, 2008

Related U.S. Application Data

(60) Continuation of application No. 10/737,929, filed on Dec. 18, 2003, now abandoned, which is a division of application No. 10/082,111, filed on Feb. 26, 2002, now Pat. No. 6,689,555.

(30) Foreign Application Priority Data

Feb. 26, 2001 (JP) ..... 2001-050336
Sep. 28, 2001 (JP) ..... 2001-303040

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |
| ***G03C 1/06*** | (2006.01) |

(52) U.S. Cl. ..... 430/546; 430/502; 430/631; 430/598; 430/599; 430/607; 430/600; 430/603; 430/611; 430/613

(58) Field of Classification Search ..... 430/502, 430/546, 631, 598–600, 603, 607, 611, 613
See application file for complete search history.

(56) References Cited

U.S. PATENT DOCUMENTS

| | | | |
|---|---|---|---|
| 2,668,112 | A | 1/1954 | De Cat Arthur Henri, et al. |
| 3,751,252 | A | 8/1973 | Smith et al. |
| 4,137,079 | A | 1/1979 | Houle |
| 4,332,889 | A | 6/1982 | Siga et al. |
| 4,334,010 | A | 6/1982 | Mifune et al. |
| 4,395,484 | A | 7/1983 | McCarney |
| 5,006,444 | A | 4/1991 | Okada et al. |
| 5,084,376 | A | 1/1992 | Suda et al. |
| 5,314,798 | A | 5/1994 | Brust et al. |
| 5,322,767 | A | 6/1994 | Ohshima et al. |
| 5,538,843 | A | 7/1996 | Hioki et al. |
| 5,563,025 | A | 10/1996 | Ishii et al. |
| 5,667,959 | A | 9/1997 | Mikoshiba et al. |
| 5,719,007 | A | 2/1998 | Sakurazawa et al. |
| 5,780,218 | A | 7/1998 | Mifune et al. |
| 5,837,436 | A | 11/1998 | Mihayashi et al. |
| 5,932,409 | A | 8/1999 | Taniguchi et al. |
| 5,935,772 | A | 8/1999 | Tamaoki et al. |
| 5,958,668 | A | 9/1999 | Matsumoto et al. |
| 5,968,725 | A | 10/1999 | Katoh et al. |
| 5,998,126 | A | 12/1999 | Toya et al. |
| 6,010,842 | A | 1/2000 | Suga et al. |
| 6,083,680 | A | 7/2000 | Ito et al. |
| 6,090,538 | A | 7/2000 | Arai et al. |
| 6,120,983 | A | 9/2000 | Okada et al. |
| 6,143,488 | A | 11/2000 | Uytterhoeven et al. |
| 6,171,775 | B1 | 1/2001 | Nishikawa |
| 6,258,518 | B1 | 7/2001 | Taniguchi et al. |
| 6,379,880 | B1 | 4/2002 | Katoh |
| 6,426,181 | B2 | 7/2002 | Irving et al. |
| 6,610,450 | B2 | 8/2003 | Yang et al. |
| 6,689,553 | B2 | 2/2004 | Sakurazawa et al. |
| 6,689,555 | B2 | 2/2004 | Matsunaga et al. |
| 6,924,091 | B2 | 8/2005 | Hosoya et al. |
| 7,026,109 | B2 | 4/2006 | Ohzeki et al. |
| 7,147,999 | B2 | 12/2006 | Ohzeki et al. |
| 2003/0224307 | A1 | 12/2003 | Yamamoto et al. |
| 2003/0232288 | A1 | 12/2003 | Oka et al. |

(Continued)

FOREIGN PATENT DOCUMENTS

| | | |
|---|---|---|
| EP | 1 220 026 A1 | 7/2002 |

(Continued)

*Primary Examiner*—Geraldina Visconti
(74) *Attorney, Agent, or Firm*—Sughrue Mion, PLLC

(57) ABSTRACT

The present invention relates to a silver halide color photographic light-sensitive material wherein at least one of light-sensitive silver halide emulsion layers includes a silver halide emulsion having a silver chloride content of at least 95 mol % and a silver iodide content of 0.05 mol % to 0.75 mol % and/or a silver bromide content of 0.05 mol % to 4.00 mol % and further at least one compound represented by the following formula (I):

$$X\text{-}(L)_n\text{-}Y \qquad \text{Formula (I)}$$

wherein X represents a group adsorptive to a silver halide, L represents a divalent connecting group comprising one of an atom and an atomic group including at least one of a carbon atom, a nitrogen atom, a sulfur atom and an oxygen atom, Y denotes a reducible group and n denotes an integer of 0 or 1.

20 Claims, No Drawings

U.S. PATENT DOCUMENTS

| | | | |
|---|---|---|---|
| 2004/0033454 | A1 | 2/2004 | Ohzeki et al. |
| 2004/0234906 | A1 | 11/2004 | Ohzeki et al. |
| 2005/0074707 | A1 | 4/2005 | Yamane et al. |
| 2005/0202355 | A1 | 9/2005 | Yoshioka |

FOREIGN PATENT DOCUMENTS

| | | | |
|---|---|---|---|
| JP | 63316743 | | 12/1988 |
| JP | 4-177336 | | 6/1992 |
| JP | 4-368935 | | 12/1992 |
| JP | 6-175266 | | 6/1994 |
| JP | 9-43764 | A | 2/1997 |
| JP | 11-202440 | A | 9/1999 |
| JP | 2000-275767 | A | 10/2000 |
| JP | 2000-330247 | A | 11/2000 |
| JP | 2000-352793 | A | 12/2000 |
| JP | 2002-049136 | | 2/2002 |
| WO | 97/11410 | | 3/1997 |

SILVER HALIDE COLOR PHOTOGRAPHIC LIGHT-SENSITIVE MATERIAL AND IMAGE FORMATION METHOD USING THE SAME, SILVER HALIDE EMULSION, REDUCING COMPOUND HAVING GROUP ADSORPTIVE TO SILVER HALIDE AND METHOD FOR PRODUCING THE SAME

This is a continuation of application Ser. No. 10/737,929 filed Dec. 18, 2003, which is a divisional of application Ser. No. 10/082,111, filed Feb. 26, 2002 now U.S. Pat. No. 6,689,555 issued Feb. 10, 2004. The entire disclosures of the prior patent applications and application numbers are hereby incorporated by reference.

BACKGROUND OF THE INVENTION

1. Field of the Invention

The present invention relates to a silver halide color photographic light-sensitive material and, particularly, to a silver halide color photographic light-sensitive material using a photographic emulsion whose silver chloride content is high and which has high sensitivity, superior raw stock storability and exposure moisture dependency and suppresses fogging and to an image formation method using the light sensitive material. Further, the present invention relates to a compound (a reducing compound having a group adsorptive to a silver halide) having a group adsorptive to a silver halide and a hydroxylamine partial structure, and a method for producing the compound and a silver halide emulsion comprising the compound.

2. Description of the Related Art

Silver iodochloride emulsions including a silver iodochloride layer on the surface or subsurface portion of silver halide particles are desirable because they have high sensitivity and superior adaptability to exposure at high intensity. Representative examples of these silver iodochloride emulsions are disclosed in, for example, U.S. Pat. Nos. 5,550,013, 5,728,516, 5,547,827, 5,605,789, 5,726,005 and U.S. Pat. No. 5,736,310. However, these disclosed methods have the drawback that as an iodine content increases photographically undesirable fogging increases.

It is disclosed in the publication of Japan Patent Application Laid-Open (JP-A) No. 4-368935 that a silver halide color light-sensitive material having superior raw stock storability characteristics can be obtained by using an adsorptive-type reducing compound represented by a hydroquinone compound having a group promoting adsorption to a silver halide particle. However, in this disclosed method, there is no description concerning the effects of, particularly, low fogging, high sensitivity and superior raw stock storability from a silver iodochloride or silver iodochlorobromide emulsion.

It is disclosed in the publication of JP-A No. 9-43764 that a specific hydroxam acid compound serves to obtain a silver halide color photographic light-sensitive material, and its packaging material which prevents pressure fogging when a long light-sensitive material is rolled in and stored at high temperatures. However, in this disclosed method, there is no description as to the effects of a silver iodochloride or silver iodochlorobromide or the effects of an adsorptive type.

In addition to the aforementioned compounds, the following compounds are known as antifoggants. Examples of these antifoggants include hydroxyureas (JP-A Nos. 2000-275767 and 8-246911), phenidones (JP-A No. 2000-330247), hydroxam acids (JP-A Nos. 11-282117, 9-90546, 9-133983, 8-114884, 8-333325 and 8-314051), heterocyclic hydroxylamines (JP-A No. 11-102046), hydroxysemicarbazides (JP-A No. 10-90819), hydroxyamines (JP-A No. 9-197635) and hydrazines (JP-A No. 7-134351 and specification of Japanese Patent No. 2787630). However, these disclosed methods have no particular effects of low fogging, high sensitivity and superior raw stock storability by a silver iodochloride or silver iodochlorobromide emulsion. There is a strong desire to develop compounds having such effects.

Also, we have not been able to find any literature describing detailed conditions of a method for producing a compound having both a group adsorptive to a silver halide and a hydroxylamine partial structure. It has been clarified that when these compounds are synthesized only by applying a generally known synthetic method, a lot of fogging affecting photographic performances arises depending on the condition. In view of this, it is necessary to establish a method of the production of a compound which has the adsorptive group and the hydroxylamine partial structure and is quite free from or remarkably reduced in fogging.

SUMMARY OF THE INVENTION

The present invention is intended to solve the aforementioned problems of the prior art and to attain the following objects. Specifically, a first object of the present invention is to provide a silver halide color photographic light-sensitive material using an emulsion which: includes silver iodochloride, silver chlorobromide or silver iodochlorobromide; has high sensitivity, suppressed fogging, superior raw stock storability and exposure moisture dependency; and is able to make full use of its high sensitivity and applicability to high-intensity exposure; and to provide an image formation method using the light-sensitive material.

A second object of the present invention is to provide a compound, which has a group adsorptive to a silver halide and a hydroxylamine partial structure, and a silver halide emulsion, which are able to attain the first object efficiently.

A third object of the present invention is to provide a method for producing the compound having a group adsorptive to a silver halide and a hydroxylamine partial structure, the compound having no problems concerning photographic performance (particularly fogging does not occur).

According to a first aspect of the present invention, there is provided a silver halide color photographic light-sensitive material comprising, on a support, at least one layer of each of a blue-sensitive silver halide emulsion layer, which includes a yellow coupler, a green-sensitive silver halide emulsion layer, which include a magenta coupler, and a red-sensitive silver halide emulsion layer, which includes a cyan coupler, wherein at least one of said blue-sensitive, green-sensitive and red-sensitive silver halide emulsion layers includes a silver halide emulsion having a silver chloride content of at least 95 mol %, at least one of a silver iodide content of 0.05 mol % to 0.75 mol % and a silver bromide content of 0.05 mol % to 4.00 mol % and further includes at least one compound which is represented by the following Formula (I)

$$X\text{-}(L)_n\text{-}Y \qquad \text{Formula (I)}$$

wherein X represents a group adsorptive to a silver halide, L represents a divalent connecting group comprising one of an atom and an atomic group including at least one of a carbon atom, a nitrogen atom, a sulfur atom and an oxygen atom, Y denotes a reducible group and n denotes an integer of 0 or 1.

According to a second aspect of the present invention, there is provided an image formation method comprising the steps of scan-exposing, on the basis of image information, a silver halide color photographic light-sensitive material and color developing said scan-exposed silver halide color photographic light-sensitive material, wherein said silver halide color photographic light-sensitive material is the above-described silver halide color photographic light-sensitive material.

According to a third aspect of the present invention, there is provided a silver halide emulsion comprising at least one compound represented by the following Formula (IV):

$$X\text{-}(L_1)_n\text{-}Y_3 \qquad \text{Formula (IV)}$$

wherein: X represents a group adsorptive to a silver halide, n denotes an integer of 0 or 1; $L_1$ represents a divalent connecting group, provided that the atom of $L_1$, which is directly connected to $Y_3$, is a carbon atom; $Y_3$ is any group selected from the groups represented by the following ($B_1$) to ($B_4$); and $R_{b1}$, $R_{b2}$ and $R_{b3}$ in the groups represented by the following ($B_1$) to ($B_4$) respectively denotes one of a hydrogen atom, an alkyl group, an alkenyl group, an alkynyl group, an aryl group and a heterocyclic group:

($B_1$)

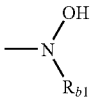

($B_2$)

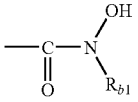

($B_3$)

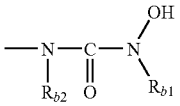

($B_4$)

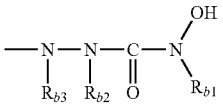

According to a fourth aspect of the present invention, there is provided a compound represented by the following Formula (V):

$$X\text{-}(L_2)_n\text{-}Y_3 \qquad \text{Formula (V)}$$

wherein X represents a group adsorptive to a silver halide; n denotes an integer of 0 or 1; $L_2$ represents a divalent connecting group comprising any one of an alkylene group, —CO—, —$SO_2$—, —NR— and a combination of at least two of these groups, provided that the atom of $L_2$, which is directly connected to $Y_3$, is a carbon atom; R represents one of a hydrogen atom, an alkyl group and an aryl group; $Y_3$ is any group selected from the groups represented by the following ($B_1$) to ($B_4$); $R_{b1}$, $R_{b2}$ and $R_{b3}$ in the groups represented by the following ($B_1$) to ($B_4$) respectively represents one of a hydrogen atom, an alkyl group, an alkenyl group, an alkynyl group, an aryl group and a heterocyclic group.

($B_1$)

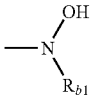

-continued ($B_2$)

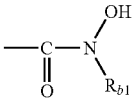

($B_3$)

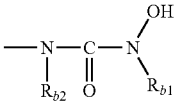

($B_4$)

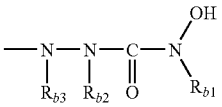

According to a fifth aspect of the present invention, there is provided a method for producing a compound represented by the Formula (VI), the method comprising reacting a urethane derivative having a group adsorptive to a silver halide with a hydroxylamine to obtain the compound:

Formula (VI)

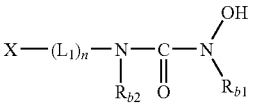

wherein: X represents a group adsorptive to a silver halide; n denotes an integer of 0 or 1; $L_1$ represents a divalent connecting group, provided that the atom of $L_1$ which is directly connected to a nitrogen atom is a carbon atom; and $R_{b1}$ and $R_{b2}$ respectively represents one of a hydrogen atom, an alkyl group, an alkenyl group, an alkynyl group, an aryl group and a heterocyclic group.

According to a sixth aspect of the present invention, there is provided a method for producing a compound represented by the following Formula (IV), wherein, when the hydroxylamine portion is introduced an alkali except for the hydroxylamines is present in an amount which is equal to or more than the neutralization amount for the reaction system:

$$X\text{-}(L_1)_n\text{-}Y_3 \qquad \text{Formula (IV)}$$

wherein X represents a group adsorptive to a silver halide, n denotes an integer of 0 or 1; $L_1$ represents a divalent connecting group, provided that the atom of $L_1$ which is directly connected to $Y_3$ is a carbon atom, $Y_3$ is any group selected from the groups represented by the following ($B_1$) to ($B_4$); $R_{b1}$, $R_{b2}$ and $R_{b3}$ in the groups represented by the following ($B_1$) to ($B_4$) respectively represents one of a hydrogen atom, an alkyl group, an alkenyl group, an alkynyl group, an aryl group and a heterocyclic group:

(B1)

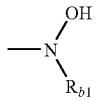

(B2)

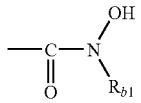

(B3)

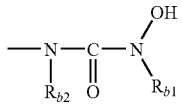

(B4)

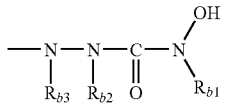

According to a seventh aspect of the present invention, there is provided a silver halide emulsion comprising at least one compound according to the forth aspect of the present invention.

Moreover, according to a eighth aspect of the present invention, there is provided a silver halide color photographic light-sensitive material comprising a silver halide emulsion according to the third aspect of the present invention.

Further, according to a ninth aspect of the present invention, there is provided a silver halide color photographic light-sensitive material comprising a silver halide emulsion according to the seventh aspect of the present invention.

DETAILED DESCRIPTION OF THE PREFERRED EMBODIMENTS

The present invention will be hereinafter explained in detail. A compound having a group adsorptive to a silver halide and a hydroxylamine partial structure, a method for producing the compound, a silver halide emulsion including the compound according to the present invention and a silver halide color photographic light-sensitive material according to the present invention will be explained.

The silver halide color photographic light-sensitive material (hereinafter, sometimes called simply, "light-sensitive material") of the present invention comprises, on a support, at least one of each of a blue-sensitive silver halide emulsion layer which includes a yellow coupler, a green-sensitive silver halide emulsion layer which includes a magenta coupler and red-sensitive silver halide emulsion layer which includes a cyan coupler, wherein at least one of the blue-sensitive silver halide emulsion layer, the green-sensitive silver halide emulsion layer and the red-sensitive silver halide emulsion layer includes a silver halide emulsion having a silver chloride content of 95 mol % or more, a silver iodide content of 0.05 to 0.75 mol % and/or a silver bromide content of 0.05 to 4.00 mol % and further at least one compound represented by the Formula (I):

In the silver halide light-sensitive material of the present invention, a combination of the silver halide emulsion having the aforementioned specific halogen composition and a compound represented by the following Formula (I) is used in at least one of the light-sensitive silver halide emulsion layers. Thus, the silver halide light sensitive material can: suppress fogging characteristic of emulsions whose silver chloride content is high and which include a silver iodochloride layer, a silver chlorobromide layer or a silver iodochlorobromide layer, and particularly a silver iodochlorobromide layer on the surface or subsurface of a silver halide particle; impart superior raw stock storability characteristics and exposure moisture dependency; and ensure full use of its high sensitivity and adaptability to high-intensity exposure.

The silver halide color photographic light-sensitive material of the present invention may be provided with a hydrophilic colloidal layer, antihalation layer, intermediate layer and colored layer, which will be explained later, as desired in addition to the aforementioned blue-sensitive silver halide emulsion layer, green-sensitive silver halide emulsion layer and red-sensitive silver halide emulsion layer. Also, the light-sensitive material of the present invention is provided with at least one color developing layer which can develop a color by light radiation and developing. By forming a color developing layer which can develop each of the colors magenta, yellow and cyan, a light-sensitive material capable of forming a full-color image can be produced. The above color developing layer may also comprise the aforementioned blue-sensitive silver halide emulsion layer, green-sensitive silver halide emulsion layer and red-sensitive silver halide emulsion layer.

The compound (adsorptive type reducing compound) represented by the following Formula (I) will be explained in detail.

$$X\text{-}(L)_n\text{-}Y \qquad \text{Formula (I)}$$

Wherein: X represents a group adsorptive to a silver halide; L represents a divalent connecting group comprising an atom or an atomic group including at least one of a carbon atom, a nitrogen atom, a sulfur atom and an oxygen atom; Y represents a reducible group; and n denotes an integer with a value of 0 or 1.

X in the Formula (I) will now be explained in detail.

In the Formula (I), the adsorptive group represented by X is preferably a group obtained from any one of the following structures (1) to (5) (whose hydrogen atom is changed to a bond).

(1) A five-, six- or seven-membered heterocycle having two or more heteroatoms, (2) A five-, six- or seven-membered heterocycle which has a quaternary nitrogen atom and represented by the following "a", (3) A five-, six- or seven-membered heterocycle which includes nitrogen and has a thioxo group and represented by the following "b", (4) A five-, six- or seven-membered heterocycle which includes nitrogen and is represented by the following "c" and (5) A five-, six- or seven-membered heterocycle which includes nitrogen and is represented by the following "d" or "e". It should be noted that in order to be the adsorptive group to a silver halide, a bond to be connected to L or Y in the formula (I) is preferably present in the Z portion or $R_1$ portion of "a", the Z portion of "b" and "c", the Z portion, $L_1$ portion or $L_2$ portion (preferably Z portion) of "d" and the Z portion of "e".

a

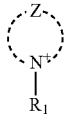

b

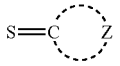

-continued c

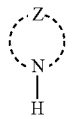

d

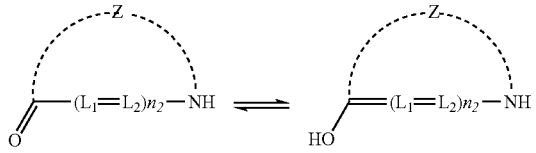

e

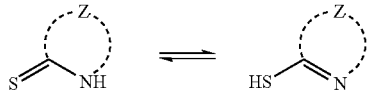

wherein Z represents an atomic group required to form a nitrogen-containing five-, six- or seven-membered heterocycle; $R_1$ represents an alkyl group, an alkenyl group or an alkynyl group; $L_1$ and $L_2$ respectively represents a methine group; and $n_2$ represents 0, 1 or 2.

Examples of $R_1$ include: substituted or unsubstituted alkyl groups having 1 to 18 carbon atoms (more preferably 1 to 8 carbon atoms); substituted or unsubstituted alkenyl groups having 2 to 18 carbon atoms (more preferably 2 to 8 carbon atoms); and substituted or unsubstituted alkynyl groups having 2 to 18 carbon atoms (more preferably 2 to 8 carbon atoms). Specific examples of $R_1$ include methyl, ethyl, propyl, isopropyl, butyl, isobutyl, hexyl, octyl, dodecyl, octadecyl, cyclopentyl, cyclopropyl and cyclohexyl. More preferable examples of $R_1$ include: unsubstituted alkyl groups having 1 to 6 carbon atoms and substituted alkyl groups having 1 to 8 carbon atoms {e.g., a sulfoalkyl group (e.g., 2-sulfoethyl, 3-sulfopropyl, 4-sulfobutyl and 3-sulfobutyl), carboxyalkyl groups (e.g., carboxymethyl and 2-carboxyethyl) and hydroxyalkyl groups (e.g., 2-hydroxyethyl)}.

The nitrogen-containing heterocycle which includes Z as a cyclic structure atom is a five-, six- or seven-membered heterocycle comprising at least one nitrogen atom and may also include, heteroatoms other than a nitrogen atom (e.g., an oxygen atom, sulfur atom, selenium atom and tellurium atom). Preferable examples of the heterocycle include an azole rings (e.g., imidazole, triazole, tetrazole, oxazole, thiazole, selenazole, benzoimidazole, benzotriazole, benzoxazole, benzothiazole, thiadiazole, oxadiazole, benzoselenazole, pyrazole, naphthothiazole, naphthoimidazole, naphthoxazole, azabenzoimidazole and purine), pyrimidine rings, triazine rings and azaindene rings (e.g., triazaindene, tetrazaindene and pentazaindene).

In the Formula (I), the adsorptive group represented by X is preferably a compound represented by one of the Formulae (X-a), (x-b), (X-c), (X-d) and (X-e). Examples, of favorable compounds for the adsorptive group represented by X bounded to $-(L)_n-Y$ will be given and explained. Thus, in each the following Formulae (X-a) to (X-e), at least one $-(L)_n-Y$ is substituted. However, $-(L)_n-Y$ is not substituted for $M_1$ or $M_2$ of the following Formulae (X-c) or (X-b).

(X-a)

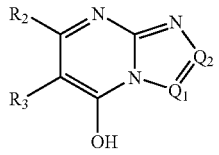

$Q_1 = N, Q_2 = C—R_4$ or
$Q_1 = C—R_4, Q_2 = N$ (X-b)

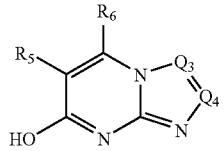

$Q_3 = N, Q_4 = C—R_7$ or
$Q_3 = C—R_7, Q_4 = N$ (X-c)

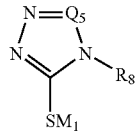

$Q_5 = N$ or $C—R_a$ (X-d)

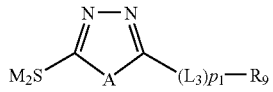

(X-e)

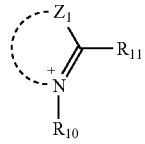

wherein $R_2$, to $R_7$ and $R_a$ respectively represents a hydrogen atom or a monovalent substituent; $R_8$ represents an alkyl group, an alkenyl group, an alkynyl group, an aryl group or a heterocyclic group; $R_9$ represents a hydrogen atom, an alkyl group, an alkenyl group, an alkynyl group, an aryl group or a heterocyclic group; $R_{10}$ represents an alkyl group, an alkenyl group or an alkynyl group; $R_{11}$ represents a hydrogen atom, an alkyl group, an alkenyl group or an alkynyl group; $L_3$ represents a divalent connecting group; $M_1$ and $M_2$ respectively represents a hydrogen atom, an alkali metal atom, an ammonium group or a block group, $p_1$ is an integer from 0 to 3; A represents an oxygen atom, a sulfur atom, >NH or $>N-(L_4)p_2-R_{12}$ (wherein: $L_4$ respectively represents a divalent connecting group; $R_{12}$ represents a hydrogen atom, an alkyl group, an alkenyl group, an alkynyl group, an aryl group or a heterocyclic group; and $p_2$s respectively denotes an integer from 0 to 3); and $Z_1$ represents an atomic group necessary to form a nitrogen-containing five-, six- or seven-membered heterocycle; and $p_1$ and $p_2$ are preferably 1.

Among these Formulae (X-a) to (X-e), the Formulae (X-a), (X-c) and (X-d) are preferable and the Formula (X-c) is more preferable.

In the Formulae (X-a) to (X-e), examples of the substituents represented by $R_2$ to $R_7$ or $R_a$ include halogen atoms (e.g., a chlorine atom, bromine atom and iodine atom); alkyl groups {representing straight-chain, branched or cyclic substituted or unsubstituted alkyl groups and the like: these groups include alkyl groups (preferably alkyl groups having 1 to 30 carbon atoms, for example, methyl, ethyl, n-propyl, isopropyl, t-butyl, n-octyl, eicosyl, 2-chloroethyl, 2-cyanoethyl and 2-ethylhexyl), cycloalkyl groups (preferably substituted or unsubstituted cycloalkyl groups having 3 to 30 carbon atoms, for example, cyclohexyl, cyclopentyl and 4-n-dodecylcyclohexyl), bicycloalkyl groups (preferably monovalent groups obtained by eliminating one hydrogen atom from substituted or unsubstituted bicycloalkyl groups having 5 to 30 carbon atoms, namely, bicycloalkanes having 5 to 30 carbon atoms, for example, bicyclo[1,2,2]heptane-2-yl and bicyclo[2,2,2]octane-3-yl), also a tricyclo structure having many cyclic structures is included and alkyl groups in the substituent explained below (e.g., an alkyl group of an alkylthio group) represent the kinds alkyl groups}; alkenyl groups {representing straight-chain, branched or cyclic substituted or unsubstituted alkenyl groups; these groups include alkenyl groups (preferably substituted or unsubstituted alkenyl groups having 2 to 30 carbon atoms, for example, vinyl, allyl, prenyl, geranyl and oleyl), cycloalkenyl groups (preferably substituted or unsubstituted cycloalkenyl groups having 3 to 30 carbon atoms, namely, monovalent groups obtained by eliminating one hydrogen atom from cycloalkenes having 3 to 30 carbon atoms, for example, 2-cyclopentene-1-yl and 2-cyclohexene-1-yl), bicycloalkenyl groups (substituted or unsubstituted bicycloalkenyl groups and preferably substituted or unsubstituted bicycloalkenyl groups having 5 to 30 carbon atoms, namely, monovalent groups obtained by eliminating one hydrogen atom from bicycloalkenes having one double bond, for example, bicyclo[2,2,1]hepto-2-ene-1-yl and bicyclo[2,2,2]octo-2-ene-4-yl)}; alkynyl groups (preferably substituted or unsubstituted alkynyl groups having 2 to 30 carbon atoms, for example, ethynyl, propargyl and trimethylsilylethynyl); aryl groups (preferably substituted or unsubstituted aryl groups having 6 to 30 carbon atoms, for example, phenyl, p-tolyl, naphthyl, m-chlorophenyl and o-hexadecanoylaminophenyl); heterocyclic groups (preferably monovalent groups obtained by eliminating one hydrogen atom from five- or six-membered substituted or unsubstituted aromatic or non-aromatic heterocyclic compounds and more preferably five- or six-membered aromatic heterocyclic groups having 3 to 30 carbon atoms, for example, 2-furyl, 2-thienyl, 2-pyrimidinyl and 2-benzothiazolyl); cyano groups; hydroxyl groups; nitro groups, carboxyl groups; alkoxy groups (preferably substituted or unsubstituted alkoxy groups having 1 to 30 carbon atoms, for example, methoxy, ethoxy, isopropoxy, t-butoxy, n-octyloxy and 2-methoxyethoxy); aryloxy groups (preferably substituted or unsubstituted aryloxy groups having 6 to 30 carbon atoms, for example, phenoxy, 2-methylphenoxy, 4-t-butylphenoxy, 3-nitrophenoxy and 2-tetradecanoylaminophenoxy); silyloxy groups (preferably silyloxy groups having 3 to 20 carbon atoms, for example, trimethylsilyloxy and t-butyldimethylsilyloxy); heterocyclic oxy groups (preferably substituted or unsubstituted heterocyclic oxy groups having 2 to 30 carbon atoms, for example, 1-phenyltetrazole-5-oxy and 2-tetrahydropyranyloxy); acyloxy groups (preferably formyloxy groups, substituted or unsubstituted alkylcarbonyloxy groups having 2 to 30 carbon atoms and substituted or unsubstituted arylcarbonyloxy groups having 6 to 30 carbon atoms, for example, formyloxy, acetyloxy, pivaloyloxy, stearoyloxy, benzoyloxy and p-methoxyphenylcarbonyloxy); carbamoyloxy groups (preferably substituted or unsubstituted carbamoyloxy groups having 1 to 30 carbon atoms, for example, N,N-dimethylcarbamoyloxy, N,N-diethylcarbamoyloxy, morpholinocarbonyloxy, N,N-di-n-octylaminocarbonyloxy and N-n-octylcarbamoyloxy); alkoxycarbonyloxy groups (preferably substituted or unsubstituted alkoxycarbonyloxy groups having 2 to 30 carbon atoms, for example, methoxycarbonyloxy, ethoxycarbonyloxy, t-butoxycarbonyloxy and n-octylcarbonyloxy); aryloxycarbonyloxy groups (preferably substituted or unsubstituted aryloxycarbonyloxy groups having 7 to 30 carbon atoms, for example, phenoxycarbonyloxy, p-methoxyphenoxycarbonyloxy and p-n-hexadecyloxyphenoxycarbonyloxy); amino groups (preferably amino groups, substituted or unsubstituted alkylamino groups having 1 to 30 carbon atoms and substituted or unsubstituted anilino groups having 6 to 30 carbon atoms, for example, amino, methylamino, dimethylamino, anilino, N-methyl-anilino and diphenylamino); acylamino groups (preferably formylamino groups, substituted or unsubstituted alkylcarbonylamino groups having 1 to 30 carbon atoms and substituted or unsubstituted arylcarbonylamino groups having 6 to 30 carbon atoms, for example, formylamino, acetylamino, pivaloylamino, lauroylamino, benzoylamino and 3,4,5-tri-n-octyloxyphenylcarbonylamino); aminocarbonylamino groups (preferably substituted or unsubstituted aminocarbonylaminos having 1 to 30 carbon atoms, for example, carbamoylamino, N,N-dimethylaminocarbonylamino, N,N-diethylaminocarbonylamino and morpholinocarbonylamino); alkoxycarbonylamino groups (preferably substituted or unsubstituted alkoxycarbonylamino groups having 2 to 30 carbon atoms, for example, methoxycarbonylamino, ethoxycarbonylamino, t-butoxycarbonylamino, n-octadecyloxycarbonylamino and N-methylmethoxycarbonylamino); aryloxycarbonylamino groups (preferably substituted or unsubstituted aryloxycarbonylamino groups having 7 to 30 carbon atoms, for example, phenoxycarbonylamino, p-chlorophenoxycarbonylamino and m-n-octyloxyphenoxycarbonylamino); sulfamoylamino groups (preferably substituted or unsubstituted sulfamoylamino groups having 0 to 30 carbon atoms, for example, sulfamoylamino, N,N-dimethylaminosulfonylamino and N-n-octylaminosulfonylamino); alkylsulfonylamino or arylsulfonylamino groups (preferably substituted or unsubstituted alkylsulfonylaminos having 1 to 30 carbon atoms and substituted or unsubstituted arylsulfonylaminos having 6 to 30 carbon atoms, for example, methylsulfonylamino, butylsulfonylamino, phenylsulfonylamino, 2,3,5-trichlorophenylsulfonylamino and p-methylphenylsulfonylamino); mercapto groups; alkylthio groups (preferably substituted or unsubstituted alkylthio groups having 1 to 30 carbon atoms, for example, methylthio, ethylthio and n-hexadecylthio); arylthio groups (preferably substituted or unsubstituted arylthios having 6 to 30 carbon atoms, for example, phenylthio, p-chlorophenylthio and m-methoxyphenylthio); heterocyclic thio groups (preferably substituted or unsubstituted heterocyclic thio groups having 2 to 30 carbon atoms, for example, 2-benzothiazolylthio and 1-phenyltetrazole-5-ylthio); sulfamoyl groups (preferably substituted or unsubstituted sulfamoyl groups having 0 to 30 carbon atoms, for example, N-ethylsulfamoyl, N-(3-dodecyloxypropyl)sulfamoyl, N,N-dimethylsulfamoyl, N-acetylsulfamoyl, N-benzoylsulfamoyl and N—(N'-phenylcarbamoyl)sulfamoyl); sulfo groups; alkylsulfinyl or arylsulfinyl groups (preferably substituted or unsubstituted alkylsulfinyl groups having 1 to 30 carbon atoms and substituted or unsubstituted arylsulfinyl groups having 6 to 30 carbon atoms, for example, methylsulfinyl, ethylsulfinyl, phenylsulfinyl and p-methylphenylsulfinyl); alkylsulfonyl or arylsulfonyl groups (preferably substituted or unsubstituted alkylsulfonyl groups having 1 to 30 carbon atoms and substituted or unsubstituted arylsulfonyl groups having 6 to 30 carbon atoms, for example, methylsulfonyl, ethylsulfonyl, phenylsulfonyl and p-methylphenylsulfonyl); acyl groups (preferably formyl groups, substituted or unsubstituted alkylcarbonyl groups having 2 to 30 carbon atoms, substituted or unsubstituted arylcarbonyl groups having 7 to 30 carbon atoms and substituted or unsubstituted heterocyclic carbonyl groups having 4 to 30 carbon atoms and a carbonyl group connected directly to a carbon atom, for example, acetyl, pivaloyl, 2-chloroacetyl, stearoyl, benzoyl, p-n-octyloxyphenylcarbonyl, 2-pyridylcarbonyl and 2-furylcarbonyl); aryloxycarbonyl groups (preferably substituted or unsubstituted aryloxycarbonyl groups having 7 to 30 carbon atoms, for example, phenoxycarbonyl, o-chlorophenoxycarbonyl, m-nitrophenoxycarbonyl and p-t-butylphenoxycarbonyl); alkoxycarbonyl groups (preferably substituted or unsubstituted alkoxycarbonyl groups having 2 to 30 carbon atoms, for example, methoxycarbonyl, ethoxycarbonyl, t-butoxycarbonyl and n-octadecyloxycarbonyl); carbamoyl groups (preferably substituted or unsubstituted carbamoyl having 1 to 30 carbon atoms, for example, carbamoyl, N-methylcarbamoyl, N,N-dimethylcarbamoyl, N,N-di-n-octylcarbamoyl and N-(methylsulfonyl)carbamoyl); arylazo or heterocyclic azo groups (preferably substituted or unsubstituted arylazo groups having 6 to 30 carbon atoms and substituted or unsubstituted heterocyclic azo groups having 3 to 30 carbon atoms, for example, phenylazo, p-chlorophenylazo, 5-ethylthio-1,3,4-thiadiazole-2-ylazo); imide groups (preferably N-succinimide and N-phthalimide); phosphino groups (preferably substituted or unsubstituted phosphino groups having 2 to 30 carbon atoms, for example, dimethylphosphino, diphenylphosphino and methylphenoxyphosphino); phosphinyl groups (preferably substituted or unsubstituted phosphinyl groups having 2 to 30 carbon atoms, for example, phosphinyl, dioctyloxyphosphinyl and diethoxyphosphinyl); phosphinyloxy groups (preferably substituted or unsubstituted phosphinyloxy groups having 2 to 30 carbon atoms, for example, diphenoxyphosphinyloxy and dioctyloxyphosphinyloxy); phosphinylamino groups (preferably substituted or unsubstituted phosphinylamino groups having 2 to 30 carbon atoms, for example, dimethoxyphosphinylamino and dimethylaminophosphinylamino); and silyl groups (preferably substituted or unsubstituted silyl groups having 3 to 30 carbon atoms, for example, trimethylsilyl, t-butyldimethylsilyl and phenyldimethylsilyl). Among the above substituents, those having a hydrogen atom may be further substituted with the same substituent as the aforementioned substituent after the hydrogen atom is eliminated. Examples of such substituents include alkylcarbonylaminosulfonyl groups, arylcarbonylaminosulfonyl groups, alkylsulfonylaminocarbonyl groups and arylsulfonylaminocarbonyl groups. Specific examples include a methylsulfonylaminocarbonyl group, p-methylphenylsulfonylaminocarbonyl group, acetylaminosulfonyl group and benzoylaminosulfonyl group. These groups may be further substituted.

More preferable examples of $R_2$ to $R_7$ and $R_a$ in the Formulae (X-a) to (X-e) include lower alkyl groups (preferably substituted or unsubstituted alkyl groups having 1 to 4 carbon atoms, for example, methyl, ethyl, n-propyl, isopropyl, n-butyl, t-butyl, methoxyethyl, hydroxyethyl, hydroxymethyl, vinyl and allyl), carboxy groups, alkoxy groups (preferably substituted or unsubstituted alkoxy groups having 1 to 5 carbon atoms, for example, methoxy, ethoxy, methoxyethoxy and hydroxyethoxy), aralkyl groups (preferably substituted or unsubstituted aralkyl groups having 7 to 12 carbon atoms, for example, benzyl, phenetyl and phenylpropyl), aryl groups (preferably substituted or unsubstituted aryl groups having 6 to 12 carbon atoms, for example, phenyl, 4-methylphenyl and 4-methoxyphenyl), heterocyclic groups (e.g., 2-pyridyl), alkylthio groups (preferably substituted or unsubstituted alkylthio groups having 1 to 10 carbon atoms, for example, methylthio and ethylthio), arylthio groups (preferably substituted or unsubstituted arylthio groups having 6 to 12 carbon atoms, for example, phenylthio), aryloxy groups (preferably substituted or unsubstituted aryloxy groups having 6 to 12 carbon atoms, for example, phenoxy), alkylamino groups having 3 or more carbon atoms (e.g., propylamino and butylamino), arylamino groups (e.g., anilino) and halogen atoms (e.g., a chlorine atom, bromine atom and fluorine atom) or the following "f" to "h".

f

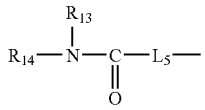

g

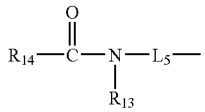

h

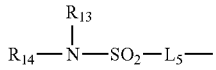

wherein $L_5$ represents an alkylene group (preferably an alkylene group having 1 to 5 carbon atoms, for example, a methylene, propylene or 2-hydroxypropylene); and $R_{13}$ and $R_{14}$, which may be the same or different, respectively represents a hydrogen atom, an alkyl group, an alkenyl group or an alkynyl group (preferably a substituted or unsubstituted alkyl, alkenyl or alkynyl group having 1 to 10 carbon atoms, for example, methyl, ethyl, n-propyl, isopropyl, n-butyl, t-butyl, n-octyl, methoxyethyl, hydroxyethyl, allyl or propargyl), an aralkyl group (preferably a substituted or unsubstituted aralkyl group having 7 to 12 carbon atoms, for example, benzyl, phenetyl and vinylbenzyl), an aryl group (preferably substituted or unsubstituted aryl groups having 6 to 12 carbon atoms, for example, phenyl or 4-methylphenyl) or a heterocyclic group (e.g., 2-pyridyl).

The alkyl group, alkenyl group, alkynyl group, aralkyl group, aryl group and heterocyclic group of $R_{13}$ or $R_{14}$ may be substituted or unsubstituted. As the substituent, those given as the examples of the substituents which $R_2$ to $R_7$ may have in the Formulae (X-a) to (X-e) may be applied. Among these substituents, preferable examples may include halogen atoms (e.g., a chlorine atom, bromine atom and fluorine atom), nitro groups, cyano groups, hydroxy groups, alkoxy groups (e.g., methoxy), aryl groups (e.g., phenyl), acylamino groups (e.g., propionylamino), alkoxycarbonylamino groups (e.g., methoxycarbonylamino), ureide groups, amino groups, heterocyclic groups (e.g., 2-pyridyl), acyl groups (e.g., acetyl), sulfamoyl groups, sulfonamide groups, thioureide groups, carbamoyl groups, alkylthio groups (e.g., methylthio), arylthio groups (e.g., phenylthio), heterocyclic thio groups (e.g., 2-benzothiazolylthio), carboxylic acid groups, sulfo groups and their salts.

The aforementioned ureide groups, thioureide groups, sulfamoyl groups, carbamoyl groups and amino groups respectively include those unsubstituted, those substituted with N-alkyl and those substituted with N-aryl. Also, examples of the above aryl groups include phenyl groups and substituted phenyl groups. As the substituent, those given as examples of the substituent for $R_2$ to $R_7$ may be applied.

Examples of the alkali metal atoms represented by $M_1$ or $M_2$ in the Formulae (X-a) to (X-e) include a sodium atom and potassium atom. Examples of the ammonium group include tetramethylammoniums and trimethylbenzylammoniums. Also, the block group is a group which can be cleft in an alkaline condition and examples of the block group include acetyl, cyanoethyl and methanesulfonylethyl.

Specific examples of the divalent connecting group represented by $L_3$ or $L_4$ in the Formulae (X-a) to (X-e) may include connecting groups represented by the following "i" through "p" and combinations of these groups.

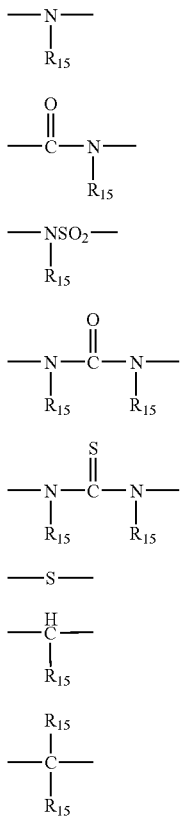

wherein $R_{15}$ represents a hydrogen atom, an alkyl group, an alkenyl group, an alkynyl group (preferably a substituted or unsubstituted alkyl, alkenyl or alkynyl group having 1 to 4 carbon atoms, for example, methyl, ethyl, n-butyl, methoxyethyl, hydroxyethyl or allyl) or an aralkyl group (preferably a substituted or unsubstituted aralkyl group having 7 to 12 carbon atoms, for example, benzyl, phenetyl or phenylpropyl). When plural $R_{15}$s are present, these $R_{15}$'s may be the same or different.

Preferable examples of the heterocyclic group which has $Z_1$ as a ring-structuring atom in the Formulae (X-a) to (X-e) include thiazoliums {e.g., thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium}; oxazoliums {e.g., oxazolium, 4-methyloxazolium, benzooxazolium, 5-chlorobenzooxazolium, 5-phenylbenzooxazolium, 5-methylbenzooxazolium, naphtho[1,2-d]oxazolium}; imidazoliums {e.g., 1-methylbenzoimidazolium, 1-propyl-5-chlorobenzoimidazolium, 1-ethyl-5,6-dichlorobenzoimidazolium, 1-allyl-5-trifluoromethyl-6-chloro-benzoimidazolium}; and selenazoliums {e.g., benzoselenazolium, 5-chlorobenzoselenazolium, 5-methylbenzoselenazolium, 5-methoxybenzoselenazolium and naphtho[1,2-d]selenazolium}.

Particularly preferable examples are thiazoliums (e.g., benzothiazolium, 5-chlorobenzothiazolium, 5-methoxybenzothiazolium and naphtho[1,2-d]thiazolium).

As examples of $R_8$, $R_9$ or $R_{12}$ in the Formulae (X-a) to (X-e) the alkyl groups, alkenyl groups, alkynyl groups, aryl groups or heterocyclic groups which are described for $R_2$ to $R_7$ are preferable; an alkyl groups having 1 to 30 carbon atoms, aryl groups having 6 to 30 carbon atoms or heterocyclic groups having 3 to 30 carbon atoms are more preferable; alkyl groups having 1 to 18 carbon atoms or aryl groups having 6 to 10 carbon atoms are still more preferable; and aryl groups having 6 to 10 carbon atoms are most preferable.

Preferable examples of $R_{10}$ or $R_{11}$ in the Formulae (X-a) to (X-e) include a hydrogen atom; unsubstituted alkyl groups having 1 to 18 carbon atoms (e.g., methyl, ethyl, propyl, butyl, pentyl, octyl, decyl, dodecyl and octadecyl); and substituted alkyl groups having 1 to 18 carbon atoms {examples of the substituent include vinyl group, carboxy group, sulfo group, cyano group, halogen atom (e.g., fluorine, chlorine and bromine), hydroxy group, alkoxycarbonyl groups having 1 to 8 carbon atoms (e.g., methoxycarbonyl, ethoxycarbonyl, phenoxycarbonyl and benzyloxycarbonyl), alkoxy groups having 1 to 8 carbon atoms (e.g., methoxy, ethoxy, benzyloxy and phenetyloxy), monocyclic aryloxy groups having 6 to 10 carbon atoms (e.g., phenoxy and p-tolyloxy), acyloxy groups having 1 to 3 carbon atoms (e.g., acetyloxy and propionyloxy), acyl groups having 1 to 8 carbon atoms (e.g., acetyl, propionyl, benzoyl and mesyl), carbamoyl groups (e.g., carbamoyl, N,N-dimethylcarbamoyl, morpholinocarbonyl and piperidinocarbonyl), sulfamoyl groups (e.g., sulfamoyl, N,N-dimethylsulfamoyl, morpholinosulfonyl and piperidinosulfonyl), aryl groups having 6 to 10 carbon atoms (e.g., phenyl, 4-chlorophenyl, 4-methylphenyl and α-naphthyl)}; provided that $R_{10}$ is not a hydrogen atom.

More preferable examples of $R_{10}$ include unsubstituted alkyl groups (e.g., methyl and ethyl) and alkenyl groups (e.g., allyl) and more preferable examples of $R_{11}$ include a hydrogen atom and unsubstituted lower alkyl groups (e.g., methyl and ethyl).

Specific examples of the structure of the compound represented by the Formula (X-c) will be shown, but are not intended to limit the present invention.

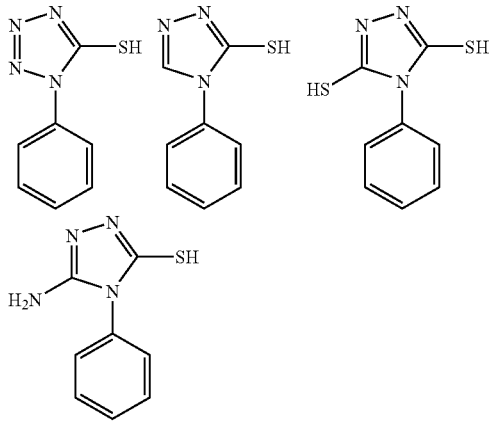

As the adsorptive group represented by X in the Formula (I), 1-phenyl-1H-tetrazole-5-thiol or 4-phenyl-4H-[1,2,4]triazole-3-thiol is most preferable.

L in the Formula (I) will now be explained in detail.

In the Formula (I), L represents a divalent connecting group comprising an atom or an atomic group containing at least one of a carbon atom, nitrogen atom, sulfur atom and oxygen atom. L preferably represents a divalent connecting group having 1 to 20 carbon atoms and is constituted by combining one or more of the following groups: alkylene groups having 1 to 8 carbon atoms (e.g., methylene, ethylene, propylene, butylene and pentylene), arylene groups having 6 to 12 carbon atoms (e.g., phenylene and naphthylene), alkenylene groups having 2 to 8 carbon atoms (e.g., ethynylene and propenylene), amide groups, carbamoyl groups, ester groups, sulfonamide groups, sulfamoyl groups, sulfonate groups, ureide groups, sulfonyl groups, sulfinyl groups, thioether groups, ether groups, carbonyl groups, —N($R_{16}$)— (wherein $R_{16}$ represents a hydrogen atom, a substituted or unsubstituted alkyl group or a substituted or unsubstituted aryl group) and divalent heterocyclic residues (e.g., 6-chloro-1,3,5-triazine-2,4-diyl, pyrimidine-2,4-diyl and quinoxaline-2,3-diyl). Among these connecting groups, more preferable examples include divalent connecting groups containing one or more of alkylene groups, arylene groups, ureide groups, amide groups and carbamoyl groups.

Y in the Formula (I) will be explained in detail.

The reducible group represented by Y in the Formula (I) may be any one of groups working reductively in the silver halide photographic light-sensitive material. Examples of the reducible group are reductones, phenols (e.g., tocopherols, polyphenols, hydroquinones and aminophenols), phenylenediamines, phenidones, hydroxylamines, hydroxyureas, hydroxysemicarbazides, hydrazides, hydrazines, hydroxyurethanes, hydroxam acids and semicarbazides. As Y among these groups, reductones, phenols, hydroxylamines, hydroxyureas, hydroxysemicarbazides, hydrazides, hydroxyurethanes and hydroxam acids are preferable, phenols, hydroxyureas, hydroxysemicarbazides and hydroxam acids are more preferable and hydroxyureas, hydroxysemicarbazides and hydroxam acids are particularly preferable.

Next, "n" in the Formula (I) will be explained in detail.

In the Formula (I), "n" is 0 or 1, and preferably 0.

The compound represented by the Formula (I) is preferably a compound represented by the Formula (II) and more preferably a compound represented by the Formula (III).

$X\text{-}Y_1$ Formula (II)

wherein X has the same meanings as X of the Formula (I) and the preferable range of X is also the same. $Y_1$ represents reductones, phenols, phenylenediamines, phenidones, hydroxylamines, hydroxyureas, hydroxysemicarbazides, hydrazides, hydrazines, hydroxyurethanes, hydroxam acids or semicarbazides.

$X_1\text{-}Y_2$ Formula (III)

wherein $X_1$ represents a 1-phenyl-1H-tetrazole-5-thiol or 4-phenyl-4H-[1,2,4]triazole-3-thiol and $Y_2$ represents a phenol, hydroxylamine, hydroxyurea, hydroxysemicarbazide, hydroxyurethane or hydroxam acid.

As the compound represented by the Formula (I), compounds represented by the following Formulae (IV) to (VI) are particularly preferable. These compounds are desirable as the compounds including the group adsorptive to a silver halide and the hydroxylamine partial structure and are compounds which can produce the above effects more efficiently in the present invention.

$X\text{-}(L_1)_n\text{-}Y_3$ Formula (IV)

wherein X and n have the same meanings as X and n of the Formula (I); $L_1$ represents a divalent connecting group provided that the $L_1$ directly connected to $Y_3$ is a carbon atom; and $Y_3$ represents any one selected from the groups represented by the following Formulae ($B_1$) to ($B_4$), wherein $R_{b1}$, $R_{b2}$ and $R_{b3}$ respectively represents a hydrogen atom, an alkyl group, an alkenyl group, an alkynyl group, an aryl group or a heterocyclic group.

($B_1$)

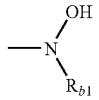

($B_2$)

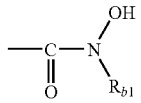

($B_3$)

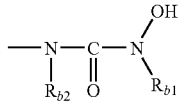

($B_4$)

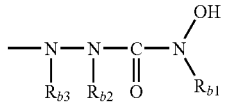

$X\text{—}(L_2)_n\text{—}Y_3$ Formula (V)

wherein X and n have the same meanings as X and n of the Formula (I) respectively; $L_2$ represents a divalent connecting group comprising one or a combination of at least two of alkylene group, —CO—, —$SO_2$— and —NR—, provided that the atom directly connected to $Y_3$ is a carbon atom; R represents a hydrogen atom, an alkyl group or an aryl group; and $Y_3$ represents any group selected from the groups represented by the above-described Formulae ($B_1$) to ($B_4$), wherein $R_{b1}$, $R_{b2}$ and $R_{b3}$ respectively represents a hydrogen atom, an alkyl group, an alkenyl group, an alkynyl group, an aryl group or a heterocyclic group.

Formula (VI)

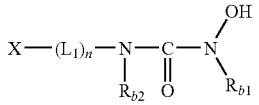

wherein: X and n have the same meanings as X and n of the Formula (I) respectively; and $L_1$, $R_{b1}$ and $R_{b2}$ have the same meanings as $L_1$, $R_{b1}$ and $R_{b2}$ of the Formula (IV).

The alkyl groups represented by $R_{b1}$, $R_{b2}$ and $R_{b3}$ in the Formulae (IV) to (VI) (($B_1$) to ($B_4$)) are preferably substituted or unsubstituted alkyl groups having 1 to 20 carbon atoms (e.g., methyl, ethyl, n-propyl, isopropyl, cyclopropyl, isobutyl, cyclohexyl, t-octyl, decyl, dodecyl, hexadecyl and benzyl), more preferably unsubstituted straight-chain alkyl groups and most preferably methyl groups.

The alkenyl groups represented by $R_{b1}$, $R_{b2}$ and $R_{b3}$ are preferably substituted or unsubstituted alkenyl groups having 2 to 20 carbon atoms (e.g., vinyl, allyl, 2-butenyl, oleyl and isopropenyl), more preferably unsubstituted straight-chain alkenyl groups and most preferably allyl groups.

The alkynyl groups represented by $R_{b1}$, $R_{b2}$ and $R_{b3}$ are preferably substituted or unsubstituted alkynyl groups having 2 to 20 carbon atoms (e.g., ethynyl, propargyl and trimethylsilylethynyl) and more preferably unsubstituted straight-chain alkynyl groups.

The aryl groups represented by $R_{b1}$, $R_{b2}$ and $R_{b3}$ are preferably substituted or unsubstituted aryl groups having 6 to 20 carbon atoms (e.g., phenyl and naphthyl) and more preferably unsubstituted phenyls.

The heterocyclic groups represented by $R_{b1}$, $R_{b2}$ and $R_{b3}$ are preferably monovalent groups obtained by removing a hydrogen atom from five- or six-membered substituted or unsubstituted aromatic or non-aromatic heterocyclic compounds having 3 to 20 carbon atoms (e.g., 2-furyl, 2-thienyl, 2-pyrimidinyl and 2-benzothiazolyl) and more preferably aromatic heterocyclic groups. These groups may have substituents. Examples of these substituents include the same substituents as those given for $R_2$.

As $R_{b1}$, a hydrogen atom or an alkyl group is preferable, an alkyl group is more preferable and a methyl group is particularly preferable.

As $R_{b2}$ and $R_{b3}$, hydrogen atoms or alkyl groups are preferable and hydrogen atoms are particularly preferable.

The compound represented by the Formula (IV) is preferably a compound represented by the following Formula (IV-1), more preferably a compound represented by the Formula (IV-2) and particularly preferably a compound represented by the Formula (IV-3).

$X_2$-$(L_1)_n$-$Y_3$ Formula (IV-1)

wherein $X_2$ is a group represented by the Formula (X-c) and $L_1$, n and $Y_3$ are the same as $L_1$, n and $Y_3$ of the Formula (IV) respectively.

$X_2$-$Y_3$ Formula (IV-2)

wherein $X_2$ is a group represented by the Formula (X-c) and $Y_3$ has the same meaning as $Y_3$ of the Formula (IV).

Formula (IV-3)

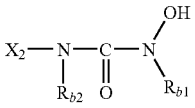

wherein $X_2$ is a group represented by the Formula (X-c) and $R_{b1}$ and $R_{b2}$ have the same meanings as $R_{b1}$ and $R_{b2}$ of the Formula (IV) ($(B_1)$ to $(B_4)$) respectively.

The compounds represented by the Formula (V) are preferably compounds represented by the following Formula (V-1) more preferably compounds represented by the Formula (V-2) and particularly preferably compounds represented by the Formula (V-3).

$X_2$-$(L_2)_n$-$Y_3$ Formula (V-1)

wherein: $X_2$ is a group represented by the Formula (X-c) and $L_2$, n and $Y_3$ have the same meanings as $L_2$, n and $Y_3$ of the Formula (V), respectively.

$X_2$-$Y_3$ Formula (V-2)

wherein $X_2$ is a group represented by the Formula (X-c) and $Y_3$ has the same meaning as $Y_3$ of the Formula (V).

Formula (V-3)

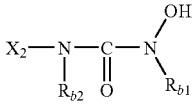

wherein $X_2$ is a group represented by the Formula (X-c) and $R_{b1}$ and $R_{b2}$ have the same meanings as $R_{b1}$ and $R_{b2}$ of the Formula (IV) ($(B_1)$ to $(B_4)$) respectively.

The compounds represented by the Formula (VI) are preferably compounds represented by the following Formula (VI-1) and more preferably compounds represented by the Formula (VI-2).

Formula (VI-1)

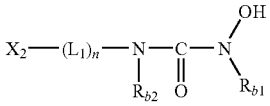

wherein $X_2$ is a group represented by the Formula (X-c) n has the same meaning as n of the Formula (I) and $L_1$, $R_{b1}$ and $R_{b2}$ have the same meanings as $L_1$, $R_{b1}$ and $R_{b2}$ of the Formula (IV) respectively.

Formula (VI-2)

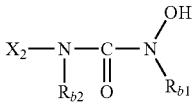

wherein $X_2$ is a group represented by the Formula (X-c) and $R_{b1}$ and $R_{b2}$ have the same meanings as $R_{b1}$ and $R_{b2}$ of the Formula (IV), respectively.

Preferable specific examples (exemplified compounds (I-1) to (I-67)) represented by the Formula (I) are shown below, but are not intended to be limiting of the present invention.

I-1)

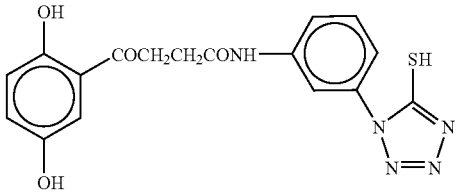

I-2)

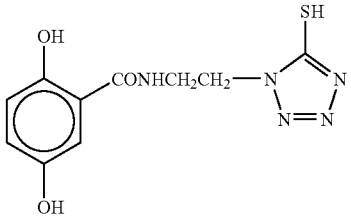

-continued
I-3)
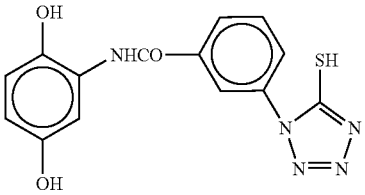
I-4)
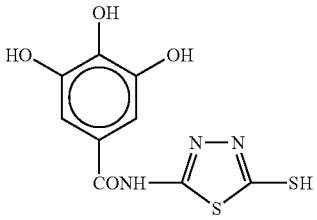
I-5)
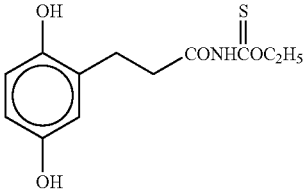
I-6)
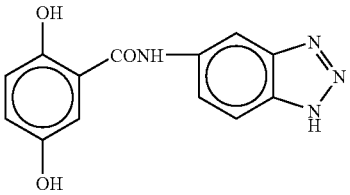
I-7)
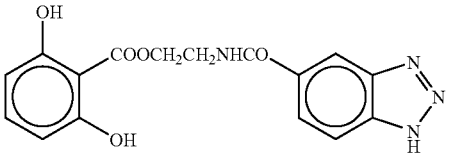
I-8)
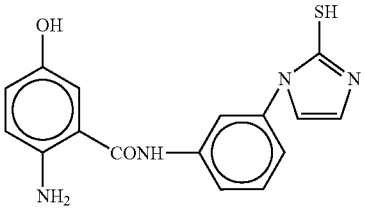
I-9)
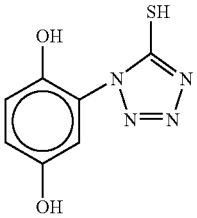
-continued
I-10)
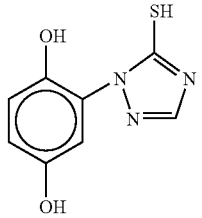
I-11)
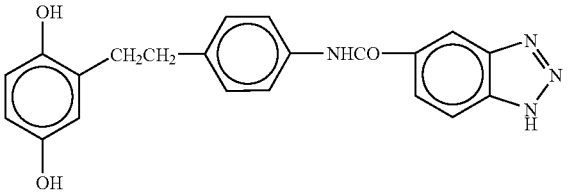
I-12)
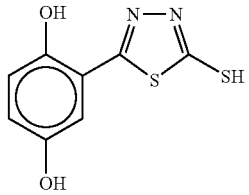
I-13)
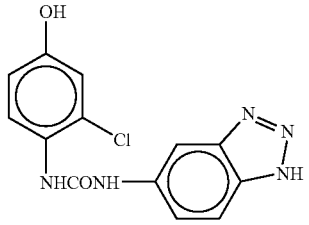
I-14)
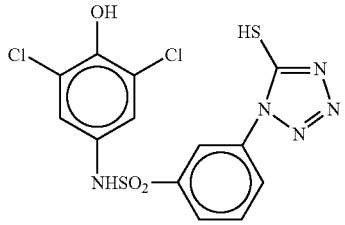
I-15)
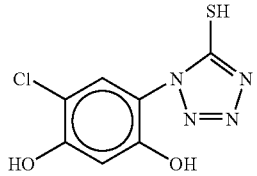
I-16)
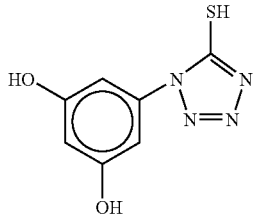

-continued
I-17)
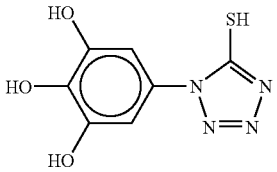
I-18)
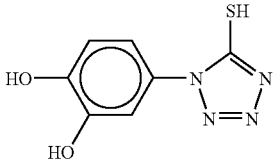
I-19)
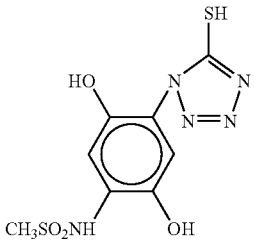
I-20)
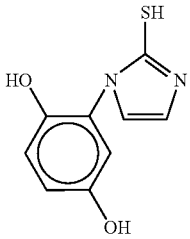
I-21)
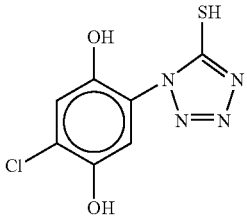
I-22)
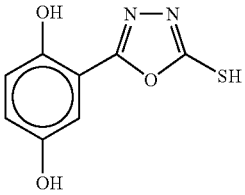
I-23)
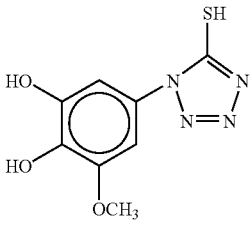
-continued
I-24)
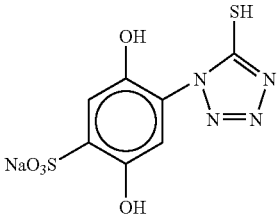
I-25)
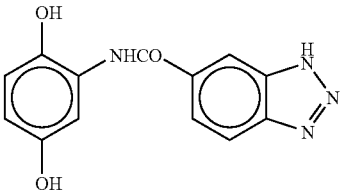
I-26)
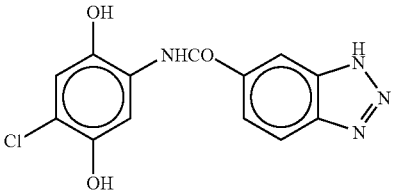
I-27)
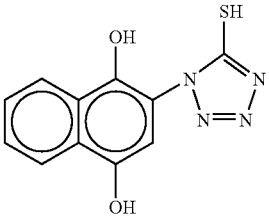
I-28)
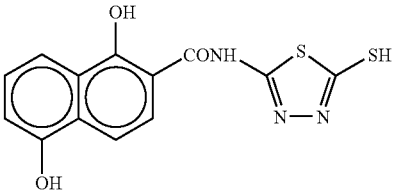
I-29)
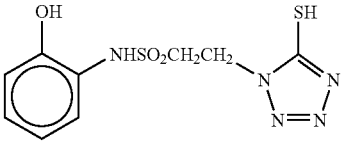
I-30)
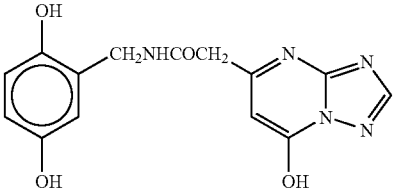

-continued
I-31)
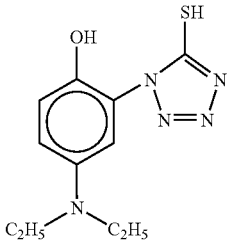
I-32)
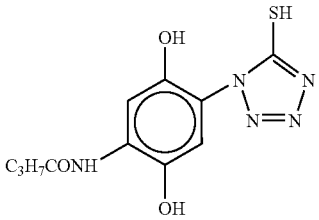
I-33)
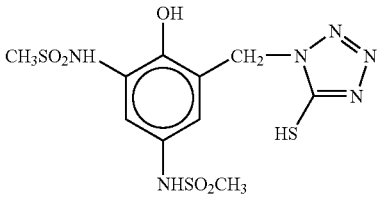
I-34)
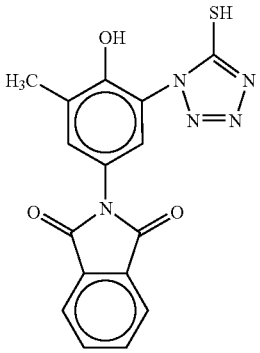
I-35)
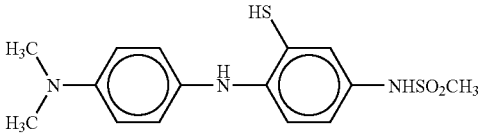
I-36)
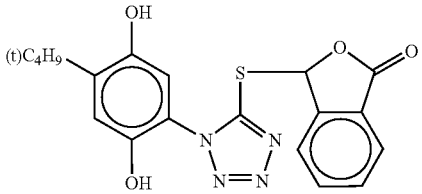
I-37)
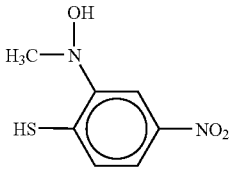
-continued
I-38)
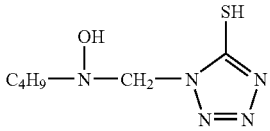
I-39)
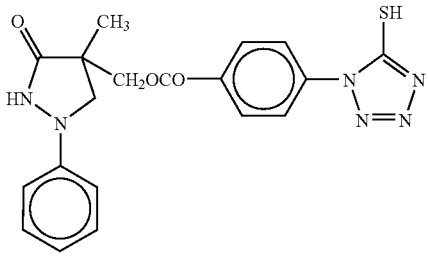
I-40)
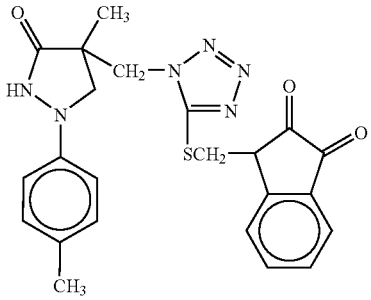
I-41)
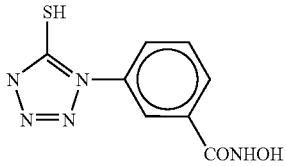
I-42)
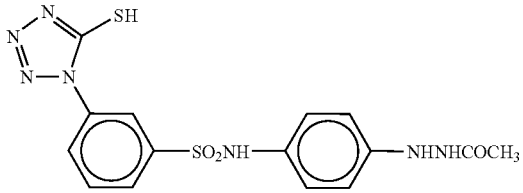
I-43)
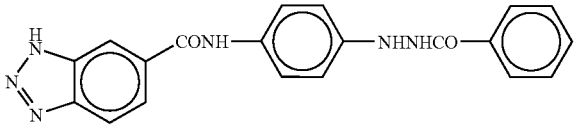
I-44)
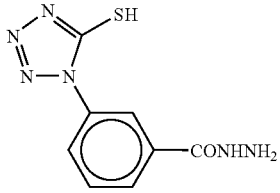

-continued
I-45)
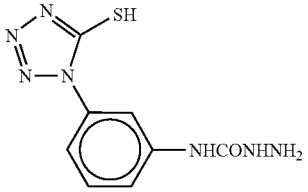
I-46)
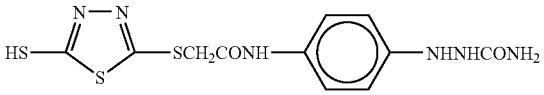
I-47)
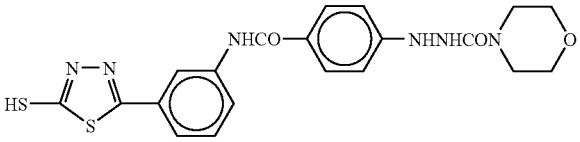
I-48)
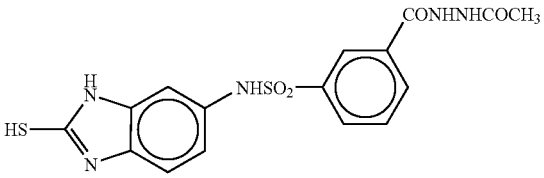
I-49)
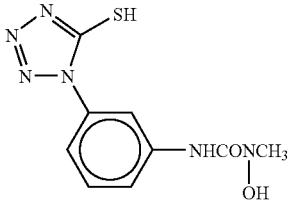
I-50)
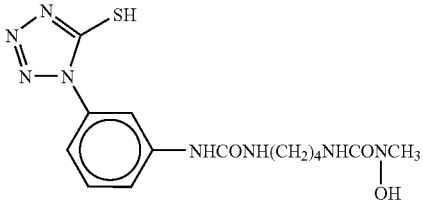
I-51)
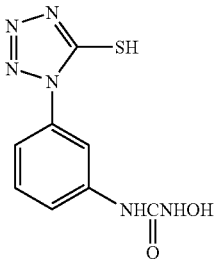
-continued
I-52)
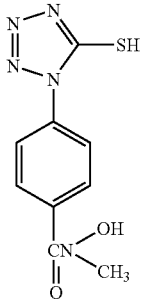
I-53)
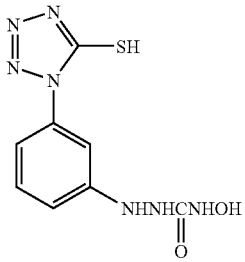
I-54)
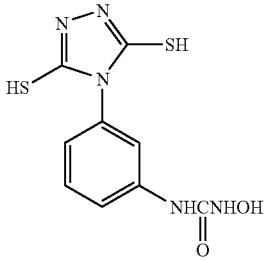
I-55)
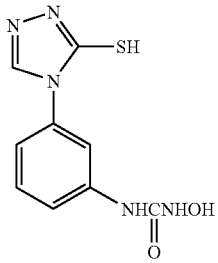
I-56)
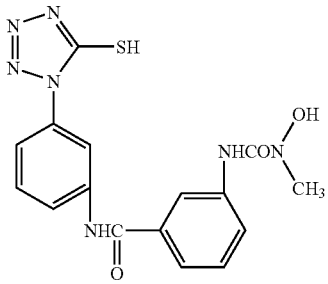
I-57)
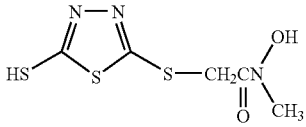

-continued

I-58)

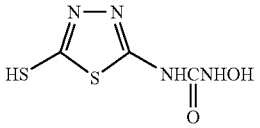

I-59)

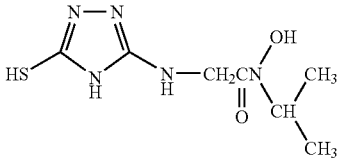

I-60)

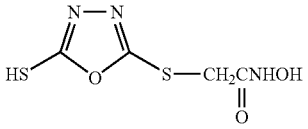

I-61)

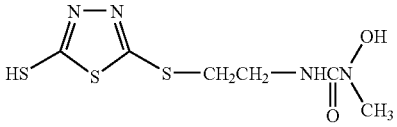

I-62)

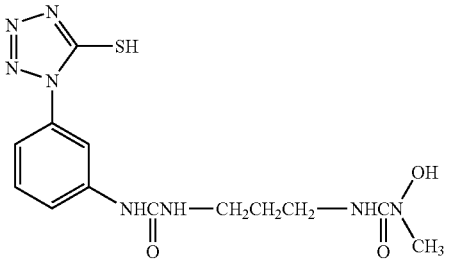

I-63)

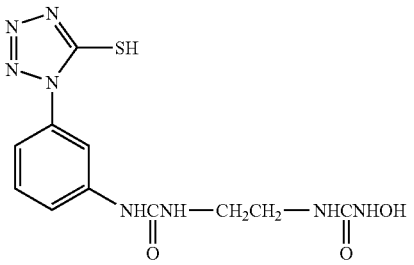

I-64)

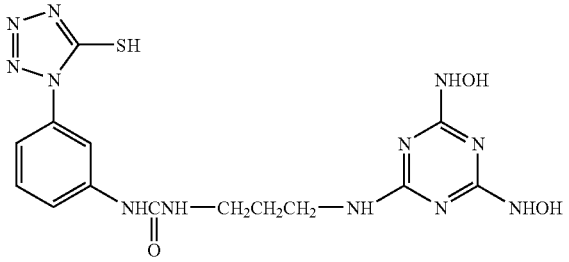

I-65)

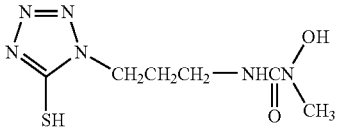

-continued

I-66)

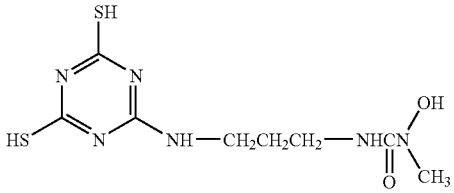

I-67)

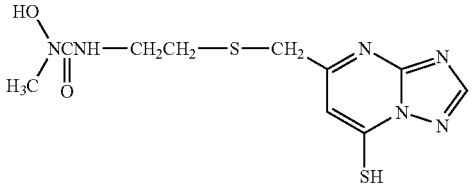

A method of synthesizing the compounds represented by the formula (I) (the compounds represented by the Formulae (II) to (VI)) will be explained in detail hereinafter.

The compound represented by the Formula (I) may be synthesized with reference to the methods described in the publications of JP-A Nos. 61-90153 and 4-368935 and the publications cited therein. In particular, a method of synthesizing the compounds (the compounds represented by the Formulae (IV) to (VI)) having the hydroxylamine partial structure will be hereinafter described in detail.

The compound represented by the Formula (I) may be synthesized using a commercially available reagent. Also, the group adsorptive to the silver halide represented by X may be synthesized by referring to the specifications of U.S. Pat. Nos. 5,538,843, 5,316,886, 2,557,726, 2,867,350, 2,641,982, the publications of JP-A No. 4-158354, J. Heterocycl. Chem. 17 (1980), 1077-1080, Bioorg. Med. Chem. Lett. 10, 13 (2000) 1421-1425 and the like. Also, the reaction of the adsorptive group with the divalent connecting portion may be accomplished by referring to the specification of U.S. Pat. No. 5,538,843.

The compound having the hydroxylamine partial structure (i.e., the compound represented by the Formulae (IV) to (VI)) among the compounds represented by the Formula (I) is synthesized largely through two synthetic routes. In one route, the divalent connecting group portion is reacted with the adsorptive group and thereafter with the hydroxylamine portion. In another route, the hydroxylamine portion is reacted with the divalent connecting group portion and then with the adsorptive group. The former route is preferable. The compound represented by the Formula (VI) in particular is preferably obtained by reacting a urethane derivative having the silver halide-adsorptive group with the hydroxylamines (preferably a reaction between a substituted or unsubstituted phenyloxycarbonylamino derivative connected with the silver halide-adsorptive group and the hydroxylamines) (scheme 1).

Scheme 1

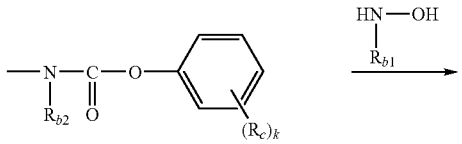

-continued

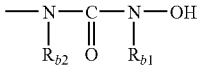

Wherein: $R_{b1}$ and $R_{b2}$ have the same meanings as $R_{b1}$ and $R_{b2}$ of the formula (IV) respectively; $R_c$ represents a substituent wherein examples of the substituent include the substituents given for $R_2$, and "k" represents an integer from 0 to 5, preferably 0 or 1 and more preferably 0.

The hydroxylamine portion is preferably introduced by the final reaction in the synthesis because it has reducibility and two reaction portions (N and OH). In most cases the reaction can be progressed at this time without adding other alkalis because the hydroxylamine itself is basic. If an excessive amount of the hydroxylamine is used, the reaction proceeds more rapidly. However, it has been proven that when the hydroxylamine portion is introduced, the compound obtained by the reaction with only the alkali of the hydroxylamines gives rise to a lot of fogging affecting photographic performance. This is not caused by the compound itself but is caused by impure fogging substances. The inventors of the present invention have made earnest studies to remove these fogging substances and, as a result, found that this problem can be solved by adding an alkali other than the hydroxylamines. It is preferable to add the alkali in an amount equal to or larger than that required to neutralize the whole compound in the reaction system and it is more preferable to allow an alkali to be present (added) in an amount equal to or larger than the neutralization amount (amount required to neutralize). In the reaction, in particular, between the urethane derivative (phenyloxycarbonylamino derivative) having the silver halide-adsorptive group and the hydroxylamines when the compound represented by the Formula (VI) is synthesized, it is preferable to add an alkali in an amount corresponding to at least one mol more than the neutralization amount (more than the number of mols of the substrate reacted with the hydroxylamine derivative), and more preferably from one to five mol more than the neutralization amount.

The alkali which may be used here may be any alkalis which dissolves in an organic solvent. Examples of the alkali are inorganic alkalis {e.g., carbonates (e.g., potassium carbonate and sodium carbonate), alkali metal hydrides (e.g., sodium hydride), alkali metals (e.g., sodium) and alkali metal hydroxides (e.g., sodium hydroxide, potassium hydroxide and lithium hydroxide)}, organic alkalis {e.g., alkali metal alkoxides (e.g., sodium methoxide and sodium ethoxide) and hydroxides of quaternary salts}. Alkalis which are more basic than the hydroxylamines are preferable and organic alkalis are more preferable. Sodium methoxide is also particularly desirable. Sodium methoxide is also particularly desirable when the compound represented by the Formula (VI) is synthesized.

Also, any solvent may be used as a reaction solvent in the reaction with the hydroxylamines as far as it does not participate in the reaction. Preferable examples of the solvent include water, alcohols (e.g., methanol, ethanol and isopropanol), ethers (e.g., tetrahydrofuran and dioxane), amides (e.g., dimethylformamide and dimethylacetamide), hydrocarbons (e.g., toluene, benzene, chlorobenzene). Alcohol is more preferable and methanol is particularly preferable. Methanol is particularly preferable also when the compound represented by the Formula (VI) is synthesized.

The reaction temperature in the reaction with the hydroxylamines may range from −20° C. to 150° C., although it depends on the type of reaction. In the reaction between the phenyloxycarbonylamino derivative of the Formula (VI) and the hydroxylamines, the reaction temperature is preferably 50 to 100° C. and more preferably 55 to 90° C.

As to the amount of the alkali to be added in the reaction with the hydroxylamines, it is preferable to use the alkali in an amount equal to or larger than the neutralization amount of the reaction system, specifically, in an amount excessive for the substrate to be reacted with the hydroxylamines and preferably in an amount of 1.2 equivalents or more and 5 equivalents or less.

The details of a synthetic example of the compound (particularly, the compound (the compounds represented by the Formulae (IV) to (VI)) having the hydroxylamine partial structure) represented by the formula (I) will be explained in the examples as will be described later. However, the present invention is not limited to those shown in examples.

The content of the compound represented by the Formula (I) related to the light-sensitive silver halide emulsion is preferably $1.0\times10^{-8}$ mol/mol Ag to $1.0\times10^{-2}$ mol/mol Ag, more preferably $1.0\times10^{-7}$ mol/mol Ag to $1.0\times10^{-3}$ mol/mol Ag and more preferably $1.0\times10^{-6}$ mol/mol Ag to $5.0\times10^{-4}$ mol/mol Ag. Since the compound represented by the Formula (I) has the adsorptive group, it can produce effects for the fogging and preservation characteristics of only a specific light-sensitive silver halide emulsion and also a smaller amount (content) is required.

The compound represented by the Formula (I) is used in combination with the light-sensitive silver halide emulsion, which may be any one of a blue-sensitive silver halide emulsion, a green-sensitive silver halide emulsion and a red-sensitive silver halide emulsion and is particularly preferably a blue-sensitive emulsion. Also, when the compound represented by the Formula (I) is used in combination with the light-sensitive silver halide emulsion, it may be either added in the stage of producing the silver halide emulsion or incorporated into the light-sensitive material as an emulsion dispersion together with a hydrophobic compound such as a coupler. The compound is preferably added in the stage of producing the silver halide emulsion. When the compound is added in the stage of the production of the silver halide emulsion, it is preferably added after a water-washing step and particularly after a chemical sensitizing step, although it may be added in any one of a step of forming the silver halide particles, a water-washing step, a precipitation-dispersing step, a pre-chemical sensitizing step, a chemical sensitizing step, a post chemical sensitizing step and a pre-coating step.

The silver halide emulsion will now be explained.

In the silver halide light-sensitive material of the present invention, the silver halide emulsion is used such that at least one layer of the light-sensitive silver halide emulsion layers for every color has a halogen composition in which the content of silver chloride is 95 mol % or more, the content of silver iodide is 0.05 mol % to 0.75 mol % and/or the content of silver bromide is 0.05 mol % to 4.00 mol %. In the above halogen composition, silver chloride is an essential component and at least one of silver iodide and silver bromide may be included, and it is preferable to include the both.

In the aforementioned halogen composition, the content of silver chloride is intended to be 95 mol % or more and preferably 97 mol % or more for rapid processing. When the content of silver chloride is lower than 95 mol %, the progress of developing is significantly delayed and hindered and the emulsion significantly lacks adaptability to rapid processing.

Also, when silver iodide is included, the content of silver iodide is 0.05 mol % to 0.75 mol %, preferably 0.07 mol % to 0.50 mol % and more preferably 0.10 mol % to 0.30 mol %.

When the content of silver iodide is lower than 0.05 mol %, the sensitivity is significantly lowered whereas when the content of silver iodide is higher than 0.75 mol %, the fogging is increased and the gradation is softened.

Also, when silver bromide is included, the content of silver bromide is 0.05 mol % to 4.00 mol %, preferably 0.10 mol % to 2.00 mol % and more preferably 0.50 mol % to 1.00 mol %. When the content of silver iodide is lower than 0.05 mol %, the sensitivity is significantly reduced whereas when the content of silver iodide is higher than 4.0 mol %, the progress of developing is significantly delayed and hindered.

A silver chloride emulsion, a silver iodide emulsion, a silver bromide emulsion, a silver chloroiodide emulsion, a silver chlorobromide emulsion, a silver chloroiodobromide emulsion and the like are used singly or in combinations of two or more such that the silver halide emulsion has the aforementioned specific halogen composition. It is preferable to use a silver chloroiodide emulsion and a chloroiodobromide emulsion and it is particularly preferable to use a silver chloroiodobromide emulsion in view of the effects of the present invention.

When an iodide ion and/or a bromide ion are introduced into the silver halide emulsion, the iodide and/or bromide solutions may each be added either singly or together a silver salt solution and a highly chlorinated salt solution. In the latter case, the iodide and/or bromide solutions and the highly chlorinated salt solution may be added separately or a mixed solution of the iodide and/or bromide and the highly chlorinated salt may be added. The iodide and/or bromide are added in the form of a soluble salt such as an alkali or alkali earth iodide. In addition, an iodide may be introduced by cleaving an iodide ion from an organic molecule as described in the specification of U.S. Pat. No. 5,389,508. Also, as other iodide ion source, a silver iodide micro particles may be used.

The iodide solution may be added into all at once or may extend over a certain period of time during the formation of particles. In the highly chlorinated emulsion, the positions into which the iodide and/or the bromide are introduced are limited in order to obtain a highly sensitive and low-fogging emulsion. As the iodide ion and/or the bromide ion are introduced more internally into the emulsion particle, an increase of sensitivity lessens. Therefore, the iodide and/or bromide solution is added preferably to positions more outside than 50% of the volume of the particle, more preferably 70% or more of the volume of the particle and most preferably 80% or more of the volume of the particle. Also, the addition of the iodide and/or bromide solution finishes at the inside of preferably 98% or less and most preferably 96% or less of the volume of the particle. When the addition of the iodide and/or bromide solution finishes slightly inside of a surface of the particle, an emulsion imparting higher sensitivity and lower fogging can be obtained.

Here, the distribution of ion concentration of the iodide and/or bromide in a depth direction of the emulsion particle may be measured using, for example, TRIFT II type TOF-SIMS manufactured by Phi Evans according to an etching/TOF-SIMS (Time of Flight-Secondary Ion Mass Spectrometry) method. The details of the TOF-SIMS method are described in: *Library of Surface Analysis Technologies, Secondary Ion Mass Spectrometry* Japan Surface Science Institute. Maruzen Co., Ltd., 1999. When the emulsion particle is analyzed using the etching/TOF-SIMS method, a bleeding out of the iodide and bromide ions towards the surface of the particle can be analyzed/detected even if the addition of the iodide and bromide solution finishes at the inside of the particle. In the case where the emulsion of the present invention includes silver iodide and silver bromide, it is preferable to find, by the etching/TOF-SIMS method, that the iodide and bromide ions have a maximum concentration on the surface of a particle and the concentration of the iodide and bromide ions declines towards the inside.

When the silver halide emulsion includes a silver bromide-localized phase, it is preferable that a silver bromide-localized phase having a silver bromide content of at least 10 mol % be formed on the surface of the particles by epitaxial growth. The content of silver bromide in the silver bromide-localized phase preferably ranges from 10 to 60% and most preferably from 20 to 50 mol %. The silver bromide-localized phase preferably comprises 0.1 to 5 mol % and more preferably 0.3 to 4 mol % of a total amount of silver constituting the silver halide particle. In the silver bromide-localized phase, it is preferable to include a VIII group metal complex ion such as iridium (III) chloride, iridium (III) bromide, iridium (IV) chloride, sodium hexachloroiridate (III), potassium hexachloroiridate (IV), hexamine iridium salt (IV), trioxalatoiridium salt (III) or trioxalatoiridium salt (IV). A range of the amount of these compounds to be added extends widely corresponding to the purpose, but is preferably $10^{-9}$ to $10^{-2}$ mol per mol of the silver halide.

The silver halide particles in the silver halide emulsion are preferably cubic or tetradacahedral crystal particles having substantially a {100} plane (these particles may have a round top and planes of higher order), octahedral crystal particles or tabular particles having the characteristics that 50% or more of the total project area is occupied by a {100} plane or a {111} plane and the aspect ratio is 2 or more. The aspect ratio means the value obtained by dividing the diameter of a circle corresponding to the project area by the thickness of the particle. In the present invention, cubic particles, tabular particles having a {100} plane as the principal plane or tabular particles having a {111} plane as the principal plane are preferably applied.

As to the silver halide particles, transition metal ions may be added thereto during the course of the formation and/or growth thereof and metal ions may be incorporated into the inside and/or surface thereof. As the metal ion to be used, transition metal ions are preferable, the transition metal is preferably iron, ruthenium, iridium, osmium, lead, cadmium or zinc. Further, these metal ions are more preferably accompanied by ligands and used as a six-coordination octagonal type complex. When inorganic compounds are used as these ligands, it is preferable to use cyanide ions, halide ions, thiocyan, hydroxide ions, peroxide ions, azide ions, nitrous acid ions, water, ammonia, nitrosyl ions or thionitrosyl ions. It is desirable that these ligands be used by coordinating each with any of the aforementioned metal ions of iron, ruthenium, iridium, osmium, lead, cadmium or zinc. It is also preferable that multiple ligands be used in one complex molecule. Also, organic compounds may be used as the ligand. Preferable examples of the organic compound may include chain compounds with the primary chain having 5 or less carbon atoms and/or five- or six-membered heterocyclic compounds. More preferable organic compounds are those including, as ligand atoms with a metal, nitrogen atoms, phosphorous atoms, oxygen atoms or sulfur atoms in the molecule. Most preferable examples of the organic compounds include furans, thiophenes, oxazoles, isooxazole, thiazole, isothiazole, imidazole, pyrazole, triazoles, furazanes, pyrans, pyridines, pyridazines, pyrimidines and pyrazines. Moreover, compounds obtained by using these compounds as basic skeletons and then introducing substituents into these basic skeletons are also preferable.

As the combination of the metal ion and the ligand, a combination of an iron ion or a ruthenium ion and a cyanide ion is preferable. The cyanide ion among these compounds preferably occupies a majority of the number of ligands to be coordinated with the iron or ruthenium which is a center metal and the remainder coordination positions are preferably occupied by thiocyan, ammonia, water, nitrosyl ions, dimethylsulfoxide, pyridine, pyrazine or 4,4'-bipyridine. It is most preferable that all of six coordination positions of the center metal be occupied by cyanide ions to form a hexacyano-iron complex or a hexacyano-ruthenium complex. A complex having these cyanide ions as ligands is added in an amount of preferably $1\times10^{-8}$ mol to $1\times10^{-2}$ mol and most preferably $1\times10^{-6}$ mol to $5\times10^{-4}$ mol per mol of silver during the formation of particles. When iridium is used as the center metal, the ligands are preferably fluoride ions, chloride ions, bromide ions or iodide ions. Among these ions, chloride ions or bromide ions are preferably used. Specific examples of the iridium complex include $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$ and $[IrBr_3(H_2O)_3]^{+}$. These iridium complexes are preferably added in an amount of $1\times10^{-10}$ mol to $1\times10^{-3}$ mol and most preferably $1\times10^{-8}$ mol to $1\times10^{-5}$ mol per mol of silver during the formation of particles. When ruthenium or osmium is used as the center metal, it is preferable to use a nitrosyl ion or a thionitrosyl ion or a water molecule and a chloride ion together as the ligands. It is more preferable to form a pentachloronitrosyl complex, pentachlorothionitrosyl complex or pentachloroaqua complex. Forming is also preferable a hexachloro complex. These complexes are added in an amount of preferably $1\times10^{-10}$ mol to $1\times10^{-6}$ mol and more preferably $1\times10^{-9}$ mol to $1\times10^{-6}$ mol per mol of silver during the formation of particles.

Here, the aforementioned complex is preferably incorporated into the silver halide particle by directly adding it to a reaction solution or by adding it to an aqueous halide solution used for forming the silver halide particle or to a solution other than the above solution and by adding the resulting solution to a reaction solution for the formation of the particle. Moreover, it is also preferable to incorporate the complex into the silver halide particle by using a combination of these methods.

Also, when these complexes are incorporated into the silver halide particle, it is preferable to make these complexes exist uniformly in the inside of the particle. It is also preferable, as disclosed in JP-A Nos. 4-208936, 2-125245 and 3-188437, to make these complexes be present in only the surface layer of the particle, or to make these complexes present in only the inside of the particle and then to add a layer which does not include these complexes to the surface of the particle. Also, it is preferable to physically age the complex with micro particles incorporated into the particle to reform the surface phase of the particle as disclosed in U.S. Pat. Nos. 5,252,451 and 5,256,530. Further, combinations of these methods may be used and multiple types of complexes may be incorporated into one silver halide particle. No particular limitations are imposed on the halogen composition at the position where the above complex is included. The complex may preferably include in any of a silver chloride layer, silver chlorobromide layer, silver bromide layer, silver iodochloride layer and silver iodobromide layer.

The average particle size (obtained by defining the diameter of a circle equivalent to the projected area of the particle as the size of the particle and calculating the average value of the particle sizes) of the silver halide particles included in the silver halide emulsion is preferably 0.1 μm to 2 μm.

The distribution of size of these particles is preferably one having a coefficient of variation (obtained by dividing the standard deviation of the distribution of particle size by the average particle size) of 20% or less, preferably 15% or less and more preferably 10% or less, namely a so-called monodispersion. At this time, to obtain a wide large latitude, it is preferable to carry out such operations so as to use the above monodispersion emulsion by blending it in the same layer or by applying it to form a multilayer coating.

Also, the following compounds may be preferably used in the silver halide emulsion of the present invention to improve the preservation characteristics of the emulsion. These compounds include a hydroxam acid derivative as described in JP-A No. 11-109576, cyclic ketones having a double bond, whose both ends are substituted with an amino group or a hydroxyl group, adjacent to a carbonyl group (particularly those represented by the formula (S1), the paragraphs nos. 0036 to 0071 may be incorporated into the specification of the patent application of this case) as described in JP-A No. 11-327094, sulfo-substituted catechol and hydroquinones (e.g., 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts of these acids) as described in JP-A No. 11-143011, hydroxylamines represented by the formula (A) of U.S. Pat. No. 5,556,741 (the descriptions in U.S. Pat. No. 5,556,741, 4th column, line 56 to 11th column, line 22 are preferably applied to the application of this case and may be incorporated as a part of the specification of the patent application of this case) and water-soluble reducing agents represented by the Formulae (I) to (III) described in JP-A No. 11-102045.

The silver halide emulsion is spectrally sensitized for the purpose of imparting spectral sensitizing in desired light wavelength ranges to the emulsion of each layer in the light-sensitive material of the present invention.

Examples of spectral sensitizing dyes to be used for spectral sensitizing of blue, green and red regions include those described in: F. M. Harmer. 1964. *Heterocyclic Compounds-Cyanine Dyes and Related Compounds*. New York: John Wiley & Sons. Specific examples of the dye compound and the spectral sensitizing method are described in JP-A No. 62-215272, page 22, right upper column to page 38 and these compounds and methods are preferably used. Also, as the red-sensitive spectral sensitizing dye of, particularly, the silver halide emulsion particle having a high silver chloride content, spectral sensitizing dyes described in JP-A No. 3-123340 are very desirable in view of stability, adsorptive strength and the temperature dependency of exposure.

The range of the amounts of these spectral sensitizing dyes extends widely corresponding to the purpose, but a range from $0.5\times10^{-6}$ mol to $1.0\times10^{-2}$ mol is preferable and a range from $1.0\times10^{-6}$ mol to $5.0\times10^{-3}$ mol per mol of the silver halide is more preferable.

The silver halide emulsion may be chemically sensitized in general. As chemical sensitizing methods, sulfur sensitizing represented by the addition of an unstable sulfur compound, precious metal sensitizing represented by gold sensitizing and reduction sensitizing may be used either independently or in combinations. As the compounds used in the chemical sensitizing, those described in JP-A No. 62-215272, page 18, right lower column to page 22, right upper column are preferably used. The silver halide emulsion is preferably treated by gold sensitizing in particular among these sensitizing methods. This is because the provision of gold sensitizing makes it possible to further decrease variations in photographic performance when scanning exposure using laser light has been performed.

In order to perform the gold sensitizing of the silver halide emulsion, various inorganic gold compounds, gold (I) complexes having inorganic ligands and gold (I) compounds having an organic ligand may be utilized. As the inorganic gold compound, for example, chloroauric acids or their salts may be used. As the gold (I) complex having an inorganic ligand, for example, gold dithiocyanates such as gold (I) potassium dithiocyanate and gold dithiosulfate compounds such as gold (I) trisodium dithiosulfate may be used.

As the gold (I) compound having an organic ligand, bis gold (I) meso-ion heterocycles, e.g., gold (I) bis(1,4,5-trimethyl-1,2,4-triazolium-3-thiolate) tetrafluoroborate as described in JP-A No. 4-267249, organic mercapto-gold (I) complexes, e.g., potassium bis(1-[3-(2-sulfonatobenzamide) phenyl]-5-mercaptotetrazole potassium salt) aurate (I) pentahydrate, as described in JP-A No. 11-218870, and gold (I) compounds in which a nitrogen compound anion is coordinated, e.g., bis(1-methylhydantoinate) gold (I) sodium salt tetrahydrate, as described in JP-A No. 4-268550, may be used. Also, gold (I) thiolate compounds as described in U.S. Pat. No. 3,503,749, gold compounds as described in JP-A Nos. 8-69074, 8-69075 and 9-269554 and compounds as described in U.S. Pat. No. 5,620,841, U.S. Pat. No. 5,912,112, U.S. Pat. No. 5,620,841, U.S. Pat. No. 5,939,245 and U.S. Pat. No. 5,912,111 may be used.

The amount of these compounds to be added is $5\times10^{-7}$ to $5\times10^{-3}$ mol and preferably $5\times10^{-6}$ to $5\times10^{-4}$ mol per mol of the silver halide, although it can change widely in accordance with the situation.

Colloidal gold sulfide may also be used; its production method is described in: Research Disclosure 375154. 1995. Solid State Ionics. Vol. 79, pp. 60-66; and Compt. Rend. Hebt. Seances Acad. Sci. 1966. Vol. 263, Sect. B, p. 1328. As the colloidal gold sulfide, those having various sizes may be utilized and those having a particle diameter of 50 nm or less may be used. The amount of the colloidal gold sulfide to be added is $5\times10^{-7}$ to $5\times10^{-3}$ mol and preferably $5\times10^{-6}$ to $5\times10^{-4}$ mol as gold atoms per mol of the silver halide, although it can be changed widely corresponding to the cases.

In the present invention, the gold sensitizing may be combined with other sensitizing methods such as sulfur sensitizing, selenium sensitizing, tellurium sensitizing, reduction sensitizing and precious metal sensitizing using a precious metal other than gold.

In the light-sensitive material of the present invention, conventionally known photographic raw materials and additives may be used.

For example, as the above support, a transmittive type support and a reflective type support may be used. As the transmittive type support, those obtained by providing an information recording layer such as a magnetic layer on a transparent film such as a cellulose nitrate film or polyethylene terephthalate and a polyester of 2,6-naphthalenedicarboxylic acid (NDCA) and ethylene glycol (EG) or a polyester of NDCA, terephthalic acid and EG are preferably used. As the reflective type support, particularly a reflective type support on which multiple polyethylene layers or polyester layers (water-resistant resin layers) are laminated at least one layer of which includes a white pigment such as titanium oxide is preferable.

As more preferable examples of the reflective type support, those including a polyolefin layer having minute holes on a side of a paper base where the silver halide emulsion layer is to be provided are given. The polyolefin layer may be formed of a multilayer. In this case, the support preferably comprises a polyolefin layer which is disposed on the side of the silver halide emulsion layer adjacent to a gelatin layer and which has no minute holes (e.g., polypropylene or polyethylene) and a polyolefin (e.g., polypropylene or polyethylene) having minute holes on the side close to the paper base is more preferable. The density of the layer or layers of polyolefin disposed between the paper base and the photographic structural layer is preferably 0.40 to 1.0 g/ml and more preferably 0.50 to 0.70 g/ml. Also, the thickness of the layer or layers of polyolefin disposed between the paper base and the photographic structural layer is preferably 10 to 100 μm and more preferably 15 to 70 μm. Also, the ratio of the thickness of the polyolefin layer to the thickness of the paper base is preferably 0.05 to 0.2 and more preferably 0.1 to 0.15.

It is also preferable to provide a polyolefin layer on the side of the paper base opposite to the photographic structural layer (backface) with the view of improving the rigidity of the reflective support. In this case, the polyolefin layer on the backface is preferably a frosted matted polyethylene or polypropylene and more preferably a frosted/matted polypropylene. The polyolefin layer provided on the backface has a thickness of preferably 5 to 50 μm and more preferably 10 to 30 μm and a preferable density of 0.7 to 1.1 g/ml. As preferable embodiments of the polyolefin layer to be formed on the paper base, examples described in JP-A Nos. 10-333277, 10-333278, 11-52513, 11-65024, EP 0880065 and EP 0880066 are given.

Further, a fluorescent whitening agent is preferably included in the aforementioned water-resistant resin layer. Also, a hydrophilic colloidal layer including the above fluorescent whitening agent dispersed therein may be formed separately. As the above fluorescent whitening agent, a benzoxazoles, cumarins or pyrazolines may be used. Among these types, a benzooxazolylnaphthalene type or benzooxazolylstilbene type fluorescent whitening agent is preferable. The amount of the whitening agent is preferably 1 to 100 $mg/m^2$ although there is no limitation to it. The mixing ratio of the whitening agent when it is mixed in the water-resistant resin is preferably 0.0005 to 3 weight % and more preferably 0.001 to 0.5 weight % based on the resin.

The above reflective type support may comprise a hydrophilic colloidal layer, which includes a white pigment, on a transmittive type support or a reflective type support as previously described. The reflective type support may also be a type having a mirror-reflective or second-class diffusion reflective metal surface.

Also, as the support to be used for the light-sensitive material according to the present invention for display, a white polyester type support or a support in which a layer including a white pigment is formed on a support on the side provided with the silver halide emulsion layer may be used. Moreover, in order to improve sharpness, an antihalation layer may be preferably applied to the side of the support to which side the silver halide emulsion is applied or on the backface of the support. It is preferable to design the transmission density of the support to range from 0.35 to 0.8 in particular so that a display can be viewed whether reflected light or transmitted light is used.

In the light-sensitive material according to the present invention, it is preferable to add a dye (an oxonol type dye, in particular), which can be decolored by a treatment as described in EP No. 0,337,490A2, page 27 to page 76, to a hydrophilic colloidal layer such that the optical reflection density of the light-sensitive material at 680 nm becomes at least 0.70 for the purpose of improving the sharpness of an image and the like. It is also preferable to include at least 12 weight % (more preferably 14 weight % or more) of titanium oxide, which has been surface-treated using divalent to tetravalent alcohols (e.g., trimethylolethane), in the water-resistant resin layer of the support.

In the light-sensitive material according to the present invention, it is preferable to add a dye (an oxonol dye or a cyanine dye, in particular), which can be decolored by a treatment as described in the specification of EP No. 0337490A2, page 27 to page 76, to a hydrophilic colloidal layer for the purpose of preventing irradiation and halation and improving the safety of a safe light and the like. Furthermore, dyes as described in the specification of EP No. 0819977 are also preferably added to the light-sensitive material of the present invention.

Some of these water-soluble dyes cause color separation and impair the safety of a safe light if the amount thereof is increased. As the dyes which can be used without increasing color separation, water-soluble dyes as described in JP-A Nos. 5-127324, 5-127325 and 5-216185 are preferable.

In the present invention, a colored layer, which can be decolored by a treatment, is used either in place of or in combination with the water-soluble dye. The colored layer to be used, which can be decolored by the treatment, may be brought directly into contact with the layer having the silver halide emulsion or disposed so as to be in contact with the silver-halide emulsion containing layer through an intermediate layer including a process color mixing preventive such as a gelatin or hydroquinone. This colored layer is preferably disposed beneath (support side) an emulsion layer which develops the same primary color as that of the colored layer. It is possible to provide all colored layers corresponding to each primary color individually or to only provide some of these layers selected voluntarily. Also, it is possible to dispose a colored layer which is colored to correspond to multiple primary color ranges. As to the optical reflection density of the colored layer, the optical density for a wavelength, which gives the highest optical density in the wavelength range to be used for exposure (the visible light region in a wavelength range from 400 nm to 700 nm in the case of normal printer exposure and the wavelength of a scanning exposure light source to be used in the case of scanning exposure), is preferably 0.2 to 3.0, more preferably 0.5 to 2.5 and particularly preferably 0.8 to 2.0.

In order to form the above colored layer, conventionally known methods may be applied. Examples of these methods include a method in which a dye, like the dyes described in JP-A No. 2-282244, page 3, right upper column to page 8 and in JP-A No. 3-7931, page 3, right upper column to page 11, left lower column, is included in a hydrophilic colloidal layer in a solid fine particle dispersion, a method in which an anionic dye is made to mordant a cationic polymer, a method in which a dye is made to adsorb to fine particles of silver halide or the like to fix the dye in the layer and a method in which colloidal silver is used as described in JP-A No. 1-239544. As a method for dispersing a fine powder of a dye in a solid state, for example, a method comprising a micropowder dye which is substantially water-insoluble at a pH of 6 or less but substantially water-soluble at a pH of at least 8 is described in JP-A No. 2-308244, page 4 to page 13. Also, a method in which an anionic dye is made to mordant a cationic polymer is described in JP-A No. 2-84637, pages 18 to 26. A method of the preparation of colloidal silver as a light absorber is shown in U.S. Pat. Nos. 2,688,601 and 3,459,563. Among these methods, for example, a method for including a micropowder dye and a method which uses colloidal silver are preferable.

The light-sensitive material of the present invention is used for color negative films, color positive films, color reversal films, color reversal printing paper, color printing paper. The light-sensitive material of the present invention is preferably used for color printing paper in particular.

The color printing paper preferably comprises at least one of each of a yellow color developing silver halide emulsion layer, a magenta color developing silver halide emulsion layer and a cyan color developing silver halide emulsion layer. These silver halide emulsion layers are generally arranged such that the yellow color developing silver halide emulsion layer, the magenta color developing silver halide emulsion layer and the cyan color developing silver halide emulsion layer are disposed in this order from the side close to a support. However, a layer structure differing from the above structure may be adopted. The silver halide emulsion layer including a yellow coupler may be disposed at any position on the support. However, when a silver halide tabular particles are included in the yellow coupler-containing layer, the yellow coupler-including layer is preferably applied and formed at a position further from the support than at least one of the magenta coupler-including silver halide emulsion layer and the cyan coupler-including silver halide emulsion layer. Also, the yellow coupler-including silver halide emulsion layer is preferably disposed at a position furthest from the support relative to other silver halide emulsion layers with the view of promoting color developing, promoting desilverization and reducing residual color due to a sensitizing dye. Moreover, it is preferable that the cyan coupler-including silver halide emulsion layer be disposed as a center layer between other silver halide emulsion layers with the view of reducing Blix color fading or as a lowermost layer with the view of decreasing photo-color fading. Also, each of these yellow, magenta and cyan color developing layers may be formed from two or three layers. For example, as described in JP-A Nos. 4-75055, 9-114035, 10-246940 and U.S. Pat. No. 5,576,159, it is also preferable to dispose a coupler layer, which contains no silver halide emulsion, adjacent to a silver halide emulsion layer and to make the coupler layer serve as a color developing layer.

As the silver halide emulsion, other raw materials (e.g., additives) and the photographic structural layers (e.g., layer arrangements) which are applied in the present invention and treating methods and treating additives which are applied to treat these light-sensitive materials, those described in JP-A Nos. 62-215272, 2-33144 and EP No. 0,355,660A2 and particularly those described in EP No. 0,355,660A2 are preferably used. Moreover, the silver halide color photographic light-sensitive materials and treating methods described in JP-A Nos. 5-34889, 4-359249, 4-313753, 4-270344, 5-66527, 4-34548, 4-145433, 2-854, 1-158431, 2-90145, 3-194539, 2-93641 and European Patent Laid-Open No. 0520457A2 are also preferable.

Particularly, in the present invention, as the aforementioned reflective type support, silver halide emulsions, dissimilar metal ion types with which the silver halide particles are doped, preservation stabilizers and antifoggants for the silver halide emulsions, chemical sensitizing methods (sensitizers), spectral sensitizing methods (spectral sensitizers), cyan, magenta and yellow couplers and methods of emulsification and dispersion of these couplers, color image preservation improvers (stain preventives and fading preventives), dyes (colored layer), gelatin types, the layer structure of the light-sensitive material and the coating pH of the light-sensitive material, those described in the places of the patents listed in the following tables are preferably applied.

TABLE 1

| Element | JP-A No. 7-104448 | JP-A No. 7-77775 | JP-A No. 7-301895 |
|---|---|---|---|
| Reflective type support | 7th column, line 12-12th column, line 19 | 35th column, line 43-44th column, line 1 | 5th column, line 40-9th column, line 26 |
| Silver halide emulsion | 72th column, line 29-74th column, line 18 | 44th column, line 36-46th column, line 29 | 77th column, line 48-80th column, line 28 |
| Dissimilar metal ion types | 74th column, line 19-74th column, line 44 | 46th column, line 30-47th column, line 5 | 80th column, line 29-81th column, line 6 |
| Preservation stabilizers or antifoggants | 75th column, line 9-75th column, line 18 | 47th column, line 20-47th column, line 29 | 18th column, line 11-31th column, line 37 (particularly mercaptohetero-cyclic compounds) |
| Chemical sensitizing methods (chemical sensitizers) | 74th column, line 45-75th column, line 6 | 47th column, line 7-47th column, line 17 | 81th column, line 9-81th column, line 17 |
| Spectral sensitizing methods (spectral sensitizers) | 75th column, line 19-76th column, line 45 | 47th column, line 30-49th column, line 6 | 81th column, line 21-82th column, line 48 |
| Cyan couplers | 12th column, line 20-39th column, line 49 | 62th column, line 50-63th column, line 16 | 88th column, line 49-89th column, line 16 |
| Yellow couplers | 87th column, line 40-88th column, line 3 | 63th column, line 17-63th column, line 30 | 89th column, line 17-89th column, line 30 |
| Magenta couplers | 88th column, line 4-88th column, line 18 | 63th column, line 3-64th column, line 11 | 31th column, line 34-77th column, line 44 and 88th column, line 32-88th column, line 46 |
| Methods of emulsification and dispersion of the couplers | 71th column, line 3-72th column, line 11 | 61th column, line 36-61th column, line 49 | 87th column, line 35-87th column, line 48 |

TABLE 2

| Element | JP-A No. 7-104448 | JP-A No. 7-77775 | JP-A No. 7-301895 |
|---|---|---|---|
| Color image preservation improvers (stain preventives) | 39th column, line 50-70th column, line 9 | 61th column, line 50-62th column, line 49 | 87th column, line 49-88th column, line 48 |
| Fading preventives | 70th column, line 10-71th column, line 2 | | |
| Dyes (coloring agent) | 77th column, line 42-78th column, line 41 | 7th column, line 14-19th column, line 42 and 50th column, line 3-51th column, line 14 | 9th column, line 27-18th column, line 10 |
| Gelatin types | 78th column, line 42-78th column, line 48 | 51th column, line 15-51th column, line 20 | 83th column, line 13-83th column, line 19 |
| Layer structures of the light-sensitive materials | 39th column, line 11-39th column, line 26 | 44th column, line 2-44th column, line 35 | 31th column, line 38-32th column, line 33 |
| Coating pH of the sensitive materials | 72th column, line 12-72th column, line 28 | | |

TABLE 2-continued

| Element | JP-A No. 7-104448 | JP-A No. 7-77775 | JP-A No. 7-301895 |
|---|---|---|---|
| Scanning exposure | 76th column, line 6-77th column, line 41 | 49th column, line 7-50th column line 2 | 82th column, line 49-83th column, line 12 |
| Preservatives in a developing solution | 88th column, line 19-89th column, line 22 | | |

As the cyan, magenta and yellow couplers to be used in the present invention, besides the above, the couplers described in JP-A No. 62-215272, page 91, right upper column, line 4 to page 121, left upper column, line 6, JP-A No. 2-33144, page 3, right upper column, line 14 to page 18, left upper column, bottom line and page 30, right upper column, line 6 to page 35, right lower column, line 11 and EP No. 0355,660A2, page 4, line 15 to line 27, page 5, line 30 to page 28, bottom line, page 45, line 29 to line 31 and page 47, line 23 to page 63, line 50 may also be used.

Also, in the present invention, the compounds represented by the formulae (II) or (III) in WO-98/33760 or by the formula (D) in JP-A No. 10-221825 may be added and are preferable.

As the cyan coupler which may be used in the present invention, pyrrolotriazole type couplers are preferably used.

The couplers represented by the formula (I) or (II) in JP-A No. 5-313324, the couplers represented by the formula (I) in JP-A No. 6-347960 and the exemplified couplers described in these patents are particularly preferable.

Also, phenol type or naphthol type cyan couplers are preferable. For example, the couplers represented by the formula (ADF) described in JP-A No. 10-333297 are preferable.

As the cyan coupler other than the aforementioned couplers, pyrroloazole type cyan couplers as described in respective specifications of EP Nos. 0488248 and 0491197A1, 2,5-diacylaminophenol couplers as described in U.S. Pat. No. 5,888,716, pyrazoloazole type cyan couplers having an electron attractive group or a hydrogen bonding group at the 6th position as described in U.S. Pat. Nos. 4,873,183 and 4,916,051 and, particularly, pyrazoloazole type cyan couplers having a carbamoyl group at the 6th position as described in JP-A Nos. 8-171185, 8-311360 and 8-339060 are preferable.

Also, besides diphenylimidazole type cyan couplers as described in the publication of JP-A No. 2-33144, 3-hydroxypyridine type cyan couplers (in particular, those changed to two-equivalent couplers by allowing a four-equivalent coupler among the couplers (42) listed as specific examples to have a chlorine leaving group and the couplers (6) and (9) are particularly preferable) as described in the specification of EP No. 0333185A2, annular active methylene type cyan couplers (among these couplers, the exemplified couplers 3, 8 and 34 listed as specific examples are particularly preferable) as described in the publication of JP-A No. 64-32260, pyrrolopyrazole type cyan couplers as described in the specification of EP No. 0456226A1 and pyrroloimidazole type cyan couplers as described in the specification of EP No. 0484909 may also be used.

Among these cyan couplers, pyrroloazole type cyan couplers represented by the formula (I) as described in JP-A No. 11-282138 are particularly preferable and the descriptions of paragraphs nos. 0012 to 0059 of the patent application including the exemplified cyan couplers (1) and (47) are applied without being changed and are incorporated as a part of the specification of the patent application of this case.

As the magenta coupler to be used in the present invention, 5-pyrazolone type magenta couplers and pyrazoloazole type magenta couplers as described in the known literature in the aforementioned tables can be used. Among these couplers, pyrazolotriazole couplers in which a secondary or tertiary alkyl group is connected directly to the second, third or sixth position of a pyrazolotriazole cycle as described in JP-A No. 61-65245, pyrazoloazole couplers in which a sulfonamide group is comprised within the molecule as described in JP-A No. 61-65246, pyrazoloazole couplers having an alkoxyphenylsulfonamide ballast group as described in JP-A No. 61-147254 and pyrazoloazole couplers having an alkoxy group or an aryloxy group at sixth position as described in EP No. 226, 849A and No. 294,785A are preferably used in view of image stability and color developing ability.

Particularly pyrazoloazole couplers represented by the formula (M-I) as described in JP-A No. 8-122984 are preferable as the magenta coupler and the descriptions of paragraphs nos. 0009 to 0026 of this patent are applied as it is and incorporated as a part of the specification of the patent application of this case.

In addition to the above, pyrazoloazole couplers having steric hindrance groups at both the third and sixth positions as described in EP Nos. 854384 and 884640 are also preferably used.

Also, as the yellow coupler, besides the compounds described in the aforementioned tables, acylacetamide type yellow couplers in which the acyl group has a three- to five-membered cyclic structure as described in the specification of EP No. 0447969A1, malondianilide type yellow couplers having a cyclic structure as described in the specification of EP No. 0482552A1, pyrrol-2 or 3-yl carbonylacetic acid anilide or indole-2 or 3-ylcarbonylacetic acid anilide type couplers as described in EP Nos. 953870A1, 953871A1, 953872A1, 953873A1, 953874A1 and 953875A1 and acylacetamide type yellow couplers having a dioxane structure as described in the specification of U.S. Pat. No. 5,118,599 are preferably used. Among these couplers, acylacetamide type yellow couplers whose acyl group is 1-alkylcyclopropane-1-carbonyl group and malondianilide type yellow couplers in which one of the anilides constitutes an indoline cycle are particularly preferable. These couplers may be used either singly or in combinations of two or more.

The coupler in the present invention is preferably used such that a loadable latex polymer (e.g., U.S. Pat. No. 4,203,716) is impregnated with the coupler in the presence (or non-presence) of a high-boiling point organic solvent described in the previous tables or the coupler is dissolved together with a water-insoluble and organic solvent-soluble polymer in the high-boiling point organic solvent, and emulsified and dispersed in a hydrophilic aqueous colloid solution.

Preferable examples of the water-insoluble and organic solvent-soluble polymer include homopolymers or copolymers as described in the specification of U.S. Pat. No. 4,857,449, 7th to 15th columns and the specification of International Laid-Open WO88/00723, pages 12 to 30. Methacrylate type or acrylamide type polymers are more preferable and particularly the use of acrylamide type polymers is preferable in view of, for example, color image stability.

In the present invention, known color mixing preventives may be used. Among these preventives, those described in the patents given below are preferable.

For example, high molecular weight redox compounds as described in JP-A No. 5-333501, phenidone or hydrazine type compounds as described in WO98/33760 and U.S. Pat. No. 4,923,787 and white couplers as described in JP-A Nos. 5-249637, 10-282615 and D.T. Patent No. 19629142A1 may be used. Also, when the pH of a developing solution is raised to accelerate developing, redox compounds as described in D.T. Patent No. 19618786A1, EP Patent Nos. 839623A1 and 842975A1, D.T. Patent No. 19806846A1 and F.R. Patent No. 2760460A1 may also be preferably used.

In the present invention, compounds having a triazine skeleton having a high molar extinction coefficient are preferably used as the ultraviolet absorber. For example, the compounds described in the following patents may be used. These compounds are preferably added to light-sensitive layers and/or light-insensitive layers.

Examples of these compounds include compounds as described in JP-A Nos. 46-3335, 55-152776, 5-197074, 5-232630, 5-307232, 6-211813, 8-53427, 8-234364, 8-239368, 9-31067, 10-115898, 10-147577, 10-182621, D.T. Patent No. 19739797, EP No. 711804A and Japanese Patent Application National Publication (Laid Open) No. 8-501291.

As a binder or a protective colloid which can be used for the light-sensitive material according to the present invention, the use of a gelatin is advantageous. A hydrophilic colloid other than gelatin may be either independently or in combination with gelatin. Preferable gelatin may contain heavy metals, such as iron, copper, zinc and manganese, which are included as impurities, in an amount of preferably 5 ppm or less and more preferably 3 ppm or less.

Also, the amount of calcium included with photosensitive material is preferably 20 mg/m$^2$ or less, more preferably 10 mg/m$^2$ or less and most preferably 5 mg/m$^2$ or less.

In the present invention, it is preferable to add an antibacterial and anti-mildew agent as described in the publication of JP-A No. 63-271247 to prevent various mildews and bacteria, which propagate in the hydrophilic colloidal layers, to deteriorate an image.

Further, the film pH of the light-sensitive material is preferably 4.0 to 7.0, and more preferably 4.0 to 6.5.

In the present invention, a surfactant may be added to the light-sensitive material to improve the application stability of the light-sensitive material, prevent the generation of static electricity and control charge quantity. Examples of the surfactant include anionic surfactants, cationic surfactants, betaine surfactants and nonionic surfactants: for example, those described in JP-A No. 5-333492. As the surfactant to be used in the present invention, surfactants which include a fluorine atom are preferable. Although this fluorine atom-comprising surfactant may be used either independently or in combination with other conventionally known surfactants, being used in combination with other conventionally known surfactants is preferable.

The amount of these surfactants to be added to the light-sensitive material not particularly limited, but is usually $1\times10^{-5}$ to 1 g/m$^2$, preferably $1\times10^{-4}$ to $1\times10^{-1}$ g/m$^2$ and more preferably $1\times10^{-3}$ to $1\times10^{-2}$ g/m$^2$.

The light-sensitive material of the present invention is exposed to light based on image information and then developed whereby an image can be formed. The light-sensitive material of the present invention is used in, for example, a print system using a regular negative printer and in addition, it is suitable to a scanning exposure system using a cathode ray tube (CRT). An exposure apparatus using a cathode ray tube is simpler, more compact and less expensive than that which uses a laser. Also, the optical axis and the color are regulated more easily. In a cathode ray tube used for the aforementioned image exposure, various emitters which emit light in a spectral region are used as required. For example, one or a combination of two or more types of red light emitters, green light emitters and blue light emitters are used. The spectral region is not limited to the aforementioned red, green and blue and fluorescent, materials which emit in yellow, orange, violet and infrared regions respectively are also used. In particular, a cathode ray tube which mixes these emitters to emit white light is frequently used.

When the light-sensitive material of the present invention is exposed to light, a cathode ray tube having fluorescent materials which emit light in multiple spectral regions may be used to expose the light-sensitive material to multiple colors at a time, namely image signals of multiple colors are input to the cathode ray tube to emit light from the surface of the tube, thereby carrying out exposure. A method may be adopted in which image signals of each color are input successively to emit each light successively and the light-sensitive material is exposed through a film which blocks colors other than the above each color (sequential surface exposure). Generally, the sequential surface exposure is preferable to attain high image qualities because a cathode ray tube with high resolution can be used.

For the exposure of the light-sensitive material of the present invention, a digital scanning exposure system using monocolor high density light of a gas laser, light-emitting diode, semiconductor laser or second harmonic light-emitting source (SHG) prepared by combining a semiconductor laser or a solid laser using a semiconductor laser as the excitation light source and a non-linear optical crystal is preferably used. It is preferable to use a semiconductor laser or a second harmonic light-emitting source (SHG) prepared by combining a semiconductor laser or a solid laser with a non-linear optical crystal to make the system compact and inexpensive. It is preferable to use a semiconductor laser to design a system which is particularly compact, economical, has a long life and exhibits high stability and therefore at least one of the exposure light sources preferably uses a semiconductor laser.

When using such a scanning exposure light source, the maximum wavelength of spectral sensitivity of the light-sensitive material may be arbitrarily set according to the wavelength of the scanning exposure light source to be used. When the above SHG light source obtained by combining a solid laser using a semiconductor laser or a semiconductor laser as the excitation light-source with a non-linear optical crystal, the oscillation wavelength of the laser can be halved and therefore blue light and green light can be obtained. Accordingly, the light-sensitive material can be made to have maximum of spectral sensitivity in each of the usual blue, green and red wavelength regions.

Exposure time in this kind of scanning exposure is preferably $10^{-4}$ seconds or less and more preferably $10^{-6}$ seconds or less in terms of exposure time per pixel, which is defined herein as the time required to expose a pixel size in the case where the pixel density is set as 400 dpi.

Scanning exposure systems which can be preferably applied to the present invention are described in the patents listed in the previous table.

When the light-sensitive material of the present invention is exposed by a printer, it is preferable to use a band stop filter as described in U.S. Pat. No. 4,880,726. This removes light color mixing and improves color reproducibility significantly.

As described in EP Nos. 0789270A1, 0789480A1, a yellow micro-dot pattern may be formed on the light-sensitive material of the present invention by pre-exposure in advance of image information being given to place restrictions on copying.

For the treatments to the light-sensitive material of the present invention, a raw materials treatment and treatment methods as described in JP-A No. 2-207250, page 26, right lower column line 1 to page 34, right upper column, line 9 and JP-A No. 4-97355, page 5, left upper column, line 17 to page 18, right lower column, line 20 may be preferably applied. Also, as a preservative to be used for a developing solution, compounds described in the patents listed in the aforementioned table may be preferably used.

Rapid development treatment of the light-sensitive material of the present invention may be performed after exposure. When the rapid development treatment is carried out, color developing time is preferably 60 seconds or less, more preferably 6 to 50 seconds and still more preferably 6 to 30 seconds. In the present invention, color developing time is particularly preferably 20 seconds or less (most preferably 3 to 20 seconds). Similarly, bleaching-fixing time is preferably 60 seconds or less, more preferably 6 to 50 seconds and sill more preferably 6 to 30 seconds. In the present invention, bleaching-fixing time is particularly preferably 20 seconds or less (most preferably 3 to 20 seconds). Also, washing or stabilizing time is preferably 150 seconds or less and more preferably 6 to 130 seconds.

The color developing time refers to a period of time from when the light-sensitive material is put in a color developing solution until it is put in a bleaching-fixing solution used in the next treating step. For example, when the light-sensitive material is treated in an automatic developing machine or the like, the color developing time refers to the total of a time (a so-called in-solution time) during which the light-sensitive material is immersed in the color developing solution and a time (a so-called in-air time) during which the light-sensitive material is taken out from the color developing solution and is carried through the air towards a bleaching and fixing bath in the next step. Similarly, the bleaching and fixing time refers to a time which passes from when the light-sensitive material is put in the bleaching and fixing solution to when the light-sensitive material is put in the next water-washing or stabilizing bath. The water-washing or stabilizing time refers to a time (the so-called in-solution time) from when the light-sensitive material enters a washing with water or a stabilizing bath until the light-sensitive material is in the solution for the next drying step.

As a method of developing the light-sensitive material of the present invention after it is exposed, besides a wet type such as a developing method using a conventional developing solution which includes an alkali agent and a developing agent and a developing method using an activator solution such as an alkaline solution which includes no developing agent wherein the light-sensitive material includes within itself a developing agent, a thermal developing system using no processing solution may be used. Since the developing agent is not included in the processing solution, the activator method in particular, is a preferable method in the point that the control and handling of the processing solution are easy, and also in view of environmental safeguards because an inconvenience of treating the waste solution is reduced. In the aforementioned activator method, hydrazine type compounds as described in, for example, JP-A Nos. 8-234388, 9-152686, 9-152693, 9-211814 and 9-160193 are preferable as the developing agent or its precursor to be included within the light-sensitive material.

Also, a developing method in which the amount of silver to be applied in the light-sensitive material is reduced and hydrogen peroxide is used to carry out image amplifying treatment (complementary treatment) is preferably used. Particularly, it is preferable to use this method in the activator method. To state in more detail, the image forming method using an activator solution including hydrogen peroxide as described in JP-A Nos. 8-297354 and 9-152695 is preferably used. In the above activator method, a light-sensitive material is usually subjected to desilverizing treatment after it is treated in an activator solution. In the image amplifying treatment method using a light-sensitive material having a low amount of silver, however, the desilverizing treatment may be omitted and a simple method such as the washing or stabilizing treatments may be used. Also, in a system in which image information is read from a light-sensitive material with a scanner, a treating system which needs no desilverizing treatment may be adopted even when using a light-sensitive material, such as photographing light-sensitive materials, having a high amount of silver.

The present invention can use known methods and known processing raw materials for the activator solution, desilverizing solution (bleaching/fixing solution), and washing and stabilizing solution. Preferably, those described in Research Disclosure Item 36544. September, 1994. pp. 536-541 and JP-A No. 8-234388 may be used.

The light-sensitive material of the present invention can be preferable used by combining it with the exposure and developing systems described in the following references.

- Automatic printing and developing system as described in JP-A No. 10-333253
- Light-sensitive material conveyer as described in JP-A No. 2000-10206
- A recording system including an image reading device as described in JP-A No. 11-215312
- Exposure system comprising a color image recording system as described in JP-A Nos. 11-88619 and 10-202950
- Digital photoprint system including a remote control diagnostic system as described in JP-A No. 10-210206
- Photoprint system including an image recording device as described in JP-A No. 10-159187

EXAMPLES

The present invention will be explained in more detail by way of examples, which, are not intended to limit the present invention.

Example 1

(Preparation of an Emulsion A-1)

A 1:1 mixture (ratio of mols of silver) of a large size emulsion A1 having an average cubic particle size of 0.70 μm and a small size emulsion A2 having an average cubic particle size of 0.50 μm was prepared as an emulsion A-1.

The coefficients of variation of the distribution of particle size for the emulsions A1 and A2 were 0.09 and 0.11 respectively. In each size emulsion, 0.5 mol % of silver bromide was included such that it was localized at a part of the surface of the particle having silver chloride as its base. Potassium hexachloroiridate (IV) was included in the silver bromide-localized phase. Iodine ions were made to be present in an amount of 0.1 mol % relative to the total number of halogen atoms at a position corresponding to the outermost 10% of the volume of these particles, which portion was also doped with $1\times10^{-5}$ mol of $K_4Ru(CN)_6$, $1\times10^{-6}$ mol of yellow prussiate of potash and $1\times10^{-6}$ mol of $K_2IrCl_5(H_2O)$ based on the total amount by mol of silver respectively. Silver chloride, silver iodide and silver bromide contents in the emulsion were 99.4 mol %, 0.1 mol % and 0.5 mol % respectively.

The following blue-sensitive sensitizing dyes A and B were added to this emulsion in an amount of $3.2\times10^{-4}$ mol and $4.4\times10^{-4}$ mol for the emulsions A1 and A2, respectively, per mole of silver to carry out spectral sensitizing. Chemical sensitizing was properly carried out using sodium thiosulfate pentahydrate and chloroauric acid.

(Sensitizing dye A)

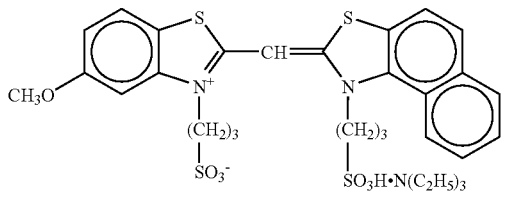

-continued (Sensitizing dye B)

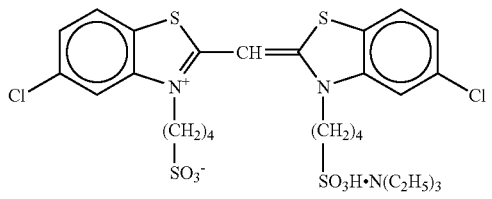

(Preparation of Emulsion B)

A 1:3 mixture (ratio or mols of silver) of a large size emulsion B1 having an average cubic particle size of 0.45 μm and a small size emulsion B2 having an average cubic particle size of 0.35 μm was prepared. The coefficients of variation of the distribution of particle size for the emulsions B1 and B2 were 0.10 and 0.08 respectively. Each size emulsion was made to include 0.1 mol % of silver iodide in the vicinity of the surface of the particle and 0.4 mol % of silver bromide at the surface of the particle. Potassium hexachloroiridate (IV) was included in the silver bromide-localized phase. Also, the silver bromide-localized phase was doped with $K_4Ru(CN)$ 6 yellow prussiate of potash and $K_2IrCl_5(H_2O)$ in the same manner as in the case of the emulsion A-1. This emulsion was spectrally sensitized using the sensitizing dyes explained later and chemical sensitizing was properly carried out using sodium thiosulfate pentahydrate and chloroauric acid.

(Preparation of Emulsion C)

A 1:1 mixture (ratio of mols of silver) of a large size emulsion C1 having an average cubic particle size of 0.40 μm and a small size emulsion C2 having an average cubic particle size of 0.30 μm was prepared. The coefficients of variation of the distribution of particle size for the emulsions C1 and C2 were 0.09 and 0.11 respectively. Each size emulsion was made to locally include 0.1 mol % of silver iodide in the vicinity of the surface of the particle and 0.8 mol % of silver bromide at the surface of the particle. Potassium hexachloroiridate (IV) was included in the silver bromide-localized phase. Also, the silver bromide-localized phase was doped with $X_4Ru(CN)_6$, yellow prussiate of potash and $K_2IrCl_5(H_2O)$ in the same manner as in the case of the emulsion A-1. This emulsion was spectrally sensitized using the sensitizing dyes explained later and chemical sensitizing was properly carried out using sodium thiosulfate pentahydrate and chloroauric acid.

The surface of a support which was formed by coating both surfaces of paper with a polyethylene resin was put in corona discharge treatment. Then, a gelatin undercoat layer including sodium dodecylbenzenesulfonate was formed and further, a first through a seventh layer of photographic structure layers were formed by successive applications to produce a sample (101) of a silver halide color photographic light-sensitive material having the layer structure presented below. Coating solutions for each photographic structure layer were prepared in the following ways.

(Preparation of a First Layer Coating Solution)

57 g of a yellow coupler (E×Y), 7 g of a color image stabilizer (Cpd-1), 4 g of a color image stabilizer (Cpd-2), 7 g of a color image stabilizer (Cpd-3) and 2 g of a color image stabilizer (Cpd-8) were dissolved in 21 g of a solvent (Solv-1) and 80 ml of ethyl acetate. The resulting solution was emulsion-dispersed in 220 g of an aqueous 23.5 weight % gelatin solution by using a high-speed stirring emulsifier (dissolver), followed by adding water to prepare 900 g of an emulsified dispersion A.

The aforementioned emulsified dispersion A and emulsion A-1 were mixed with and dissolved in each other to prepare a first layer coating solution such that the coating solution had the following composition. An amount of emulsion applied represents a coating amount converted into the amount of silver to be applied.

(Preparation of Coating Solutions for a Second Layer to a Seventh Layer)

Coating solutions for a second layer to a seventh layer were prepared in the same manner as in the preparation of the first layer coating solution. As gelatin hardeners for each layer, sodium 1-oxy-3,5-dichloro-s-triazide (H-1), and compounds (H-2) and (H-3) were used. Also, compounds Ab-1, Ab-2, Ab-3 and Ab-4 were respectively added to each layer in total amounts of 15.0 mg/m$^2$, 60.0 mg/m$^2$, 5.0 mg/m$^2$ and 10.0 mg/m$^2$.

(H-1)

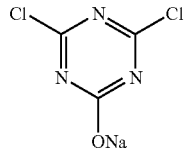

Film hardener
(used in an amount of 1.4 weight % per gelatin)

(H-2)

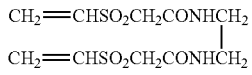

Film hardener (H-3)

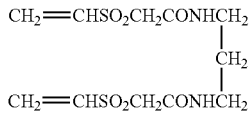

Film hardener (Ab-1)

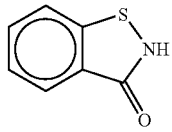

Antiseptic (Ab-2)

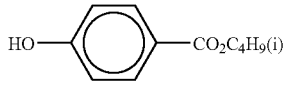

Antiseptic (Ab-3)

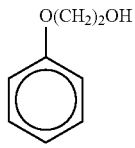

Antiseptic

-continued

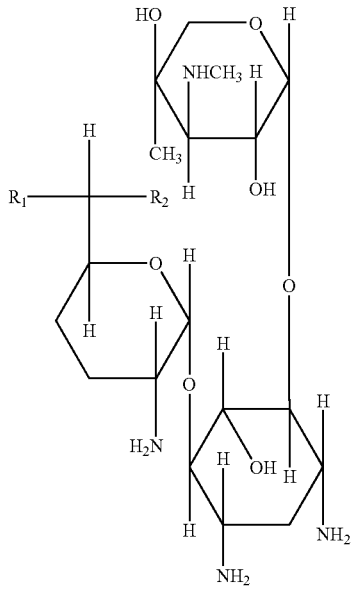

Antiseptic
1:1:1:1 mixture of a, b, c and d (mol ratio)

-continued (Ab-4)

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

The following spectral sensitizing dyes were respectively used in silver chlorobromide emulsions of green and red-sensitive emulsion layers.

(Green-sensitive Emulsion Layer)

The following sensitizing dye D was added to a large size emulsion in an amount of $3.0\times10^{-4}$ mol and to a small size emulsion in an amount of $3.6\times10^{-4}$ mol per mol of the silver halide, the following sensitizing dye E was added to a large size emulsion in an amount of $4.0\times10^{-5}$ mol and to a small size emulsion in an amount of $7.0\times10^{-5}$ mol per mol of the silver halide and the following sensitizing dye F was added to a large size emulsion in an amount of $2.0\times10^{-4}$ mol and to a small size emulsion in an amount of $2.8\times10^{-4}$ mol per mol of the silver halide.

(Sensitizing dye D)

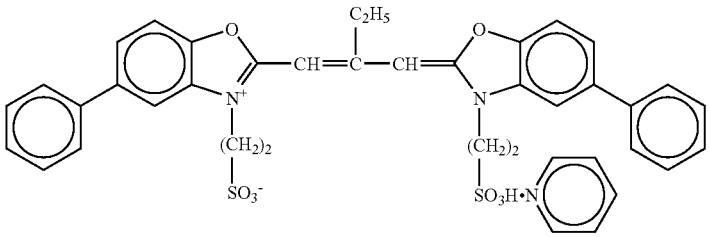

(Sensitizing dye E)

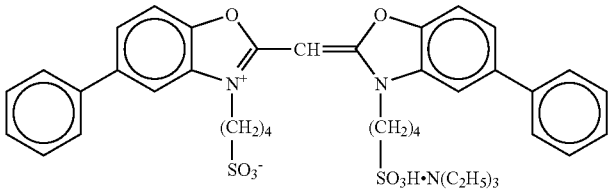

(Sensitizing dye F)

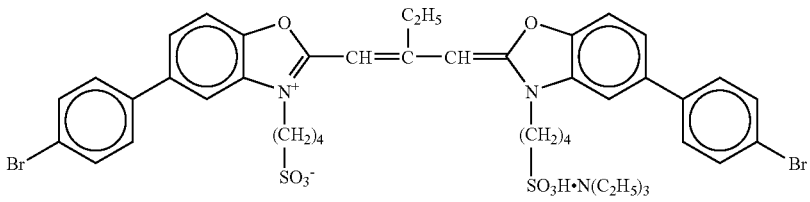

The following sensitizing dyes G and H were respectively added to a large size emulsion in an amount of $8.0\times10^{-5}$ mol and to a small size emulsion in an amount of $10.7\times10^{-5}$ mol per mol of the silver halide. Further, the following compound I was added to a red-sensitive emulsion layer in an amount of $3.0\times10^{-3}$ mol per mol of the silver halide.

(Sensitizing dye G)

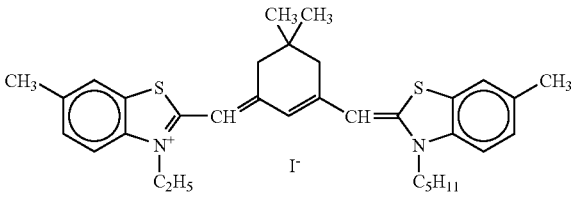

(Sensitizing dye H)

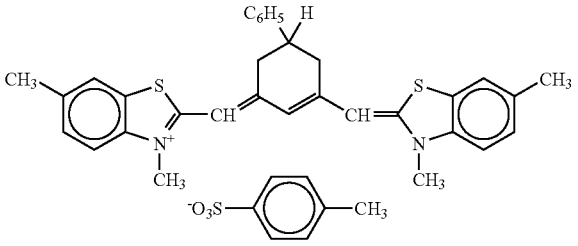

(Compound I)

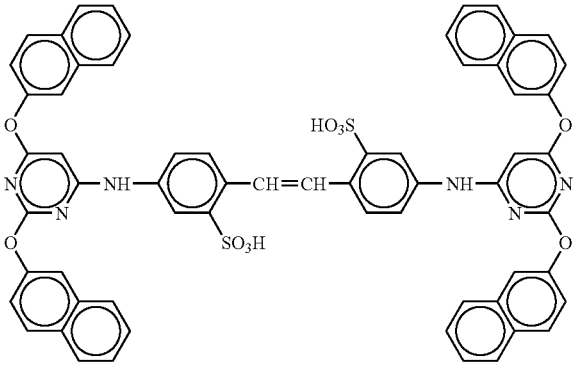

Also, 1-(3-methylureidophenyl)-5-mercaptotetrazole was respectively added to the green-sensitive emulsion layer and the red-sensitive emulsion layer in amounts of $3.3\times10^{-4}$ mol, $1.0\times10^{-3}$ mol and $5.9\times10^{-4}$ mol per mol of the silver halide.

Further, the same compound was also added to the second, the fourth, the sixth and the seventh layers in amounts of 0.2 mg/m$^2$, 0.2 mg/m$^2$, 0.6 mg/m$^2$ and 0.1 mg/m$^2$, respectively.

4-Hydroxy-6-methyl-1,3,3a,7-tetraazaindene was respectively added to the blue-sensitive emulsion layer and the green-sensitive emulsion layer in amounts of $1\times10^{-4}$ mol and $2\times10^{-4}$ mol per mol of the silver halide.

Also, 0.05 g/m$^2$ of a copolymer latex of methacrylic acid and butyl acrylate (mass ratio: 1:1, average molecular weight: 200,000 to 400,000) was added to the red-sensitive layer.

Disodium catechol-3,5-disulfonate was added to the second layer, the fourth layer and the sixth layer in amounts of 6 mg/m$^2$, 6 mg/m$^2$ and 18 mg/m$^2$, respectively.

The following dyes (numerals in parentheses indicate the amount to be applied) were added to prevent irradiation.

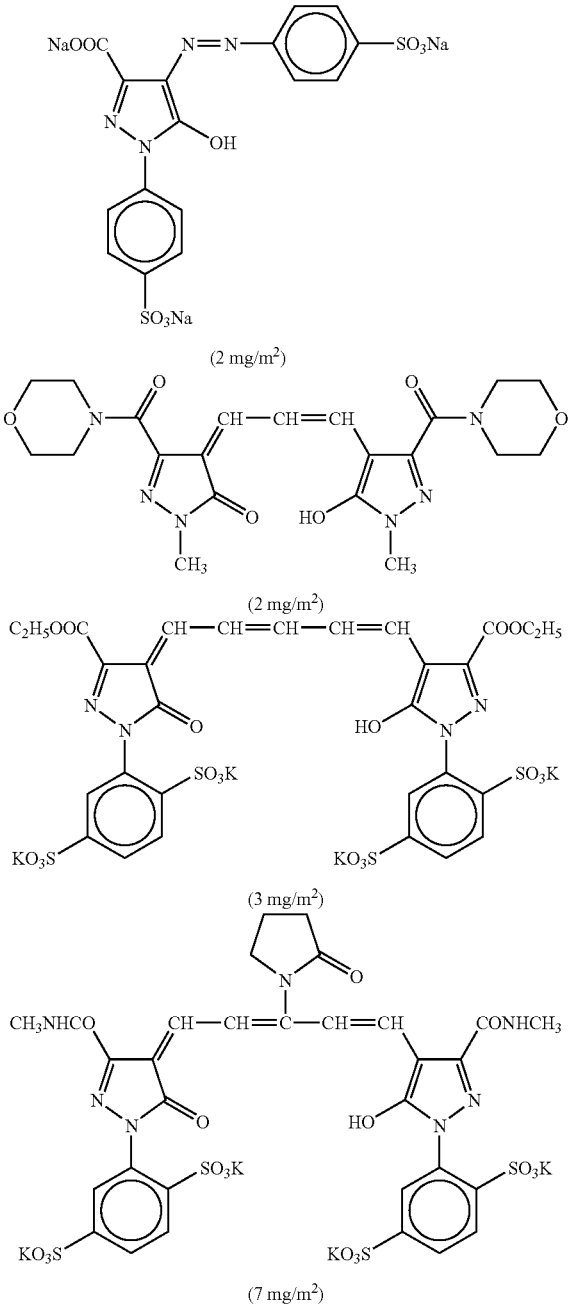

(2 mg/m$^2$)

(2 mg/m$^2$)

(3 mg/m$^2$)

(7 mg/m$^2$)

(Layer Structure)

The structure of each layer of the sample (101) is presented below. The numerals represent the amount (g/m$^2$) to be applied. The amounts listed for the silver halide emulsion that have already been converted into the amount of silver to be applied.

Support

Polyethylene Resin-laminated Paper

[The polyethylene resin includes, on the first layer side, a white pigment ($TiO_2$; a content of 16 weight %, ZnO; a content of 4 weight %), a fluorescent whitening agent (4,4-bis(5-methylbenzoxazolyl)stilbene, content: 0.03 weight %) and a blue dye (ultramarine blue)]

| | |
|---|---|
| First layer (blue-Sensitive emulsion layer) | |
| Emulsion A-1 | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second layer (color mixing preventive layer) | |
| Gelatin | 0.99 |
| Color mixing preventive (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| Third layer (green-sensitive emulsion layer) | |
| Silver chlorobromide emulsion B (aforementioned emulsion B) | 0.14 |
| Gelatin | 1.36 |
| Magenta coupler (ExM) | 0.15 |
| Ultraviolet absorber (UV-A) | 0.14 |
| Color image stabilizer (Cpd-2) | 0.02 |
| Color mixing preventive (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| Fourth layer (color mixing preventive layer) | |
| Gelatin | 0.71 |
| Color mixing preventive (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| Fifth layer (red-sensitive emulsion layer) | |
| Silver chlorobromide emulsion C (aforementioned emulsion C) | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| Sixth layer (ultraviolet absorbing layer) | |
| Gelatin | 0.46 |
| Ultraviolet absorber (UV-8) | 0.45 |
| Compound (S1-4) | 0.0015 |
| Solvent (Solv-7) | 0.25 |
| Seventh layer (protective layer) | |
| Gelatin | 1.00 |
| Acryl modified copolymer of polyvinyl alcohol (degree of modification: 17%) | 0.04 |
| Liquid paraffin | 0.02 |
| Surfactant (Cpd-13) | 0.01 |

-continued (ExY) Yellow coupler
70:30 (mol ratio) mixture of the following two compounds

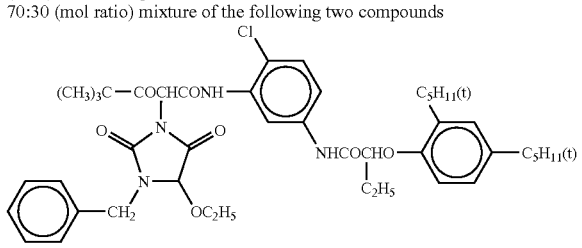

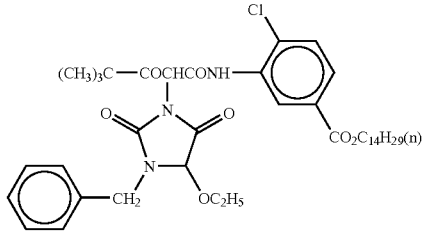

(ExM) Magenta coupler
40:40:20 (mol ratio) mixture of the following three compounds

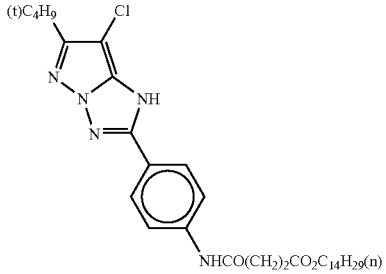

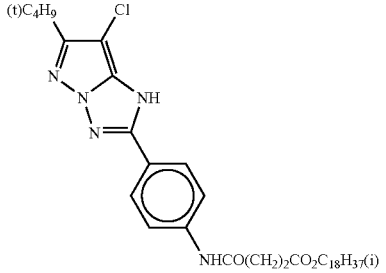

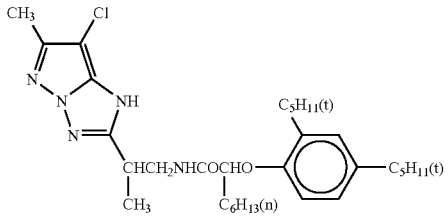

(ExC-2) Cyan coupler

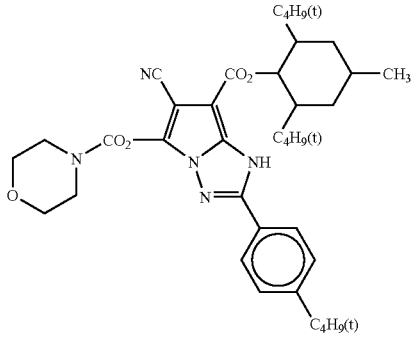

-continued (ExC-3) Cyan coupler

50:25:25 (mol ratio) mixture of the following three compounds

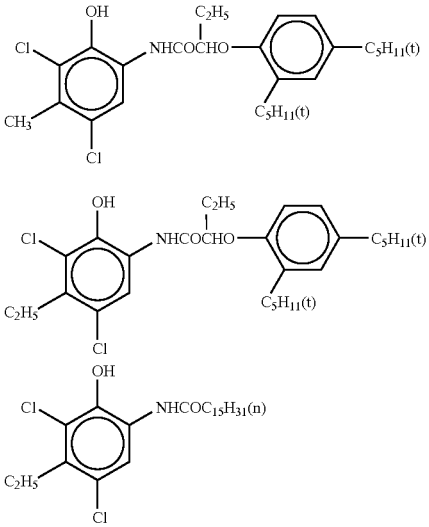

(Cpd-1) Color image stabilizer

Number average molecular weight: 60,000

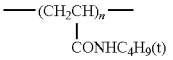

(Cpd-2) Color image stabilizer

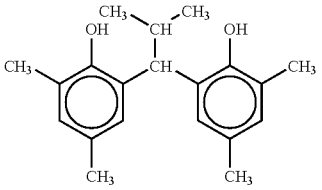

(Cpd-3) Color image stabilizer

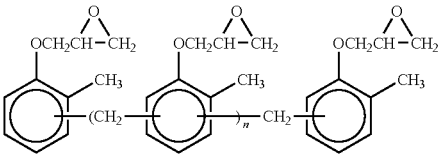

n = 7 to 8 (average value)

(Cpd-4) Color mixing preventive

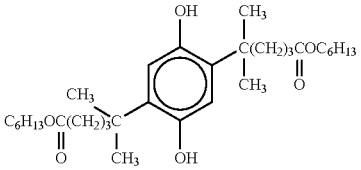

(Cpd-5) Color image stabilizer

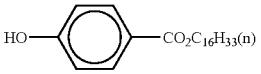

(Cpd-6) Color image stabilizer

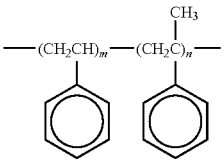

Number average molecular weight: 600 m/n = 10/90

-continued (Cpd-7) Color image stabilizer

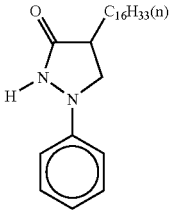

(Cpd-8) Color image stabilizer

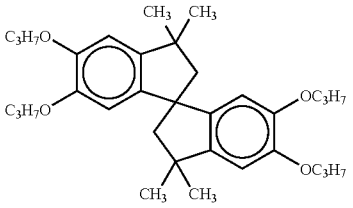

(Cpd-9) Color image stabilizer

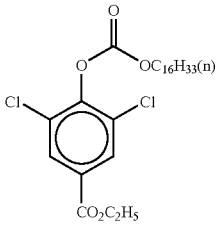

(Cpd-10) Color image stabilizer

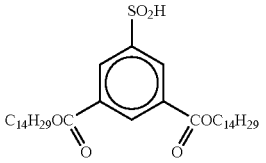

(Cpd-11)

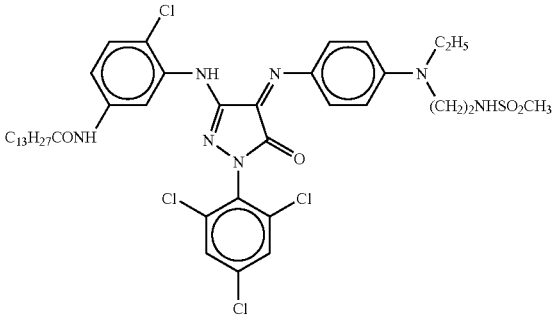

(Cpd-13) Surfactant

7:3 (mol ratio) mixture of the following two compounds

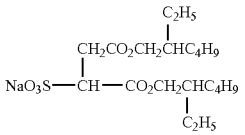

and

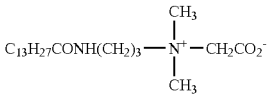

-continued (Cpd-14)

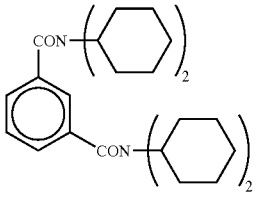

(Cpd-15)

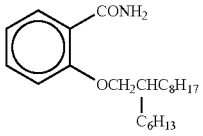

(Cpd-16)

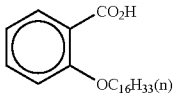

(Cpd-17)

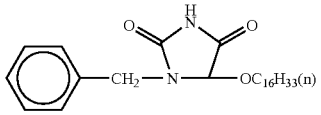

(Cpd-18)

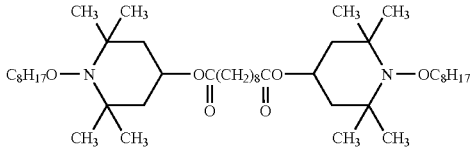

(Cpd-19) Color mixing preventive

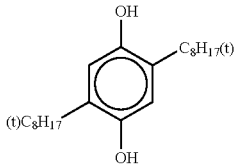

(UV-1) ultraviolet absorber

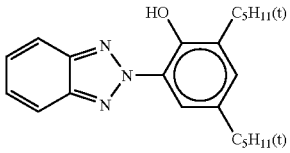

(UV-2) Ultraviolet absorber

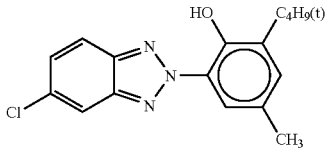

(UV-3) Ultraviolet absorber

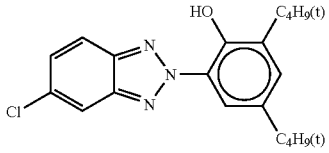

-continued (UV-4) Ultraviolet absorber

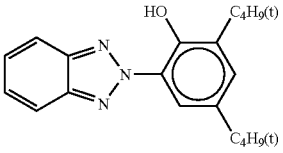

(UV-5) Ultraviolet absorber

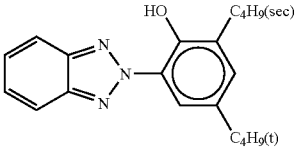

(UV-6) Ultraviolet absorber

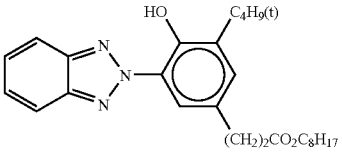

(UV-7) Ultraviolet absorber

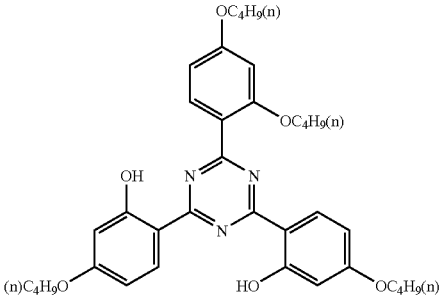

UV-A: Mixture of UV-1/UV-2/UV-3/UV-4 (mass ratio:4/2/2/3).

UV-B: Mixture of UV-1/UV-2/UV-3/UV-4/UV-5/UV-6 (mass ratio: 9/3/3/4/5/3)

UV-C: Mixture of UV-2/UV-3/UV-6/UV-7 (mass ratio:1/1/1/2).

(Solv-1)

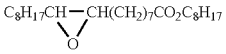

(Solv-2)

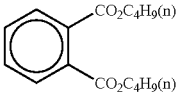

(Solv-3)

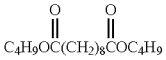

(Solv-4)

(Solv-5)

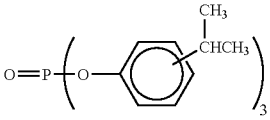

(Solv-7)

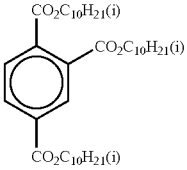

-continued (Solv-8)

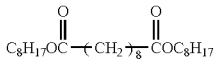

(S1-4)

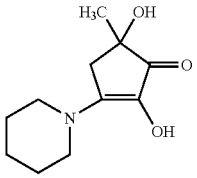

Emulsions A-2 to A-18 were prepared in the same manner as the emulsion A-1 except that the silver iodide content, the silver bromide content, the positions of bromine in the first layer of the sample (101) and compounds (adsorptive type reducible compound) represented by the Formula (I) were changed and added after chemical sensitization was finished according to those shown in Table 3. Samples (102) to (118) were produced in the same manner as the sample (101) except that these emulsions respectively replaced the emulsion A-1 of the first layer.

The following experiments were conducted to assess the photographic characteristics of these samples.

Experiment 1 Sensitometry

Each coated sample was subjected to gradation exposure for sensitometry by using a sensitometer (FWH type manufactured by Fuji Photo Film). A Sp-1 filter was installed in the sensitometer to implement exposure at a low illuminance for 10 seconds.

After the exposure, color developing treatment A shown below was performed.

The treating step is shown in the following.

(Treatment A)

The above sample of the light-sensitive material was processed into a 127-mm-wide roll, which was then exposed imagewise through a negative film having an average density by using a treatment apparatus for experiments. The treatment apparatus for experiments was obtained by modifying a mini-laboratory printer processor PP350 such that treating time and treating temperature could be changed. The resulting sample was treated continuously (running test) until the volume of the color developing replenishment solution used in the treating step shown below was 0.5 times the volume of a color developing tank.

TABLE 3

| | First layer | | | | | | | |
|---|---|---|---|---|---|---|---|---|
| | Emulsion | | | | | Compound represented by the formula (I) | | |
| Sample No. | Type of emulsion | Content of silver chloride (mol %) | Content of silver iodide (mol %) | Content of silver bromide (mol %) | Position of bromine | Type of compound | Amount to be added (mol/molAg) | Remarks |
| (101) | A-1 | 99.4 | 0.1 | 0.5 | Epi-localized phase | None | None | Comparative Example |
| (102) | A-2 | 99.4 | 0.1 | 0.5 | Epi-localized phase | I-49 | $2.50 \times 10^{-5}$ | Present invention |
| (103) | A-3 | 99.4 | 0.1 | 0.5 | Epi-localized phase | I-49 | $5.00 \times 10^{-4}$ | Present invention |
| (104) | A-4 | 99.4 | 0.1 | 0.5 | 80 to 90% uniform | None | None | Comparative Example |
| (105) | A-5 | 99.4 | 0.1 | 0.5 | 80 to 90% uniform | I-49 | $2.50 \times 10^{-5}$ | Present invention |
| (106) | A-6 | 99.4 | 0.1 | 0.5 | 80 to 90% uniform | I-49 | $5.00 \times 10^{-4}$ | Present invention |
| (107) | A-7 | 100 | None | None | None | None | None | Comparative Example |
| (108) | A-8 | 100 | None | None | None | I-49 | $2.50 \times 10^{-5}$ | Comparative Example |
| (109) | A-9 | 100 | None | None | None | I-49 | $5.00 \times 10^{-4}$ | Comparative Example |
| (110) | A-10 | 99.8 | None | 0.2 | Epi-localized phase | None | None | Comparative Example |
| (111) | A-11 | 99.8 | None | 0.2 | Epi-localized phase | I-49 | $2.50 \times 10^{-5}$ | Present invention |
| (112) | A-12 | 99.0 | 1.0 | None | None | None | None | Comparative Example |
| (113) | A-13 | 99.0 | 1.0 | None | None | I-49 | $2.50 \times 10^{-5}$ | Comparative Example |
| (114) | A-14 | 95.0 | None | 5.0 | 80 to 90% uniform | None | None | Comparative Example |
| (115) | A-15 | 95.0 | None | 5.0 | 80 to 90% uniform | I-49 | $2.50 \times 10^{-5}$ | Comparative Example |
| (116) | A-16 | 99.4 | 0.1 | 0.5 | 80 to 90% uniform | I-50 | $2.50 \times 10^{-5}$ | Present invention |
| (117) | A-17 | 99.4 | 0.1 | 0.5 | 80 to 90% uniform | I-21 | $2.50 \times 10^{-5}$ | Present invention |
| (118) | A-18 | 99.4 | 0.1 | 0.5 | 80 to 90% uniform | I-17 | $2.50 \times 10^{-5}$ | Present invention |

(Note 1)

The term "80 to 90% uniform" in the column "Position of bromine" means that the particle is being formed when the amount of silver of a complete particle is set to 100%.

(Note 2)

The position of potassium hexachloroiridate (IV) is in the silver bromide-localized phase in the case of the emulsions A-1 to A-3, A-10 and A-11 and in the 80 to 90% uniform phase in the case of the emulsions A-4 to A-9 and A-12 to A-18.

| Treating step | Temperature | Time | Replenished amount* |
|---|---|---|---|
| Color development | 45.0° C. | 15 sec | 45 ml |
| Bleaching-fixing | 40.0° C. | 15 sec | 35 ml |
| Rinse 1 | 40.0° C. | 8 sec | — |
| Rinse 2 | 40.0° C. | 8 sec | — |
| Rinse 3 | **40.0° C. | 8 sec | — |
| Rinse 4 | **38.0° C. | 8 sec | 121 ml |
| Drying | 80.0° C. | 15 sec | |

*Amount to be replenished per 1 $m^2$ of the light-sensitive material.

**A rinse cleaning system RC50D manufactured by Fuji Photo Film was set to the rinse (3) and a rinse solution was taken from the rinse (3) and fed to an reverse osmosis module (RC50D) by using a pump. The water which had passed through and was obtained in the vessel was supplied to the rinse (4) and the concentrated solution was returned to the rinse (3). Pump pressure was controlled such that the amount of water which had passed through the reverse osmosis was maintained in a range from 50 to 30 ml/min and the rinse solution was circulated under controlled temperature for 10 hours a day. Rinsing system was designed to be a four-tank counter current system from (1) to (4).

The composition of each processing solution is as follows.

The yellow color-developed density of each treated sample was measured after treatment to find 10 second-exposure low-illuminance sensitivity, fogging density, raw stock storability characteristics and moisture dependency of exposure. The results are shown in Table 4. The sensitivity was defined as a logarithmic value of an exposure amount giving a higher developed color density than the minimum developed color density by 1.0 and expressed as a relative value when the sensitivity of the developed sample (101) was the standard (0). The mark "+" shows high sensitivity and the mark "−" show low sensitivity. The fogging was expressed by the minimum density of each sample. The raw stock storability characteristics are evaluated by a difference (ΔS preservation) in sensitivity between the sample stored in the atmosphere of 50° C./55% RH for 3 days and the sample stored in the atmosphere of 25° C./55% RH for 3 days. The moisture dependency of exposure was evaluated by a difference (ΔS moisture) in sensitivity due to the aforementioned exposure between the light-sensitive materials which are kept at 25° C./55% RH and at 25° C./80% RH respectively.

| | Tank solution | Replenishing solution |
|---|---|---|
| Color developing solution | | |
| Water | 800 ml | 600 ml |
| Fluorescent whitening agent (FL-1) | 5.0 g | 8.5 g |
| Triisopropanolamine | 8.8 g | 8.8 g |
| Sodium p-toluenesulfoflate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Sodium 5-dihydroxybenzene-1,3-disulfonate | 0.50 g | 0.50 g |
| Disodium-N,N-bis (sulfonatoethyl)hydroxylamine | 8.5 g | 14.5 g |
| 4-Amino-3-methyl-N-ethyl-N-(β-methanesulfonamidoethyl) aniline•3/2sulfate•monohydrate | 10.0 g | 22.0 g |
| Potassium carbonate | 26.3 g | 26.3 g |
| Total amount (including water to be added) | 1000 ml | 1000 ml |
| pH (25° C., adjusted by sulfuric acid and KOH) | 0.35 | 12.6 |
| Bleaching/fixing solution | | |
| Water | 800 ml | 800 ml |
| Ammonium thiosulfate (750 g/ml) | 107 ml | 214 ml |
| Succinic acid | 29.5 g | 59.0 g |
| Iron (III) ammonium ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium methabisulfite | 23.1 g | 46.2 g |
| Total amount (including water to be added) | 1000 ml | 1000 ml |
| pH (25° C., adjusted by nitric acid and aqueous ammonia) | 6.00 | 6.00 |
| Rinse solution | | |
| Sodium chloroisocyarlurate | 0.02 g | 0.02 g |
| Deionized water (conductance: 5 μS/cm or less) | 1000 ml | 1000 ml |
| pH (25° C.) | 6.5 | 6.5 |

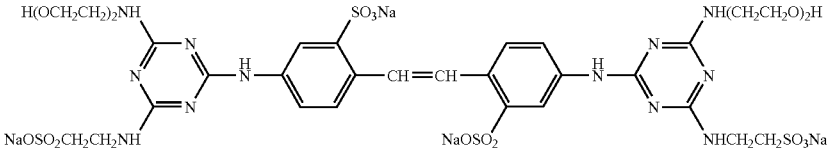

FL-1

TABLE 4

| Sample No. | Sensitivity | Fogging | ΔS preservation | ΔS moisture | Remarks |
|---|---|---|---|---|---|
| (101) | Standard 0 | 0.11 | +0.12 | −0.10 | Comparative Example |
| (102) | −0.02 | 0.10 | +0.03 | −0.02 | Present invention |
| (103) | −0.03 | 0.10 | +0.01 | −0.01 | Present invention |
| (104) | +0.05 | 0.10 | +0.11 | −0.10 | Comparative Example |
| (105) | +0.03 | 0.10 | +0.02 | −0.01 | Present invention |
| (106) | +0.02 | 0.09 | +0.01 | 0 | Present invention |
| (107) | −0.10 | 0.10 | +0.15 | −0.14 | Comparative Example |
| (108) | −0.13 | 0.10 | +0.04 | −0.05 | Comparative Example |
| (109) | −0.15 | 0.10 | +0.03 | −0.04 | Comparative Example |
| (110) | −0.03 | 0.09 | +0.12 | −0.13 | Comparative Example |
| (111) | −0.04 | 0.09 | +0.02 | −0.01 | Present invention |
| (112) | +0.15 | 0.21 | +0.10 | −0.12 | Comparative Example |
| (113) | +0.13 | 0.19 | +0.01 | −0.02 | Comparative Example |
| (114) | +0.05 | 0.14 | +0.12 | −0.11 | Comparative Example |
| (115) | +0.03 | 0.12 | +0.02 | −0.02 | Comparative Example |
| (116) | +0.03 | 0.09 | +0.02 | −0.01 | Present invention |
| (117) | +0.03 | 0.10 | +0.03 | −0.03 | Present invention |
| (118) | +0.03 | 0.10 | +0.04 | −0.04 | Present invention |

As a result, it can be seen that all of the samples of the present invention have lower fogging and superior raw stock storability characteristics and moisture dependency of exposure than the comparative samples. The same effects were observed in the emulsion B of the third layer and in the emulsion C of the fifth layer.

Example 2

The layer structure was changed as follows to prepare a thin-layered sample, which was tested in an experiment 1 made in an Example 1.

The layer structure is represented by that of a sample (201). Samples (202) to (218) are obtained in the same manner as in Example 1 except that the emulsion A-1 of the sample (201) was changed to each of the emulsions A-2 to A-18 as shown in Table 3.

The results are the same as those obtained in Example 1. From these results, the effects of the present invention have been also confirmed by super rapid treatment of the thin-layered sample.

(Production of a Sample 201)

| First layer (blue-sensitive emulsion layer) | |
|---|---|
| Emulsion A-1 | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| **Second layer (color mixing preventive layer)** | |
| Gelatin | 0.60 |
| Color mixing preventive (Cpd-19) | 0.09 |
| Color image stabilizer (Cpd-5) | 0.007 |
| Color image stabilizer (Cpd-7) | 0.007 |
| Ultraviolet absorber (UV-C) | 0.05 |
| Solvent (Solv-5) | 0.11 |
| **Third layer (green-sensitive emulsion layer)** | |
| Silver chlorobromide emulsion B (the same emulsion as that of the sample 101) | 0.14 |
| Gelatin | 0.73 |

-continued

| | |
|---|---|
| Magenta coupler (ExM) | 0.15 |
| Ultraviolet absorber (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| **Fourth layer (color mixing preventive layer)** | |
| Gelatin | 0.48 |
| Color mixing preventive (Cpd-4) | 0.07 |
| Color image stabilizer (Cpd-5) | 0.006 |
| Color image stabilizer (Cpd-7) | 0.006 |
| Ultraviolet absorber (UV-C) | 0.04 |
| Solvent (Solv-5) | 0.09 |
| **Fifth layer (red-sensitive emulsion layer)** | |
| Silver chlorobromide emulsion C (the same emulsion as that of the sample 101) | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet absorber (UV-7) | 0.02 |
| Solvent (Solv-5) | 0.09 |
| **Sixth layer (ultraviolet absorbing layer)** | |
| Gelatin | 0.32 |
| Ultraviolet absorber(UV-C) | 0.42 |
| Solvent (Solv-7) | 0.08 |
| **Seventh layer (protective layer)** | |
| Gelatin | 0.70 |
| Acryl modified copolymer of polyvinyl alcohol (degree of modification: 17%) | 0.04 |
| Liquid paraffin | 0.01 |

-continued

| | |
|---|---|
| Surfactant (Cpd-13) | 0.01 |
| Polydimethylsiloxane | 0.01 |
| Silicon dioxide | 0.003 |

Each produced sample was exposed to light in the same manner as in the experiment 1 of Example 1 and the color developing treatment was carried out by super rapid treatment according to the developing treatment B shown below.

(Treatment B)

The above light-sensitive material was processed into a 127-mm-wide roll, which was then exposed imagewise and then treated continuously (running test) until the volume of the replenished solution consumed was two times the tank volume. The treatment using this running solution was designated treatment B. A mini-laboratory printer processor PP1258AR (manufactured by Fuji Photo film) which was modified so as to increase conveying speed with the intention of shortening the time required for a treating process was used in this treatment.

| Treating step | Temperature | Time | Replenished amount* |
|---|---|---|---|
| Color development | 45.0° C. | 12 sec | 45 ml |
| Bleaching-fixing | 40.0° C. | 12 sec | 35 ml |
| Rinse (1) | 40.0° C. | 4 sec | — |
| Rinse (2) | 40.0° C. | 4 sec | — |
| Rinse (3) | **40.0° C. | 4 sec | — |
| Rinse (4) | **40.0° C. | 4 sec | 121 ml |

*Amount to be replenished per 1 $m^2$ of the light-sensitive material.

**A rinse cleaning system RC50D manufactured by Fuji Photo Film was set to the rinse (3) and a rinse solution was taken from the rinse (3) and fed to an reverse osmosis module (RC50D) by using a pump. The penetrated water obtained in the vessel was supplied to the rinse (4) and the concentrated solution was returned to the rinse (3). Pump pressure was controlled such that the amount of water penetrated through the reverse osmosis was maintained in a range from 50 to 300 ml/min and the rinse solution was circulated under controlled temperature for 10 hours a day. The rinsing system was designed to be a four-tank counter current system from (1) to (4).

The composition of each processing solution is as follows.

| | Tank solution | Replenishing solution |
|---|---|---|
| Color developing solution | | |
| Water | 800 ml | 800 ml |
| Dimethylpolysiloxane type surfactant (Silicone KF351A, manufactured by Sin-Etsu Chemical) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminstilbene type fluorescent whitening agent (Hakkol FWA-SF, manufactured by Showa Chemical Industry) | 2.5 g | 5.0 g |
| Sodium sulfite | 0.1 g | 0.1 g |
| Disodium-N,N-bis(sulfonatoethyl)hydroxylamine | 8.5 g | 11.1 g |

-continued

| | Tank solution | Replenishing solution |
|---|---|---|
| N-ethyl-N-(β-methanesulfonamidoethyl)-3-methyl-4-amino-4-aminoaniline•3/2sulfate•monohydrate | 10.0 g | 22.0 g |
| Potassium carbonate | 26.3 g | 26.3 g |
| Total amount (including water to be added) | 1000 ml | 1000 ml |
| pH (25° C., adjusted by potassium hydroxide and sulfuric acid) | 10.15 | 12.50 |
| Bleaching/fixing solution | | |
| Water | 700 ml | 600 ml |
| Iron (III) ammonium ethylenediaminetetraacetate | 75.0 g | 150.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Potassium methabisulfite | 23.1 g | 46.2 g |
| Total amount (including water to be added) | 1000 ml | 1000 ml |
| pH (25° C., adjusted by acetic acid and ammonia) | 5.5 | 5.2 |
| Rinse solution | | |
| Sodium chloroisocyanurate | 0.02 g | 0.02 g |
| Deionized water (conductance: 5 μS/cm or less) | 1000 ml | 1000 ml |
| pH | 6.0 | 6.0 |

Example 3

The samples (201) to (218) were used to form an image by laser scanning exposure.

As the laser light sources, a light source of 473 nm taken, by wavelength conversion using an SHG crystal of $LiNbO_3$ with a reversal domain structure, from a YAG solid laser (oscillation wavelength: 946 nm), which used a semiconductor laser GaAlAs (oscillation wavelength: 808.7 nm) as an exciting light source, a light source of 532 nm taken, by wavelength conversion using an SHG crystal of $LiNbO_3$ with a reversal domain structure, from a $YVO_4$ solid laser (oscillation wavelength: 1064 nm), which used a semiconductor laser GaAlAs (oscillation wavelength: 808.7 nm) as an exciting light source. AlGaInP laser (oscillation wavelength: about 680 nm, Type No. LN9R20, manufactured by Matsushita Electric Industrial Co., Ltd) were used. Each of the laser light of these three colors was arranged so that it moves in the direction perpendicular to the scanning direction by a polygon mirror to perform scanning exposure sequentially on the sample. A variation of the quantity of light, which is caused by the temperature of the semiconductor laser, was suppressed by making use of a Peltier element to keep the temperature constant. An effective beam diameter was 80 μm, scanning pitch was 42.3 μm (600 dpi), and the average exposure time per pixel was $1.7\times10^{-7}$ seconds.

After exposure, the samples were treated according to the color developing treatment B. As a consequence, it has been found that the samples (202), (203), (205), (206), (211), (216), (217) and (218) of the present invention are all suitable for image formation using laser scanning exposure with the same results as those obtained in high illuminance exposure used in Example 2.

Example 4

Synthesis of the Exemplified Compound I-41

The exemplified compound I-41 was synthesized according to the following scheme.

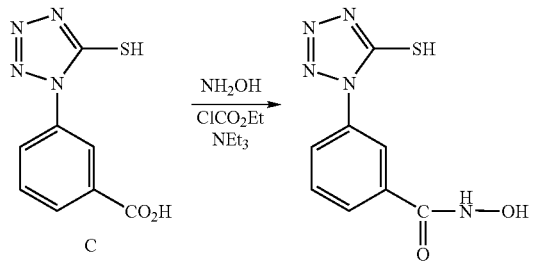

4.44 g (0.02 mol) of the raw material C and 40 ml of dimethylacetamide were put in a three necked flask, into which mixture 12.3 ml (0.088 mol) of triethylamine was then dripped. The mixture was cooled to −20° C. and 3.81 ml of ethyl chlorocarbonate was slowly added to the mixture. Thereafter, 2.78 g (0.04 mol) of hydroxylamine hydrochloride was added to the resulting mixture, which was then stirred at −20° C. for one hour. The temperature was raised to room temperature and the mixture was allowed to stand overnight. After the reaction solution was made acidic by adding concentrated hydrochloric acid, a product was extracted with ethyl acetate. The organic layer was washed with an aqueous NaCl solution. The solvents were distilled from the organic layer and a small amount of acetonitrile was added to the residue to thereby precipitate crystals. These crystal were collected by filtration to obtain the product. The structure of the product was confirmed by NMR and elemental analysis. The amount of the product was 3.2 g (yield: 67%).

| Elemental analysis $C_8H_7N_5O_2S$ = 237.24 | | | | |
|---|---|---|---|---|
| | H | C | N | S |
| Calculated value | 2.97 | 40.50 | 29.52 | 13.52 |
| Analytical value | 3.11 | 40.37 | 29.21 | 13.26 |

Synthesis of the Exemplified Compound I-49

The exemplified compound I-49 was synthesized according to the following scheme.

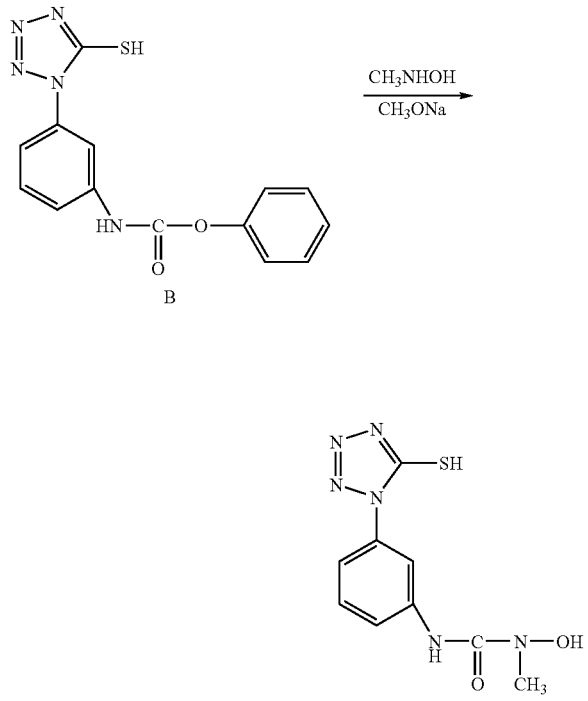

A 31.3 g (0.1 mol) of the raw material B, 16.7 g (0.2 mol) of N-methylhydroxylamine hydrochloride and 80 ml of methanol were put into a three necked flask, into which 96.5 g (0.5 mol) of 28% sodium methoxide was dripped while the mixture was cooled in an ice bath and vigorously stirred. After the mixture was heated and stirred at 60° C. for one hour, 320 ml of water was added to the mixture, followed by stirring at 40° C. for one hour. A resulting reaction solution was cooled with ice and then dripped to a mixed solution of 51.5 ml of hydrochloric acid and 80 ml of water while being stirred. After stirring of the solution was continued for 30 minutes, the precipitates were collected and washed by splashing 50 ml of water thereon. The structure of the product was confirmed by NMR and elemental analysis. The amount of the product was 23.5 g (yield: 88.3%).

| Elemental analysis $C_9H_{10}N_6O_2S$ = 266.28 | | | | |
|---|---|---|---|---|
| | H | C | N | S |
| Calculated value | 3.79 | 40.59 | 31.56 | 12.04 |
| Analytical value | 3.95 | 40.35 | 31.42 | 12.11 |

Synthesis of the Exemplified Compound I-50

The exemplified compound I-50 was synthesized according to the following scheme.

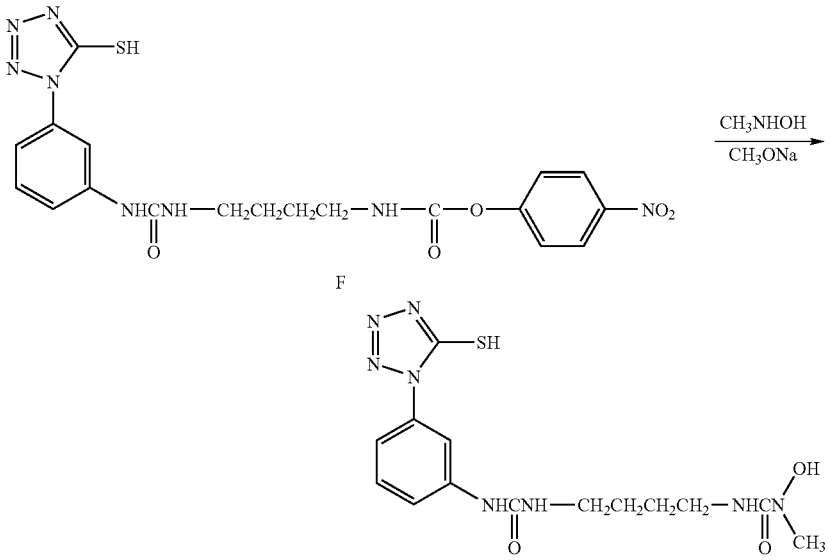

47.2 g (0.1 mol) of the raw material F, 16.7 g (0.2 mol) of N-methylhydroxylamine hydrochloride and 150 ml of methanol were put in a three necked flask, into which 96.5 g (0.5 mol) of 28% sodium methoxide was dripped while the mixture was cooled in an ice bath and vigorously stirred. After the mixture was heated and stirred at 60° C. for one hour, 350 ml of water was added to the mixture. A resulting reaction solution was cooled with ice and then dripped into a mixed solution of 55 ml of hydrochloric acid and 160 ml of water with stirring. After stirring of the solution was continued for 30 minutes, the precipitates were collected and washed by splashing 100 ml of water thereon. The structure of the product was confirmed by NMR and elemental analysis. The amount of the product was 28.6 g (yield: 75.1%).

| Elemental analysis $C_{14}H_{20}N_8O_3S$ = 380.43 | | | | |
|---|---|---|---|---|
| | H | C | N | S |
| Calculated value | 5.30 | 44.20 | 29.45 | 8.43 |
| Analytical value | 5.25 | 44.52 | 29.58 | 8.66 |

Synthesis of the Exemplified Compound I-51

The exemplified compound I-51 was synthesized according to the following scheme.

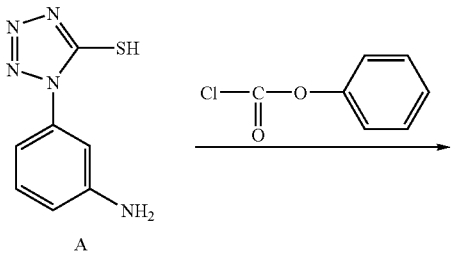

-continued

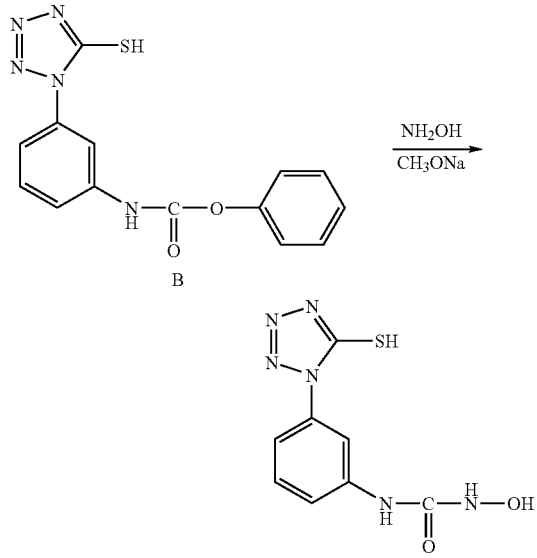

Synthesis of the Raw Material B 500 g (2.17 mol) of the raw material A and 1 L of dimethylacetamide were put in a three necked flask, into which 371.4 ml (4.77 mol) of pyridine was dripped while stirring. 370.7 g (2.37 mol) of phenyl chlorocarbonate was dripped into the mixture at a temperature ranging from 0 to 5° C. while the mixture was cooled in an ice bath. After the addition was finished, the temperature was raised to room temperature and stirring was continued for 3 hours. 650 ml of isopropyl alcohol was added to the reaction solution and 4 L of water was further added at 20° C. or less while the solution was cooled in an ice bath. 500 ml of isopropyl alcohol and a seed crystal were added to the solution, which was then stirred for one hour. The resulting crystals were collected and washed with water and isopropyl alcohol. The structure of the product was confirmed by NMR and elemental analysis. The amount of the product was 622.4 g (yield: 91.5%).

| Elemental analysis $C_{14}H_{11}N_5O_2S$ = 313.34 | | | | |
|---|---|---|---|---|
| | H | C | N | S |
| Calculated value | 3.54 | 53.66 | 22.35 | 10.23 |
| Analytical value | 3.63 | 53.53 | 22.27 | 10.11 |

Synthesis of the Exemplified Compound I-51

87.6 g (1.26 mol) of hydroxylamine hydrochloride, 200 g (0.63 mol) of the raw material B and 1 L of methanol were put in a three necked flask, into which 486 g (2.52 mol) of 28% sodium methoxide was dripped while the mixture was cooled in an ice bath and vigorously stirred. The mixture was heated at 55 to 60° C. for 3 hours and thereafter 500 ml of solvent methanol was distilled under reduced pressure. The reaction solution was slowly dripped into a mixed solution of 100 ml of concentrated hydrochloric acid and 500 ml of water. After the solution was stirred for 15 minutes, the precipitates were collected and washed by splashing 200 ml of water thereon. The powder thus obtained was recrystallized from 2500 ml of a methanol/water (1/1) solution. The structure of the product was confirmed by NMR and elemental analysis. The amount of the product was 41.5 g (yield: 26.1%).

| Elemental analysis $C_8H_8N_6O_2S$ = 252.25 | | | | |
|---|---|---|---|---|
| | H | C | N | S |
| Calculated value | 3.20 | 38.09 | 33.32 | 12.71 |
| Analytical value | 3.33 | 37.97 | 33.15 | 12.37 |

Synthesis of the Exemplified Compound I-52

The exemplified compound I-52 was synthesized according to the following scheme.

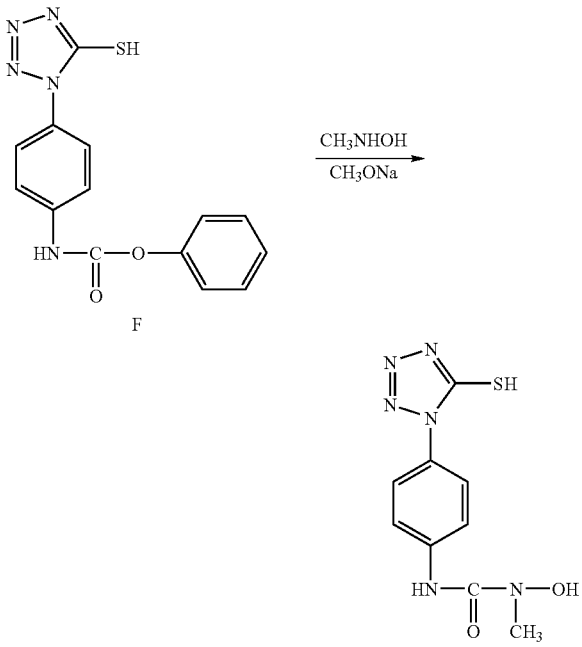

31.3 g (0.1 mol) of the raw material F, 16.7 g (0.2 mol) of N-methylhydroxylamine hydrochloride and 80 ml of methanol were put in a three necked flask, into which 96.5 g (0.5 mol) of 28% sodium methoxide was dripped while the mixture was cooled in an ice bath and vigorously stirred. After the mixture was heated and stirred at 60° C. for 2 hours, 320 ml of water was added to the mixture. A reaction solution thus obtained was cooled with ice and then dripped into a mixed solution of 51.5 ml of hydrochloric acid and 80 ml of water while stirring the mixed solution. After stirring of the solution was continued for 30 minutes, the precipitates were collected and washed by splashing 50 ml of water thereon. The structure of the product was confirmed by NMR and elemental analysis. The amount of the product was 22.8 g (yield: 85.8%).

| Elemental analysis $C_9H_{10}N_6O_2S$ = 266.28 | | | | |
|---|---|---|---|---|
| | H | C | N | S |
| Calculated value | 3.79 | 40.59 | 31.56 | 12.04 |
| Analytical value | 3.89 | 40.26 | 31.36 | 11.89 |

Synthesis of an Exemplified Compound I-58

The exemplified compound I-58 was synthesized according to the following scheme.

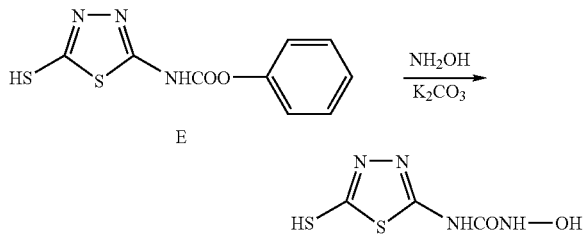

50.7 g (0.2 mol) of the raw material E, 55.28 g (0.4 mol) of potassium carbonate and 31-0 ml of isopropyl alcohol were put in a three necked flask, into which 20.8 g (0.3 mol) of hydroxylamine hydrochloride was dripped a little at a time while the mixture was cooled in an ice bath and vigorously stirred. After the mixture was heated under reflux for 2 hours, 350 ml of water was added to the mixture, followed by stirring one hour at 40° C. A reaction solution thus obtained was cooled with ice and then dripped into a mixed solution of 103 ml of hydrochloric acid and 206 ml of water while stirring the mixed solution. After the stirring of the solution was continued for 30 minutes, the precipitates were collected and washed by splashing 80 ml of water thereon. The structure of the product was confirmed by NMR and elemental analysis. The amount of the product was 31.6 g (yield: 82.3%).

| Elemental analysis $C_3H_4N_4O_2S_2$ = 192.22 | | | | |
|---|---|---|---|---|
| | H | C | N | S |
| Calculated value | 2.10 | 18.75 | 29.15 | 33.36 |
| Analytical value | 2.32 | 18.75 | 28.89 | 33.00 |

Synthesis of an Exemplified Compound I-62

The exemplified compound I-62 was synthesized according to the following scheme.

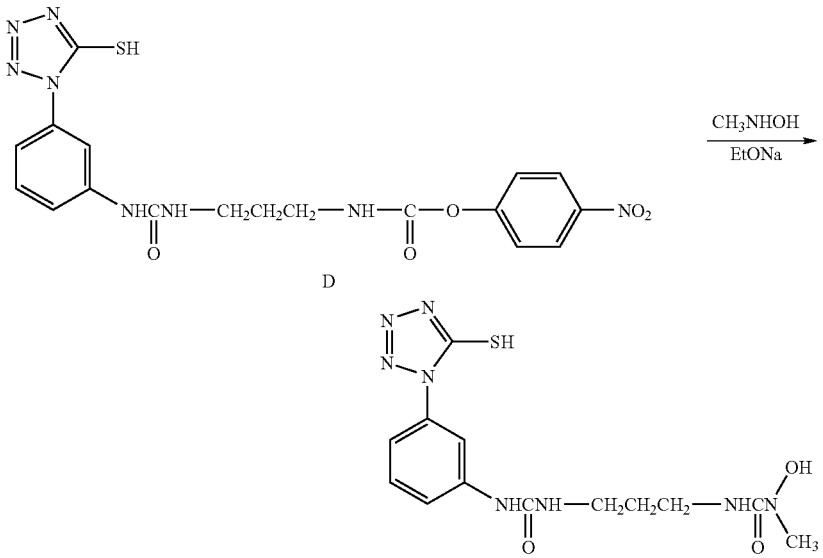

45.8 g (0.1 mol) of the raw material D, 16.7 g (0.2 mol) of N-methylhydroxylamine hydrochloride and 150 ml of ethanol were put in a three necked flask, into which 34 g (0.5 mol) of sodium ethoxide was dripped while the mixture was cooled in an ice bath and vigorously stirred. After the mixture was heated and stirred at 60° C. for 2 hours, 400 ml of water was added to the mixture, followed by stirring at 40° C. for one hour. A reaction solution thus obtained was cooled with ice and then dripped into a mixed solution of 51.5 ml of hydrochloric acid and 150 ml of water while stirring the mixed solution. After the solution was stirred for 30 minutes, the precipitates were collected and washed by splashing 100 ml of water thereon. The structure of the product was confirmed by NMR and elemental analysis. The amount of the product was 28.7 g (yield: 78.3%).

| Elemental analysis $C_{13}H_{18}N_8O_3S$ = 366.40 | | | | |
|---|---|---|---|---|
| | H | C | N | S |
| Calculated value | 4.95 | 42.61 | 30.58 | 8.75 |
| Analytical value | 5.11 | 42.55 | 30.39 | 8.57 |

Example 5

With regard to an exemplified compound (1-49) obtained by the following synthetic method, its photographic characteristics were evaluated in the same manner as in Example 1. The yellow color developed density of each treated sample was measured to find fogging density. The results are listed in Table 5 (judged from each fogging of the samples (102), (103), (105) and (106) and described in Table 5).

Synthesis of the Exemplified Compound I-49 (Runs 1 to 3)

87.6 g (1.26 mol) of N-methylhydroxylamine hydrochloride and 1 L of methanol were put in a three necked flask, into which 243 g (1.26 mol) of 28% sodium methoxide was dripped while the mixture was cooled in an ice bath and vigorously stirred. The salt thus generated was separated by filtration and placed together with 200 g (0.63 mol) of the raw material B in a three necked flask (run 1). The mixture was heated at 55 to 60° C. for 3 hours and thereafter 500 ml of solvent methanol was distilled under reduced pressure. The reaction solution was slowly dripped into a mixed solution of 100 ml of concentrated hydrochloric acid and 500 ml of water. After the solution was stirred for 15 minutes, the precipitates were collected and washed by splashing 200 ml of water thereon. The obtained powder was recrystallized from 2500 ml of an ethanol/water (1/1) solution. The amount of the product was 41.5 g (yield: 26.1%).

The reaction was run in the same manner as above except that the amount of an alkali to be added was altered (runs 2 to 3). The progress of the reaction and the photographic characteristics are listed in Table 5.

TABLE 5

| run | Amount of hydroxylamine (equivalent weights to the raw material B) | Amount of an alkali to be added (equivalent weights to the raw material B) | Excess alkali content(note 1) | Photographic fogging(note 2) (judged from the value of Dmin) |
|---|---|---|---|---|
| 1 | 2 Equivalent | 2 Equivalent | −2 Equivalent | Large |
| 2 | 2 Equivalent | 3 Equivalent | −1 Equivalent | Small |
| 3 | 2 Equivalent | 4 Equivalent | 0 Equivalent | None |

(note 1)two equivalents of the alkali are required to neutralize - SH of the raw material and ph - OH of the byproduct. Therefore when two equivalents of hydroxylamines are added in like manner as in this reaction, addition of 4 equivalents of the alkali just satisfies the requirements for the neutralization of the reaction system.
(note 2)The photographic fogging was evaluated by classifying it into 4 ratings: large, middle, small and none.

It can be seen the results of Table 5 that an exemplified compound (1-49) in which fogging does not occur and having better photographic performances is obtained by adding an alkali in an amount equal to or larger than the neutralization amount.

Example 6

The exemplified compounds (I-41), (I-49), (I-50), (I-51), (I-52), (I-54), (I-62) and (I-63) were also evaluated photographically. Like the hydrazine compound having an adsorptive group as described in JP-A No. 7-134351, it can be seen that these example compounds improved with respect to desensitization from color sensitizers, so-called chromatic desensitization, without increasing in their sensitivity to fogging.

Example 7

The exemplified compounds (I-41), (I-49), (I-50), (I-51), (I-52), (I-54), (I-62) and (I-63) were also evaluated photographically according to the photographic evaluation described in Example 5 of the publication of JP-A No. 7-134351. As a result, it was found that these exemplified compounds were improved in spectral sensitization while limiting fogging to a low level.

What is claimed is:

1. A silver halide color photographic light-sensitive material comprising at least one compound represented by the following Formula (IV):

$$X\text{-}(L_1')_n\text{-}Y_3 \qquad \text{Formula (IV)}$$

wherein: X represents one of a five-, six- or seven-membered heterocycle having, as constitutents of its ring structure, three or more heteroatoms; a five-, six- or seven-membered heterocycle which has a quaternary nitrogen atom and is represented by the following "a"; a five-, six- or seven-membered heterocycle which includes nitrogen and has a thioxo group and is represented by the following "b"; a five-, six-, or seven-membered heterocycle which includes nitrogen and is represented by the following "c"; and a five-, six-, or seven-membered heterocycle which includes nitrogen and is represented by the following "d" or "e"

a

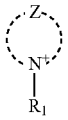

b

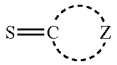

c

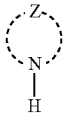

d

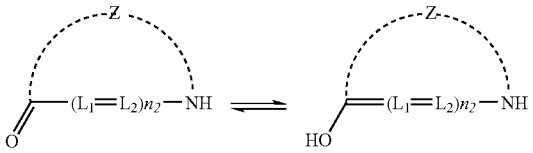

e

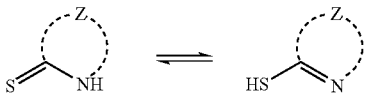

wherein Z represents an atomic group required to form a nitrogen-containing five-, six-or seven-membered heterocycle; $R_1$ represents an alkyl group, an alkenyl group or an alkynyl group; $L_1$, and $L_2$ respectively represents a methine group; and $n_2$ represents 0, 1 or 2, n denotes an integer of 0 or 1; $L_1'$ represents a divalent connecting group, provided that the atom of $L_1'$, which is directly connected to $Y_3$, is a carbon atom; $Y_3$ is any group selected from the groups represented by the following ($B_1$), ($B_2$) or ($B_4$); and $R_{b1}$, $R_{b2}$ and $R_{b3}$ in the groups represented by the following ($B_1$), ($B_2$) or ($B_4$) respectively denote one of a hydrogen atom, an alkyl group, an alkenyl group, an alkynyl group, an aryl group and a heterocyclic group, provided that when $Y_3$ is a group represented by ($B_1$), n is 1 and $L_1'$ is a heterocyclic group having a divalent carbon atom directly connected to $Y_3$, and when $Y_3$ is a group represented by ($B_2$) and $R_{b1}$ is a hydrogen atom, n is 1 and $L_1'$ has a carbon atom which is directly connected to $Y_3$, which carbon atom is part of an alkylene group or —CO— in $L_1'$ ($B_1$)

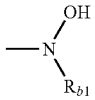

($B_2$)

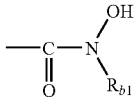

($B_4$)

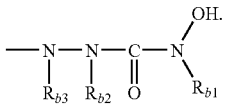

2. A silver halide color photographic light-sensitive material according to claim 1, wherein $Y_3$ is any group selected from the groups represented by ($B_2$) or ($B_4$).

3. A silver halide color photographic light-sensitive material according to claim 1, wherein $Y_3$ is ($B_4$).

4. A silver halide color photographic light-sensitive material according to claim 1, wherein $R_{b1}$ of the groups represented by ($B_1$), ($B_2$) or ($B_4$) is any of an alkyl group, an alkenyl group, an aryl group and a heterocyclic group.

5. A silver halide color photographic light-sensitive material according to claim 4, wherein $R_{b1}$ is an alkyl group.

6. A silver halide color photographic light-sensitive material according to claim 4, wherein $R_{b1}$ is a methyl group.

7. A silver halide color photographic light-sensitive material according to claim 1, wherein the compound represented by the Formula (IV) is a compound represented by the following Formula (V):

$$X\text{-}(L_2')_n\text{-}Y_3 \qquad \text{Formula (V)}$$

wherein X and n are the same as those in the Formula (IV); $Y_3$ is any group selected from the groups represented by ($B_2$) or ($B_4$); $L_2'$ represents an alkylene group, —CO—, —$SO_2$—, —NR— or a divalent connecting group comprising a combination of at least two of these groups; R represents one of a hydrogen atom, an alkyl group and an aryl group, provided that the atom of $L_2'$, which is directly connected to $Y_3$, is a carbon atom, and that when $Y_3$ is a group represented by ($B_2$) and $R_{b1}$ is a hydrogen atom, n is 1 and $L_2'$ has a carbon atom which is directly connected to $Y_3$ which carbon atom is part of an alkylene group or —CO— in $L_2'$.

8. A silver halide color photographic light-sensitive material comprising a compound represented by the following Formula (VI):

Formula (VI)

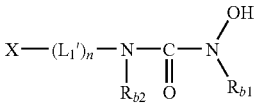

wherein X represents one of a five-, six- or seven-membered heterocycle having, as constitutents of its ring structure, three or more heteroatoms; a five-, six- or seven-membered heterocycle which has a quaternary nitrogen atom and is represented by the following "a"; a five-, six- or seven-membered heterocycle which includes nitrogen and has a thioxo group and is represented by the following "b"; a five-, six-, or seven-membered heterocycle which includes nitrogen and is represented by the following "c"; and a five-, six-, or seven-membered heterocycle which includes nitrogen and is represented by the following "d" or "e"

a

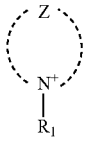

b

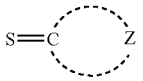

c

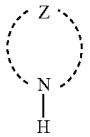

d

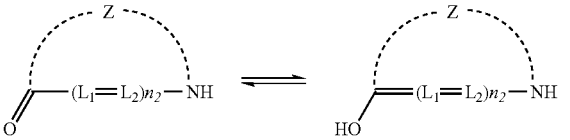

e

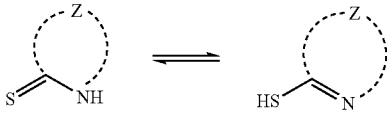

wherein Z represents an atomic group required to form a nitrogen-containing five-, six- or seven-membered heterocycle; $R_1$ represents an alkyl group, an alkenyl group or an alkynyl group; $L_1$, and $L_2$ respectively represents a methine group; and $n_2$ represents 0, 1 or 2, n denotes an integer of 0 or 1; $L_1$' represents a divalent connecting group, provided that the atom of $L_1$' which is directly connected to the nitrogen atom which is connected to $R_{b2}$ is a carbon atom; and $R_{b1}$ represents a group selected from an alkyl group, an alkenyl group, an alkynyl group, an aryl group and a heterocyclic group, and $R_{b2}$ represents a member selected from a hydrogen atom, an alkyl group, an alkenyl group, an alkynyl group, an aryl group and a heterocyclic group.

9. A silver halide color photographic light-sensitive material according to claim 1, wherein X is a compound represented by one of the following Formulae (X-a) to (X-e):

(X-a)

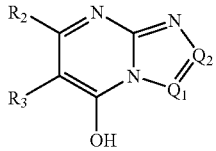

$Q_1 = N, Q_2 = C—R_4$ or $Q_1 = C—R_4, Q_2 = N$ (X-b)

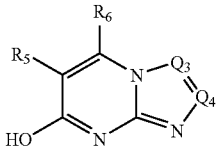

$Q_3 = N, Q_4 = C—R_7$ or $Q_3 = C—R_7, Q_4 = N$ (X-c)

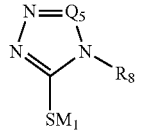

$Q_5 = N$ or $C—R_8$ (X-d)

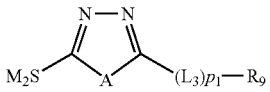

(X-e)

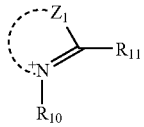

wherein $R_2$ to $R_7$ and $R_a$ respectively represents a hydrogen atom or a monovalent substituent; $R_8$ represents an alkyl group, an alkenyl group, an alkynyl group, an aryl group or a heterocyclic group; $R_9$ represents a hydrogen atom, an alkyl group, an alkenyl group, an alkynyl group, an aryl group or a heterocyclic group; $R_{10}$ represents an alkyl group, an alkenyl group or an alkynyl group; $R_{11}$ represents a hydrogen atom, an alkyl group, an alkenyl group or an alkynyl group; $L_3$ represents a divalent connecting group; $M_1$ and $M_2$ respectively represents a hydrogen atom, an alkali metal atom, an ammonium group or a block group, $p_1$ is an integer from 0 to 3; A represents an oxygen atom, a sulfur atom, >NH or >N-$(L_4)p_2$-$R_{12}$ (wherein: $L_4$ respectively represents a divalent connecting group; $R_{12}$ represents a hydrogen atom, an alkyl group, an alkenyl group, an alkynyl group, an aryl group or a heterocyclic group; and $p_2$s respectively denotes an integer from 0 to 3); and $Z_1$ represents an atomic group necessary to form a nitrogen-containing five-, six- or seven-membered heterocycle.

10. A silver halide color photographic light-sensitive material according to claim 9, wherein X is a compound represented by Formula (X-c).

11. A silver halide color photographic light-sensitive material according to claim 10, wherein X is one of the following compounds:

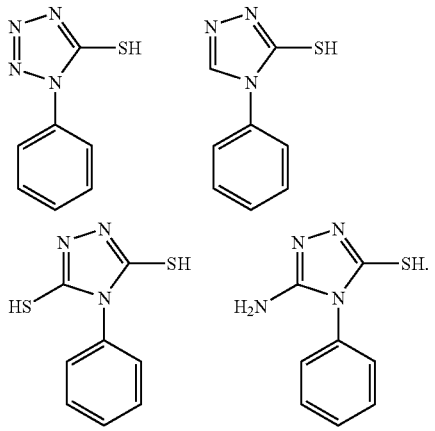
12. A silver halide color photographic light-sensitive material according to claim 1, wherein n is 0.
13. A silver halide emulsion comprising at least one of the following compounds I-49, I-50 and I-52 to I-67:
I-49)
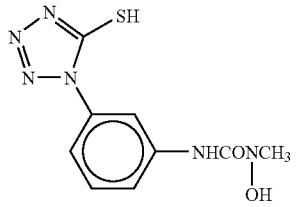
I-50)
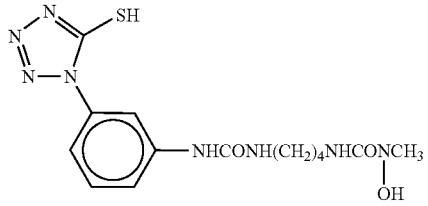
I-52)
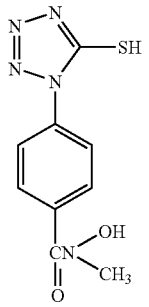
I-53)
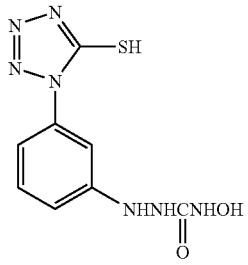
-continued
I-54)
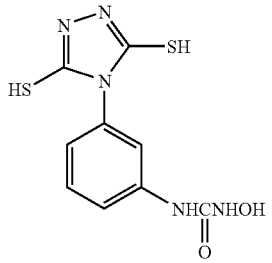
I-55)
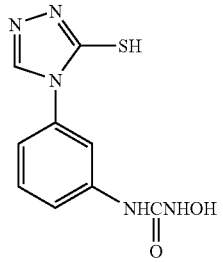
I-56)
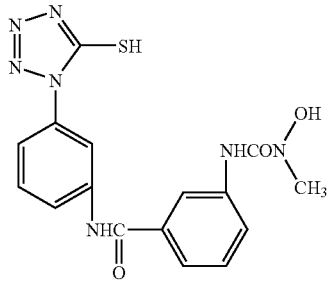
I-57)
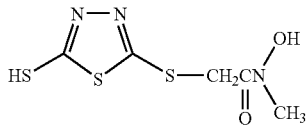
I-58)
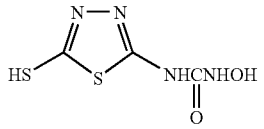
I-59)
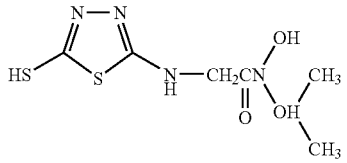
I-60)
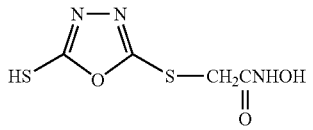
I-61)
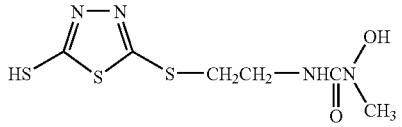

-continued

I-62)

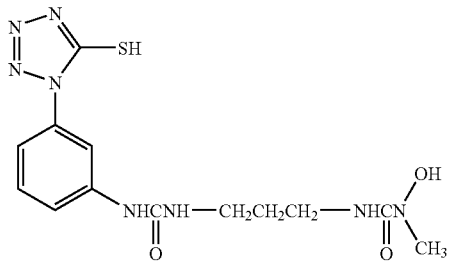

I-63)

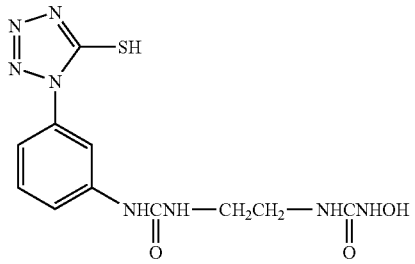

I-64)

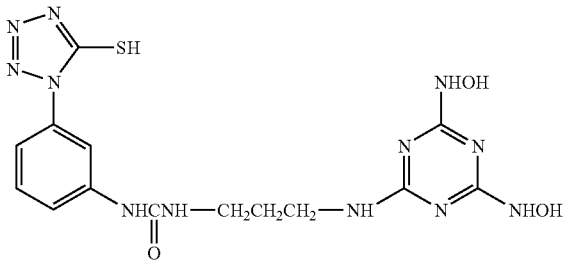

I-65)

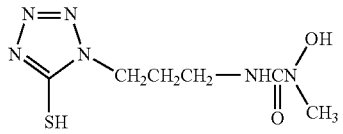

I-66)

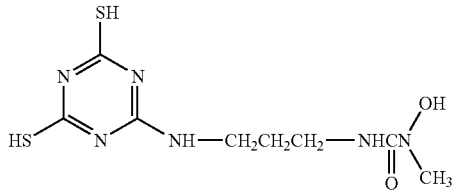

I-67)

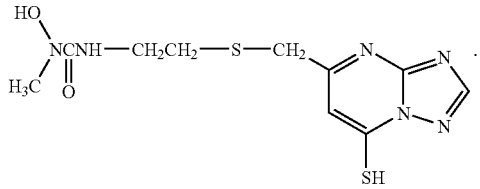

14. A silver halide color photographic light-sensitive material according to claim 1, wherein the compound represented by Formula (IV) is comprised in at least one silver halide emulsion comprised in the silver halide color photographic light-sensitive material.

15. A silver halide color photographic light-sensitive material according to claim 8, wherein $R_{b1}$ is an alkyl group.

16. A silver halide color photographic light-sensitive material according to claim 15, wherein $R_{b1}$ is a methyl group.

17. A silver halide color photographic light-sensitive material according to claim 8, wherein X is a compound represented by one of the following Formulae (X-a) to (X-e):

(X-a)

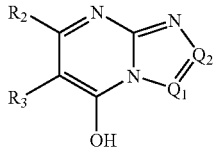

$Q_1 = N, Q_2 = C—R_4$ or $Q_1 = C—R_4, Q_2 = N$ (X-b)

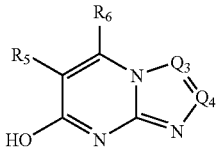

$Q_3 = N, Q_4 = C—R_7$ or $Q_3 = C—R_7, Q_4 = N$ (X-c)

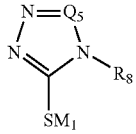

$Q_5 = N$ or $C—R_8$ (X-d)

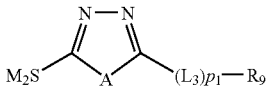

(X-e)

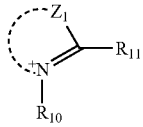

wherein $R_2$ to $R_7$ and $R_a$ respectively represents a hydrogen atom or a monovalent substituent; $R_8$ represents an alkyl group, an alkenyl group, an alkynyl group, an aryl group or a heterocyclic group; $R_9$ represents a hydrogen atom, an alkyl group, an alkenyl group, an alkynyl group, an aryl group or a heterocyclic group; $R_{10}$ represents an alkyl group, an alkenyl group or an alkynyl group; $R_{11}$ represents a hydrogen atom, an alkyl group, an alkenyl group or an alkynyl group; $L_3$ represents a divalent connecting group; $M_1$ and $M_2$ respectively represents a hydrogen atom, an alkali metal atom, an ammonium group or a block group, $p_1$ is an integer from 0 to 3; A represents an oxygen atom, a sulfur atom, >NH or >N-$(L_4)p_2$-$R_{12}$ (wherein: $L_4$ respectively represents a divalent connecting group; $R_{12}$ represents a hydrogen atom, an alkyl group, an alkenyl group, an alkynyl group, an aryl group or a heterocyclic group; and $p_2$s respectively denotes an integer from 0 to 3); and $Z_1$ represents an atomic group necessary to form a nitrogen-containing five-, six- or seven-membered heterocycle.

18. A silver halide color photographic light-sensitive material according to claim 17, wherein X is a compound represented by Formula (X-c).

19. A silver halide color photographic light-sensitive material according to claim 18, wherein X is one of the following compounds:
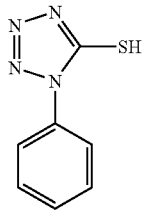
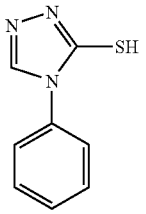
-continued
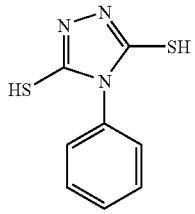
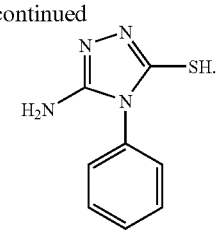
20. A silver halide color photographic light-sensitive material according to claim 8, wherein n is 0.
* * * * *